US009161149B2

(12) United States Patent
Visser et al.

(10) Patent No.: US 9,161,149 B2
(45) Date of Patent: Oct. 13, 2015

(54) THREE-DIMENSIONAL SOUND COMPRESSION AND OVER-THE-AIR TRANSMISSION DURING A CALL

(71) Applicant: QUALCOMM Incorporated, San Diego, CA (US)

(72) Inventors: Erik Visser, San Diego, CA (US); Lae-Hoon Kim, San Diego, CA (US); Pei Xiang, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 267 days.

(21) Appl. No.: 13/664,701

(22) Filed: Oct. 31, 2012

(65) Prior Publication Data

US 2013/0317830 A1 Nov. 28, 2013

Related U.S. Application Data

(60) Provisional application No. 61/651,185, filed on May 24, 2012.

(51) Int. Cl.

| | |
|---|---|
| ***G10L 19/00*** | (2013.01) |
| ***G10L 21/00*** | (2013.01) |
| ***H04S 3/00*** | (2006.01) |
| ***G10L 19/008*** | (2013.01) |

(52) U.S. Cl.

CPC ..... *H04S 3/006* (2013.01); *G10L 19/00* (2013.01); *G10L 19/008* (2013.01)

(58) Field of Classification Search

USPC ..... 704/200–257, 500–504

See application file for complete search history.

(56) References Cited

U.S. PATENT DOCUMENTS

| | | | | |
|---|---|---|---|---|
| 7,184,559 | B2 | 2/2007 | Jouppi | |
| 7,489,788 | B2 * | 2/2009 | Leung et al. | 381/92 |
| 7,606,373 | B2 | 10/2009 | Moorer | |
| 7,826,624 | B2 * | 11/2010 | Oxford | 381/92 |
| 8,005,237 | B2 * | 8/2011 | Tashev et al. | 381/92 |
| 8,098,842 | B2 * | 1/2012 | Florencio et al. | 381/92 |
| 8,396,226 | B2 * | 3/2013 | KnicKrehm et al. | 381/58 |
| 2001/0044713 | A1 * | 11/2001 | Lokhoff et al. | 704/201 |
| 2003/0138108 | A1 * | 7/2003 | Gentle | 381/23 |
| 2005/0060142 | A1 * | 3/2005 | Visser et al. | 704/201 |
| 2007/0038442 | A1 * | 2/2007 | Visser et al. | 704/233 |
| 2008/0004729 | A1 | 1/2008 | Hiipakka | |

(Continued)

FOREIGN PATENT DOCUMENTS

| | | | |
|---|---|---|---|
| EP | 1852689 | A1 | 11/2007 |
| WO | WO-2012061149 | A1 | 5/2012 |

OTHER PUBLICATIONS

Anonymous: "A/52B, ATSC standard, Digital audio compression standard (AC-3, E-AC-3), revision B", Not Known, Jun. 14, 2005, XP030001573.

(Continued)

*Primary Examiner* — Jesse Pullias

(74) *Attorney, Agent, or Firm* — Austin Rapp & Hardman

(57) ABSTRACT

A method for encoding three dimensional audio by a wireless communication device is disclosed. The wireless communication device detects an indication of a plurality of localizable audio sources. The wireless communication device also records a plurality of audio signals associated with the plurality of localizable audio sources. The wireless communication device also encodes the plurality of audio signals.

32 Claims, 47 Drawing Sheets

(56) References Cited

U.S. PATENT DOCUMENTS

| | | | |
|---|---|---|---|
| 2008/0071549 | A1 | 3/2008 | Chong et al. |
| 2008/0232601 | A1 | 9/2008 | Pulkki |
| 2009/0080632 | A1 | 3/2009 | Zhang et al. |
| 2009/0129609 | A1 | 5/2009 | Oh et al. |
| 2010/0053466 | A1 | 3/2010 | Naka et al. |
| 2011/0033063 | A1 | 2/2011 | Mcgrath et al. |
| 2011/0103591 | A1 | 5/2011 | Ojala |
| 2012/0013768 | A1 | 1/2012 | Zurek et al. |
| 2012/0128160 | A1 | 5/2012 | Kim et al. |
| 2012/0128174 | A1 | 5/2012 | Tammi et al. |
| 2012/0284619 | A1 | 11/2012 | Myllyla et al. |
| 2013/0315402 | A1 | 11/2013 | Visser et al. |
| 2014/0297296 | A1 | 10/2014 | Koppens et al. |

OTHER PUBLICATIONS

Jeroen Breebaart et al., "MPEG Spatial Audio Coding / MPEG Surround: Overview and Current Status", AES Convention 119; Oct. 2005, Aes, 60 East 42nd Street, Room 2520, New York 10165-2520, USA, Oct. 1, 2005, XP040507423.

Makinen J. et al., "AMR-WB+: a New Audio Coding Standard for 3rd Generation Mobile Audio Services", 2005 IEEE International Conference on Acoustics, Speech, and Signal Processing—Mar. 18-23, 2005—Philadelphia, PA, USA, IEEE, Piscataway, NJ, vol. 2, Mar. 18, 2005, pp. 1109-1112, XP010790838, DOI: 10.1109/ICASSP.2005.1415603, ISBN: 978-0-7803-8874-1.

Mizumoto T., et al., "Design and implementation of selectable sound separation on the Texai telepresence system using HARK", Robotics and Automation (ICRA), 2011 IEEE International Conference on, IEEE, May 9, 2011, pp. 2130-2137, XP032033716, DOI: 10.1109/ICRA.2011.5979849 ISBN: 978-1-61284-386-5 p. 2132, left-hand column, paragraph "B Overview of Selectable sound separation"—paragraph C. Integration of HARK and Texai; figures 3,6.

International Search Report and Written Opinion—PCT/US2013/040137 International Search Authority—European Patent Office, Dec. 20, 2013.

ETSI 126 290 v10.0.0, Apr. 2004, pp. 13-15, 20-22.

Nguyen et al., "Structures fior M Channel Perfect Reconstruction FIR QMF Banks which Yields Linear Phase Analysis Filters," Mar. 1990, pp. 433-436.

Sjoberg et al., "RTP Payload Format for Extensded AMR Wideband Audio Codec," Mar. 2006, pp. 21 and 23.

* cited by examiner

THREE-DIMENSIONAL SOUND COMPRESSION AND OVER-THE-AIR TRANSMISSION DURING A CALL

RELATED APPLICATIONS

This application is related to and claims priority from U.S. Provisional Patent Application Ser. No. 61/651,185 filed May 24, 2012, for "THREE-DIMENSIONAL SOUND COMPRESSION AND OVER-THE-AIR TRANSMISSION DURING A CALL."

TECHNICAL FIELD

This disclosure relates to audio signal processing. More specifically, this disclosure relates to three-dimensional sound compression and over-the-air transmission during a call.

BACKGROUND

As technology advances, we see the distinguishable growth of network speed and storage, which already supports not only text, but also multimedia data. In real-time cellular communication systems, the ability to capture, compress, and transmit three-dimensional (3-D) audio is not presently available. One of the challenges is the capturing of three-dimensional audio signals. Therefore, a benefit may be realized by capturing and reproducing three-dimensional audio for more realistic and immersive exchange of individual aural experiences.

SUMMARY

A method for encoding three dimensional audio by a wireless communication device is described. The method includes detecting an indication of a spatial direction of a plurality of localizable audio sources. The method also includes recording a plurality of audio signals associated with the plurality of localizable audio sources. The method further includes encoding the plurality of audio signals. The indication of the spatial direction of the localizable audio source may be based on received input.

The method may include determining a number of localizable audio sources. The method may also include estimating a direction of arrival of each localizable audio source. The method may include encoding a multichannel signal according to a three dimensional audio encoding scheme.

The method may include applying a beam in a first end-fire direction to obtain a first filtered signal. The method may also include applying a beam in a second end-fire direction to obtain a second filtered signal. The method may combine the first filtered signal with a delayed version of the second filtered signal. Each of the first and second filtered signals may have at least two channels. One of the filtered signals may be delayed relative to the other filtered signal. The method may delay a first channel of the first filtered signal relative to a second channel of the first filtered signal and delay a first channel of the second filtered signal relative to a second channel of the second filtered signal. The method may delay a first channel of the combined signal relative to a second channel of the combined signal.

The method may apply a filter having a beam in a first direction to a signal produced by a first pair of microphones to obtain a first spatially filtered signal and may apply a filter having a beam in a second direction to a signal produced by a second pair of microphones to obtain a second spatially filtered signal. The method may then combine the first and second spatially filtered signals to obtain an output signal.

The method may include recording, for each of a plurality of microphones in an array, a corresponding input channel. The method may also include applying, for each of a plurality of look directions, a corresponding multichannel filter to a plurality of the recorded input channels to obtain a corresponding output channel. Each of the multichannel filters may apply a beam in the corresponding look direction and a null beam in the other look directions. The method may include processing the plurality of output channels to produce a binaural recording. The method may include applying the beam to frequencies between a low threshold and a high threshold. At least one of the low and high thresholds is based on a distance between microphones.

A method for selecting a codec by a wireless communication device is described. The method includes determining an energy profile of a plurality of audio signals. The method also includes displaying the energy profile of each of the plurality of audio signals. The method also includes detecting an input that selects an energy profile. The method also includes associating a codec with the input. The method further includes compressing the plurality of audio signals based on the codec to generate a packet. The method may include transmitting the packet over the air. The method may include transmitting a channel identification.

A method for increasing bit allocation by a wireless communication device is described. The method includes determining an energy profile of a plurality of audio signals. The method also includes displaying the energy profile of each of the plurality of audio signals. The method also includes detecting an input that selects an energy profile. The method also includes associating a codec with the input. The method further includes increasing bit allocation to the codec used to compress audio signals based on the input. Compression of the audio signals may result in four packets being transmitted over the air.

A wireless communication device for encoding three dimensional audio by a wireless communication device is described. The wireless communication device includes spatial direction circuitry that detects an indication of a spatial direction of a plurality of localizable audio sources. The wireless communication device also includes recording circuitry coupled to the spatial direction circuitry. The recording circuitry records a plurality of audio signals associated with the plurality of localizable audio sources. The wireless communication device also includes an encoder coupled to the recording circuitry. The encoder encodes the plurality of audio signals.

A wireless communication device for selecting a codec by a wireless communication device is described. The wireless communication device includes energy profile circuitry that determines an energy profile of a plurality of audio signals. The wireless communication device includes a display coupled to the energy profile circuitry. The display displays the energy profile of each of the plurality of audio signals. The wireless communication device includes input detection circuitry coupled to the display. The input detection circuitry detects an input that selects an energy profile. The wireless communication device includes association circuitry coupled to the input detection circuitry. The association circuitry associates a codec with the input. The wireless communication device includes compression circuitry coupled to the association circuitry. The compression circuitry compresses the plurality of audio signals based on the codec to generate a packet.

A wireless communication device for increasing bit allocation by a wireless communication device is described. The wireless communication device includes energy profile circuitry that determines an energy profile of a plurality of audio signals. The wireless communication device includes a display coupled to the energy profile circuitry. The display displays the energy profile of each of the plurality of audio signals. The wireless communication device includes input detection circuitry coupled to the display. The input detection circuitry detects an input that selects an energy profile. The wireless communication device includes association circuitry coupled to the input detection circuitry. The association circuitry associates a codec with the input. The wireless communication device includes bit allocation circuitry coupled to the association circuitry. The bit allocation circuitry increases bit allocation to the codec used to compress audio signals based on the input.

A computer-program product for encoding three dimensional audio is described. The computer-program product includes a non-transitory tangible computer-readable medium having instructions thereon. The instructions include code for causing a wireless communication device to detect an indication of a spatial direction of a plurality of localizable audio sources. The instructions include code for causing the wireless communication device to record a plurality of audio signals associated with the plurality of localizable audio sources. The instructions include code for causing the wireless communication device to encode the plurality of audio signals.

A computer-program product for selecting a codec is described. The computer-program product includes a non-transitory tangible computer-readable medium having instructions thereon. The instructions include code for causing a wireless communication device to determine an energy profile of a plurality of audio signals. The instructions include code for causing a wireless communication device to display the energy profile of each of the plurality of audio signals. The instructions include code for causing a wireless communication device to detect an input that selects an energy profile. The method also includes associating a codec with the input. The instructions include code for causing a wireless communication device to compress the plurality of audio signals based on the codec to generate a packet.

A computer-program product for increasing bit allocation is described. The computer-program product includes a non-transitory tangible computer-readable medium having instructions thereon. The instructions include code for causing a wireless communication device to determine an energy profile of a plurality of audio signals. The instructions include code for causing a wireless communication device to display the energy profile of each of the plurality of audio signals. The instructions include code for causing a wireless communication device to detect an input that selects an energy profile. The method also includes associating a codec with the input. The instructions include code for causing a wireless communication device to increase bit allocation to the codec used to compress audio signals based on the input.

DETAILED DESCRIPTION

Figure 1:
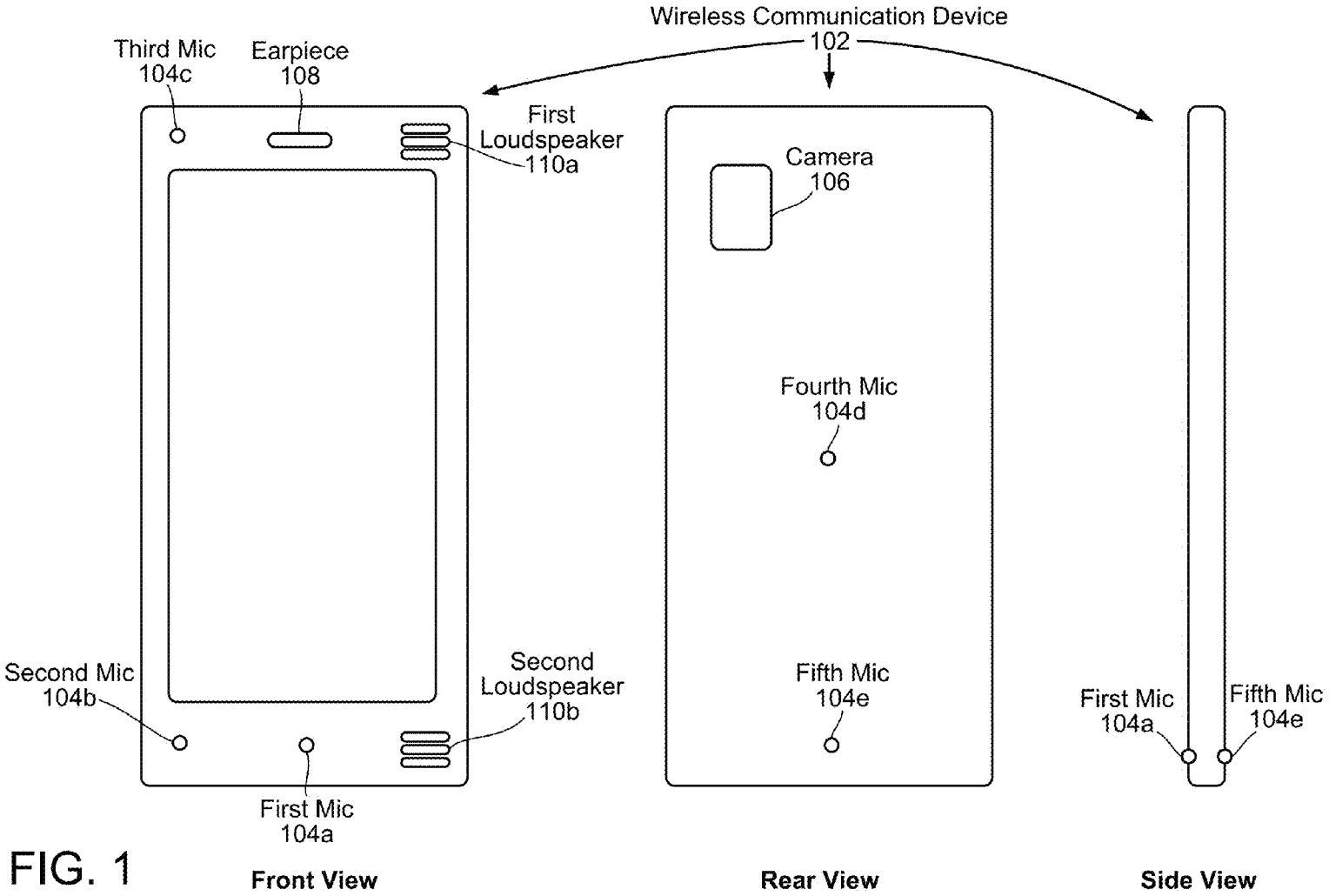
FIG. 1 illustrates a microphone placement on a representative handset for cellular telephony.

Examples of communication devices include cellular telephone base stations or nodes, access points, wireless gateways and wireless routers. A communication device may operate in accordance with certain industry standards, such as Third Generation Partnership Project (3GPP) Long Term Evolution (LTE) standards. Other examples of standards that a communication device may comply with include Institute of Electrical and Electronics Engineers (IEEE) 802.11a, 802.11b, 802.11g, 802.11n and/or 802.11ac (e.g., Wireless Fidelity or "Wi-Fi") standards, IEEE 802.16 (e.g., Worldwide Interoperability for Microwave Access or "WiMAX") standard and others. In some standards, a communication device may be referred to as a Node B, evolved Node B, etc. While some of the systems and methods disclosed herein may be described in terms of one or more standards, this should not limit the scope of the disclosure, as the systems and methods may be applicable to many systems and/or standards.

Some communication devices (e.g., access terminals, client devices, client stations, etc.) may wirelessly communicate with other communication devices. Some communication devices (e.g., wireless communication devices) may be referred to as mobile devices, mobile stations, subscriber stations, clients, client stations, user equipment (UEs), remote stations, access terminals, mobile terminals, terminals, user terminals, subscriber units, etc. Additional examples of communication devices include laptop or desktop computers, cellular phones, smart phones, wireless modems, e-readers, tablet devices, gaming systems, etc. Some of these communication devices may operate in accordance with one or more industry standards as described above. Thus, the general term "communication device" may include communication devices described with varying nomenclatures according to industry standards (e.g., access terminal, user equipment, remote terminal, access point, base station, Node B, evolved Node B, etc.).

Some communication devices may be capable of providing access to a communications network. Examples of communications networks include, but are not limited to, a telephone network (e.g., a "land-line" network such as the Public-Switched Telephone Network (PSTN) or cellular phone network), the Internet, a Local Area Network (LAN), a Wide Area Network (WAN), a Metropolitan Area Network (MAN), etc.

Unless expressly limited by its context, the term "signal" is used herein to indicate any of its ordinary meanings, including a state of a memory location (or set of memory locations) as expressed on a wire, bus, or other transmission medium. Unless expressly limited by its context, the term "generating" is used herein to indicate any of its ordinary meanings, such as computing or otherwise producing. Unless expressly limited by its context, the term "calculating" is used herein to indicate any of its ordinary meanings, such as computing, evaluating, smoothing and/or selecting from a plurality of values. Unless expressly limited by its context, the term "obtaining" is used to indicate any of its ordinary meanings, such as calculating, deriving, receiving (e.g., from an external device), and/or retrieving (e.g., from an array of storage elements). Unless expressly limited by its context, the term "selecting" is used to indicate any of its ordinary meanings, such as identifying, indicating, applying, and/or using at least one, and fewer than all, of a set of two or more. Where the term "comprising" is used in the present description and claims, it does not exclude other elements or operations. The term "based on" (as in "A is based on B") is used to indicate any of its ordinary meanings, including the cases (i) "derived from" (e.g., "B is a precursor of A"), (ii) "based on at least" (e.g., "A is based on at least B") and, if appropriate in the particular context, (iii) "equal to" (e.g., "A is equal to B"). Similarly, the term "in response to" is used to indicate any of its ordinary meanings, including "in response to at least."

References to a "location" of a microphone of a multi-microphone audio sensing device indicate the location of the center of an acoustically sensitive face of the microphone, unless otherwise indicated by the context. The term "channel" is used at times to indicate a signal path and at other times to indicate a signal carried by such a path, according to the particular context. Unless otherwise indicated, the term "series" is used to indicate a sequence of two or more items. The term "logarithm" is used to indicate the base-ten logarithm, although extensions of such an operation to other bases are within the scope of this disclosure. The term "frequency component" is used to indicate one among a set of frequencies or frequency bands of a signal, such as a sample of a frequency domain representation of the signal (e.g., as produced by a fast Fourier transform) or a subband of the signal (e.g., a Bark scale or mel scale subband).

Unless indicated otherwise, any disclosure of an operation of an apparatus having a particular feature is also expressly intended to disclose a method having an analogous feature (and vice versa), and any disclosure of an operation of an apparatus according to a particular configuration is also expressly intended to disclose a method according to an analogous configuration (and vice versa). The term "configuration" may be used in reference to a method, apparatus and/or system as indicated by its particular context. The terms "method," "process," "procedure," and "technique" are used generically and interchangeably unless otherwise indicated by the particular context. The terms "apparatus" and "device" are also used generically and interchangeably unless otherwise indicated by the particular context. The terms "element" and "module" are typically used to indicate a portion of a greater configuration. Unless expressly limited by its context, the term "system" is used herein to indicate any of its ordinary meanings, including "a group of elements that interact to serve a common purpose." Any incorporation by reference of a portion of a document shall also be understood to incorporate definitions of terms or variables that are referenced within the portion, where such definitions appear elsewhere in the document, as well as any figures referenced in the incorporated portion.

A method as described herein may be configured to process the captured signal as a series of segments. Typical segment lengths range from about five or ten milliseconds to about forty or fifty milliseconds, and the segments may be overlapping (e.g., with adjacent segments overlapping by 25% or 50%) or nonoverlapping. In one particular example, the signal is divided into a series of nonoverlapping segments or "frames", each having a length of ten milliseconds. A segment as processed by such a method may also be a segment (i.e., a "subframe") of a larger segment as processed by a different operation, or vice versa. Nowadays we are experiencing prompt exchange of individual information through rapidly growing social network services such as Facebook, Twitter, etc. At the same time, we also see the distinguishable growth of network speed and storage, which already supports not only text, but also multimedia data. In this environment, we see an important need for capturing and reproducing three-dimensional (3D) audio for more realistic and immersive exchange of individual aural experiences. In real-time cellular communication systems the ability to capture, compress, and transmit 3-D audio is not presently available. One of the challenges is the capturing of 3-D audio signals. Some of the techniques described in U.S. patent application Ser. No. 13/280,303, entitled "THREE-DIMENSIONAL SOUND CAPTURING AND REPRODUCING WITH MULTI-MICROPHONES" filed on Oct. 24, 2011 may be also used herein, to describe how 3-D audio information is captured, and how it may be recorded. However, this application extends the capability previously disclosed, by describing how 3-D audio may be combined with speech codecs found in real-time cellular communication systems.

First, the capture of 3-D audio is described. In some implementations, the audible information may be recorded. The audible information described herein may also be compressed by one or more independent speech codecs and transmitted in one or more over-the-air channels.

FIG. 1 illustrates three different views of a wireless communication device 102 having a configurable microphone 104*a-e* array geometry for different sound source directions. The wireless communication device 102 may include an earpiece 108 and one or more loudspeakers 110*a-b*. Depending on the use case, different combinations (e.g., pairs) of the microphones 104*a-e* of the device 102 may be selected to support spatially selective audio recording in different source directions. For example, in a video camera situation (e.g., with the camera lens 106 on the rear-face of the wireless communication device 102), a front-back microphone 104*a-e* pair (e.g., first mic 104*a* and fourth mic 104*d*, first mic 104*a* and fifth mic 104*e* or third mic 104*c* and fourth mic 104*d*) may be used to record front and back directions (i.e., to steer beams into and away from the camera lens 106), with left and right direction preferences that may be manually or automatically configured. For sound recording in a direction that is orthogonal to the front-back axis, microphone 104*a-e* pair (e.g., first mic 104*a* and second mic 104*b*) may be another option. In addition, the configurable microphone 104*a-e* array geometry may be also used to compress and transmit 3-D audio.

Different beamformer databanks may be computed offline for various microphone 104*a-e* combinations given a range of design methods (i.e., minimum variance distortionless response (MVDR), linearly constrained minimum variance (LCMV), phased arrays, etc.). During use, a desired one of these beamformers may be selected through a menu in the user interface depending on current use case requirements.

Figure 2B:
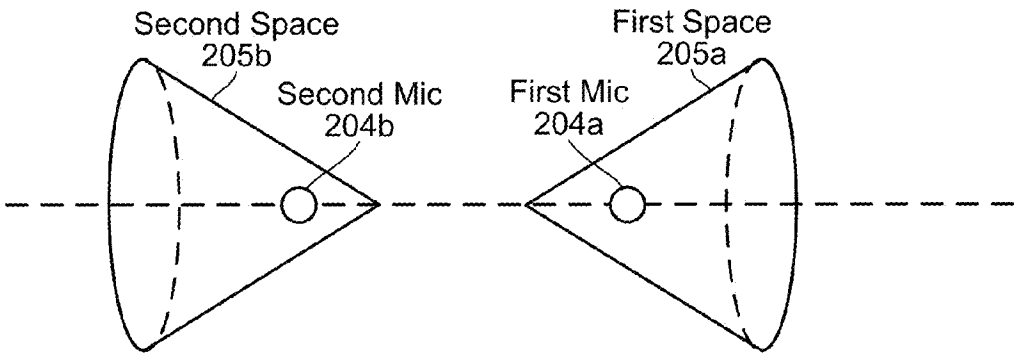
FIG. 2B illustrates regions of spatial selectivity for a microphone pair.
Figure 2A:
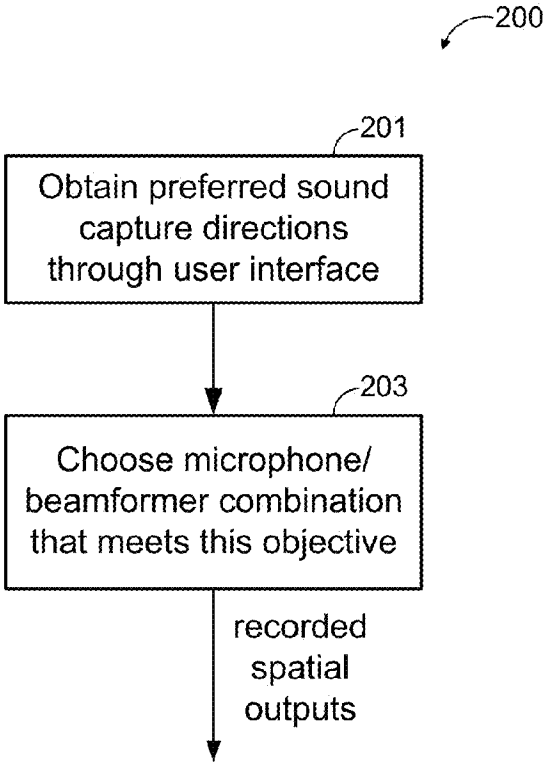
FIG. 2A illustrates a flowchart for a method of microphone/beamformer selection based on user interface inputs.

FIG. 2A illustrates a conceptual flowchart for such a method 200. First, the wireless communication device 102 may obtain 201 one or more preferred sound capture directions (e.g., as selected automatically and/or via a user interface). Next, the wireless communication device 102 may choose 203 a combination of a beamformer and a microphone array (e.g., pair) that provides the specified directivity. The specified directivity may also be used in combination with one or more speech codecs.

FIG. 2B illustrates regions of spatial selectivity for a pair of microphones 204*a-b*. For example, the first space 205*a* may represent the space from which audio may be focused by applying an end-fire beamforming using a first microphone 204*a* and a second microphone 204*b*. Similarly, the second space 205*b* may represent the space from which audio may be focused by applying an end-fire beamforming using a second microphone 204*b* and a first microphone 204*a*.

Figure 3:
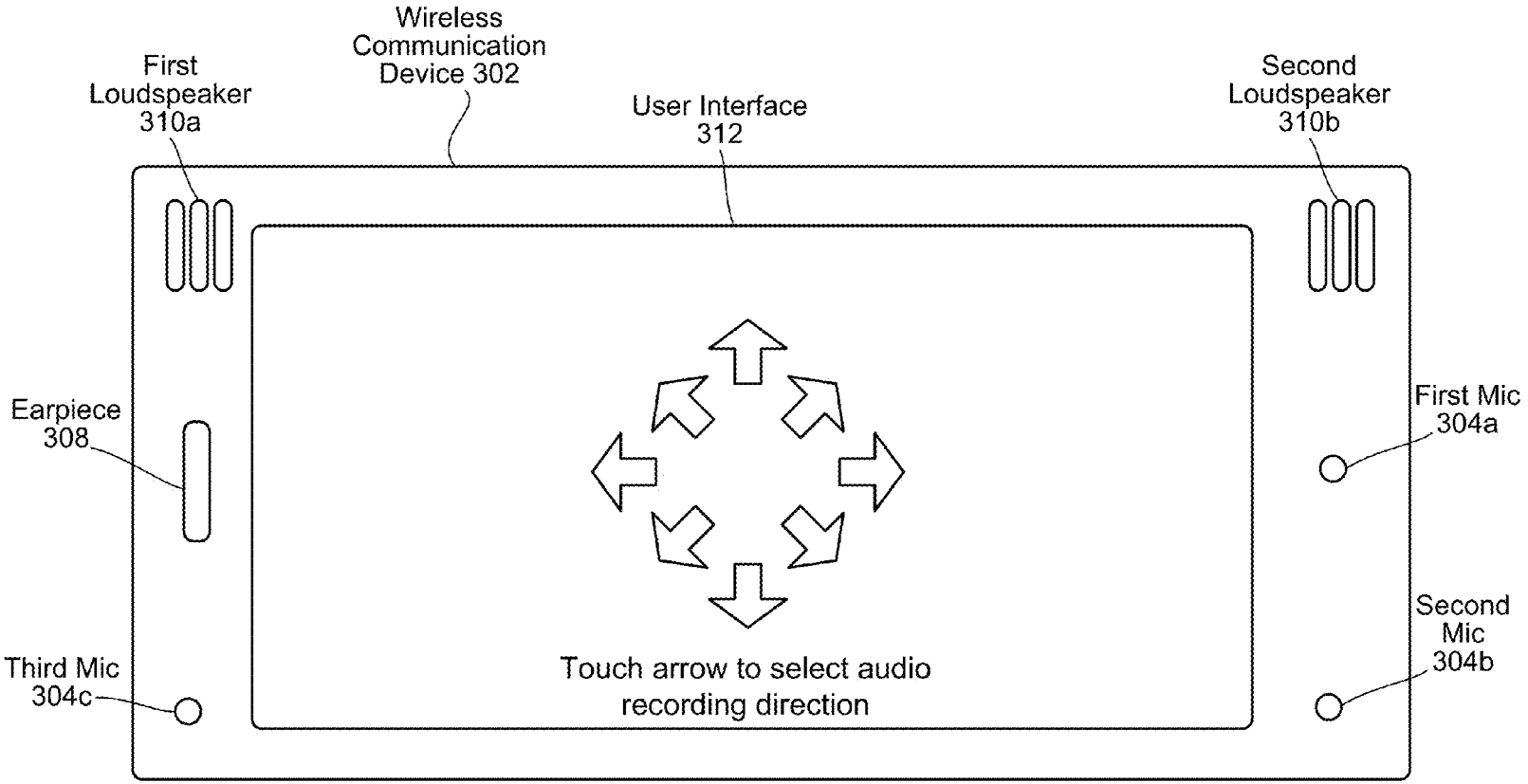
FIG. 3 illustrates a user interface for selecting a desired recording direction in two dimensions.

FIG. 3 illustrates an example of a user interface 312 of a wireless communication device 302. As described above, in some implementations, the recording direction may be selected via the user interface 312. For example, the user interface 312 may display one or more recording directions. A user, via the user interface 312 may select desired recording directions. In some examples, the user interface 312 may also be used to select the audio information associated with a particular direction that the user wishes to compress with more bits. In some implementations, the wireless communication device 302 may include an earpiece 308, one or more loudspeakers 310*a-b* and one or more microphones 304*a-c*.

Figure 4:
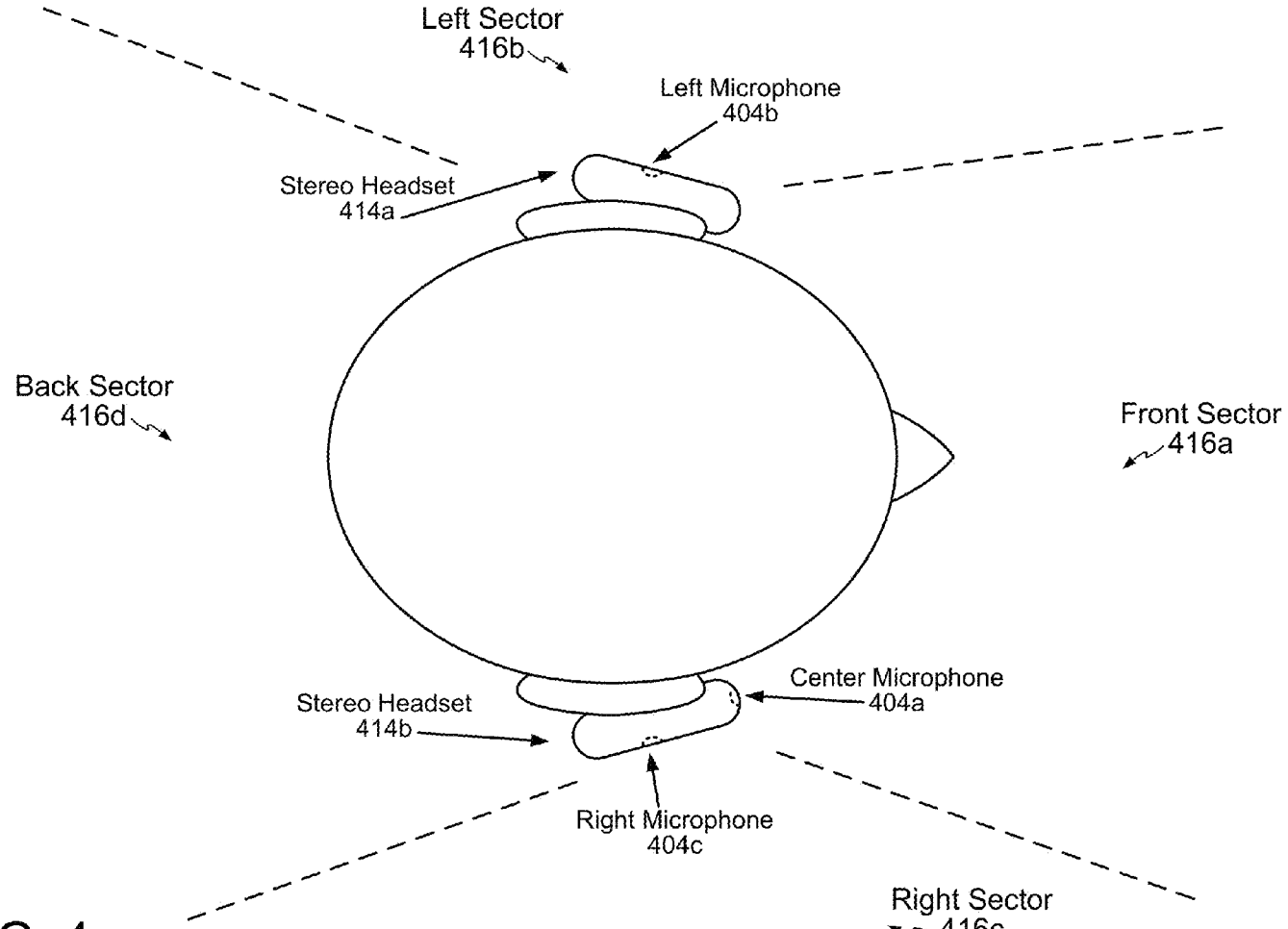
FIG. 4 illustrates possible spatial sectors defined around a headset that is configured to perform active noise cancellation (ANC)

FIG. 4 illustrates a related use case for a stereo headset 414*a-b* that may include three microphones 404*a-c*. For example, the stereo headset 414*a-b* may include a center microphone 404*a*, a left microphone 404*b* and a right microphone 404*c*. The microphones 404*a-c* may support applications such as voice capture and/or active noise cancellation (ANC). For such an application, different sectors 416*a-d* (i.e., a back sector 416*a*, a left sector 416*b*, a right sector 416*c* and a front sector 416*d*) around the head may be defined for recording using this three-microphone 404*a-c* configuration (FIG. 4, using omnidirectional microphones). Similarly, this use case may be used to compress and transmit 3-D audio.

Figure 5:
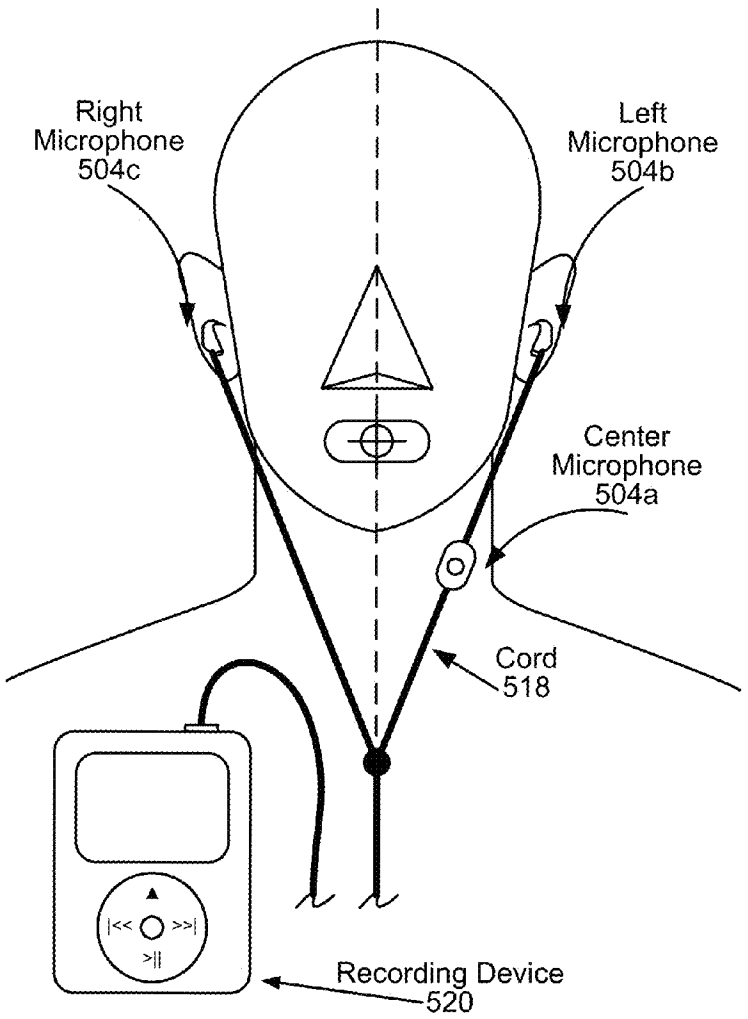
FIG. 5 illustrates a three-microphone arrangement.

Three-dimensional audio capturing may also be performed with specialized microphone setups, such as a three-microphone 504*a-c* arrangement as shown in FIG. 5. Such an arrangement may be connected via a cord 518 or wirelessly to a recording device 520. The recording device 520 may include an apparatus as described herein for detection of device 520 orientation and selection of a pair among microphones 504*a-c* (i.e., from among a center microphone 504*a*, a left microphone 504*b* and a right microphone 504*c*) according to a selected audio recording direction. In an alternative arrangement, a center microphone 504*a* may be located on the recording device 520. Similarly, this use case may be used to compress and transmit 3-D audio.

It is generally assumed that a far-end user listens to recorded spatial sound using a stereo headset (e.g., an adaptive noise cancellation or ANC headset). In other applications, however, a multi-loudspeaker array capable of reproducing more than two spatial directions may be available at the far end. To support such a use case, it may be desirable to enable more than one microphone/beamformer combination at the same time during recording, or capturing of the 3-D audio signal to be used to compress and transmit 3-D audio.

A multi-microphone array may be used with a spatially selective filter to produce a monophonic sound for each of one or more source directions. However, such an array may also be used to support spatial audio encoding in two or three dimensions. Examples of spatial audio encoding methods that may be supported with a multi-microphone array as described herein include 5.1 surround, 7.1 surround, Dolby Surround, Dolby Pro-Logic, or any other phase-amplitude matrix stereo format; Dolby Digital, DTS or any discrete multi-channel format; and wavefield synthesis. One example of a five-channel encoding includes Left, Right, Center, Left surround, and Right surround channels.

Figure 6:
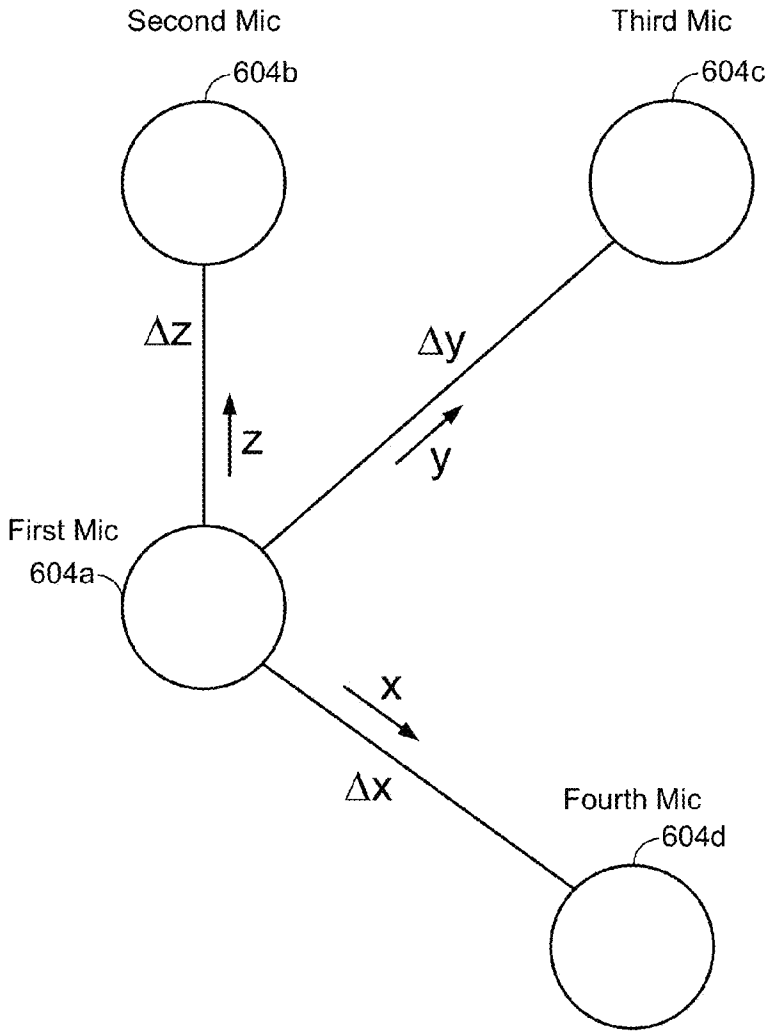
FIG. 6 illustrates an omnidirectional and first-order capturing for spatial coding using a four-microphone setup.

FIG. 6 illustrates an omnidirectional microphone 604*a-d* arrangement for approximating a first order capturing for spatial coding using a four-microphone 604*a-d* setup. Examples of spatial audio encoding methods that may be supported with a multi-microphone 604*a-d* array as described herein may also include methods that may originally be intended for use with a special microphone 604*a-d*, such as the Ambisonic B format or a higher-order Ambisonic format. The processed multichannel outputs of an Ambisonic encoding scheme, for example, may include a three-dimensional Taylor expansion on the measuring point, which can be approximated at least up to first-order using a three-dimensionally located microphone array as depicted in FIG. 6. With more microphones, we may increase the approximation order. According to an example, a second microphone 604*b* may be separated from a first microphone 604*a* by a distance $\Delta z$ in the z direction. A third microphone 604*c* may be separated from the first microphone 604*a* a distance $\Delta y$ in the y direction. A fourth microphone 604*d* may be separated from the first microphone 604*a* a distance $\Delta x$ in the x direction.

In order to convey an immersive sound experience to the user, surround sound recordings may be stand-alone or in conjunction with videotaping. Surround sound recording may use a separate microphone setup using uni-directional microphones 604*a-d*. In this example, the one or more uni-directional microphones 604*a-d* may be clipped on separately. In this disclosure, an alternative scheme based on multiple omnidirectional microphones 604*a-d* combined with spatial filtering is presented. In an example of this configuration, one or more omnidirectional microphones 604*a-d* embedded on the smartphone or tablet may support multiple sound recording applications. For example, two microphones 604*a-d* may be used for wide stereo, and at least three omnidirectional microphones 604*a-d*, with appropriate microphone 604*a-d* axes, may be used for surround sound, may be used to record multiple sound channels on the smartphone or tablet device. These channels may in turn be processed in pairs or filtered at the same time with filters designed to have specific spatial pickup patterns in desired look directions. Due to spatial aliasing, the inter-microphone distances may be chosen so the patterns are effective in the most relevant frequency bands. The generated stereo or 5.1 output channels may be played back in a surround sound setup to generate the immersive sound experience.

Figure 7:
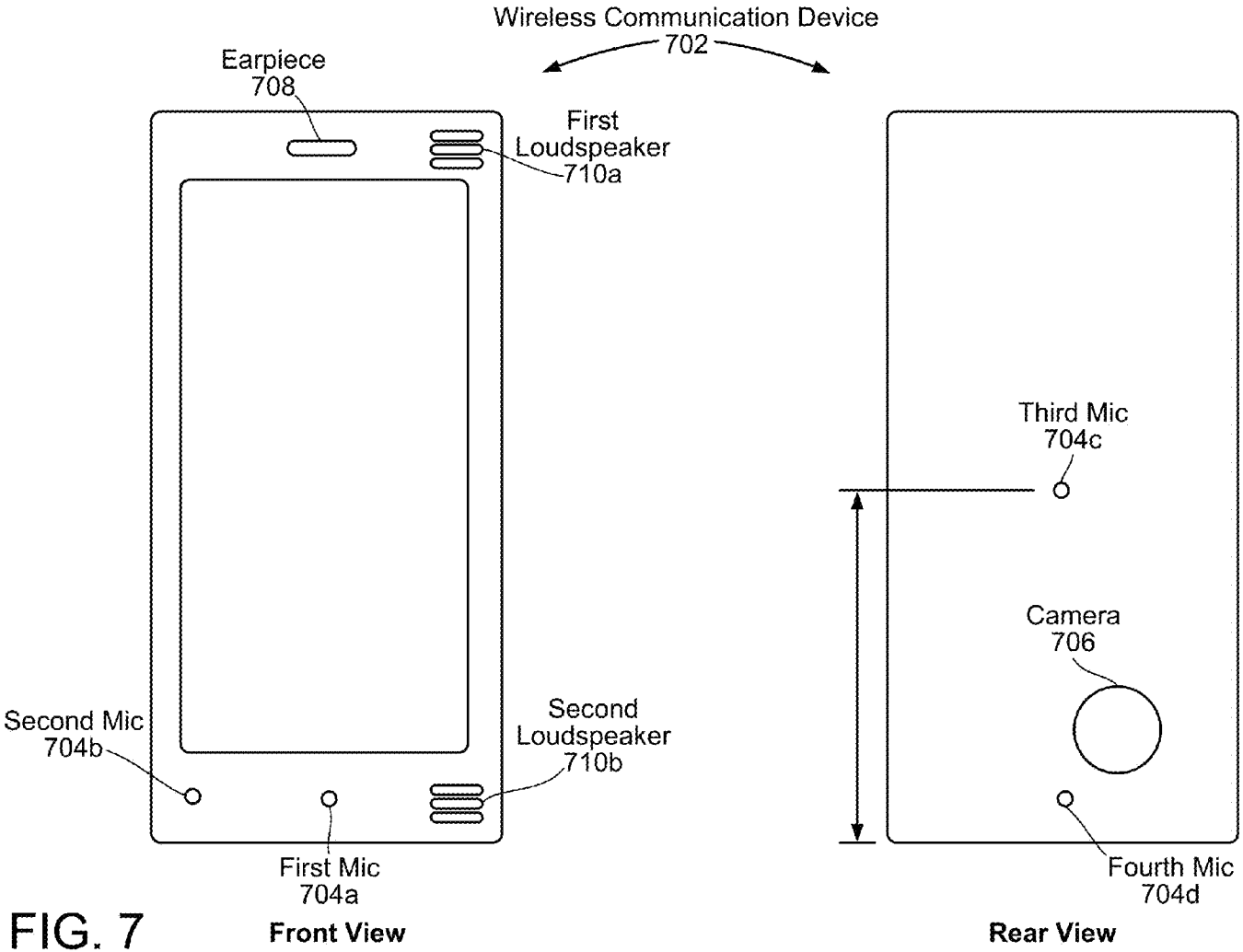
FIG. 7 illustrates front and rear views of one example of a portable communications device.

FIG. 7 illustrates front and rear views of one example of a wireless communications device 702 (e.g., a smartphone). The array of front microphone 704*a* and a first back microphone 704*c* may be used to make a stereo recording. Examples of other microphone 704 pairings include the first microphone 704*a* (on the front) and a second microphone 704*b* (on the front), the third microphone 704*c* (on the back) and fourth microphone 704*d* (on the back) and the second microphone 704*b* (on the front) and the fourth microphone 704*d* (on the back). The different locations of the microphones 704*a-d* relative to the source, which may depend on the holding position of the device 702, may create a stereo effect that may be emphasized using spatial filtering. In order to create a stereo image between a commentator and a scene being recorded (e.g., during videotaping), it may be desirable to use the end-fire pairing using the first microphone 704*a* (on the front) and the third microphone 704*c* (on the back) with the distance of the thickness of the device (as shown in the side view of FIG. 1). However, note that we can also use the same microphones 704*a-d* in a different holding position and may create an end-fire pairing with the distance toward the z-axis (e.g., as shown in the rear view of FIG. 1). In the latter case, we can create a stereo image toward the scene (e.g., sound coming from left in the scene is captured as left-coming sound). In some implementations, the wireless communication device may include an earpiece 708, one or more loudspeakers 710*a-b* and/or a camera lens 706.

Figure 8:
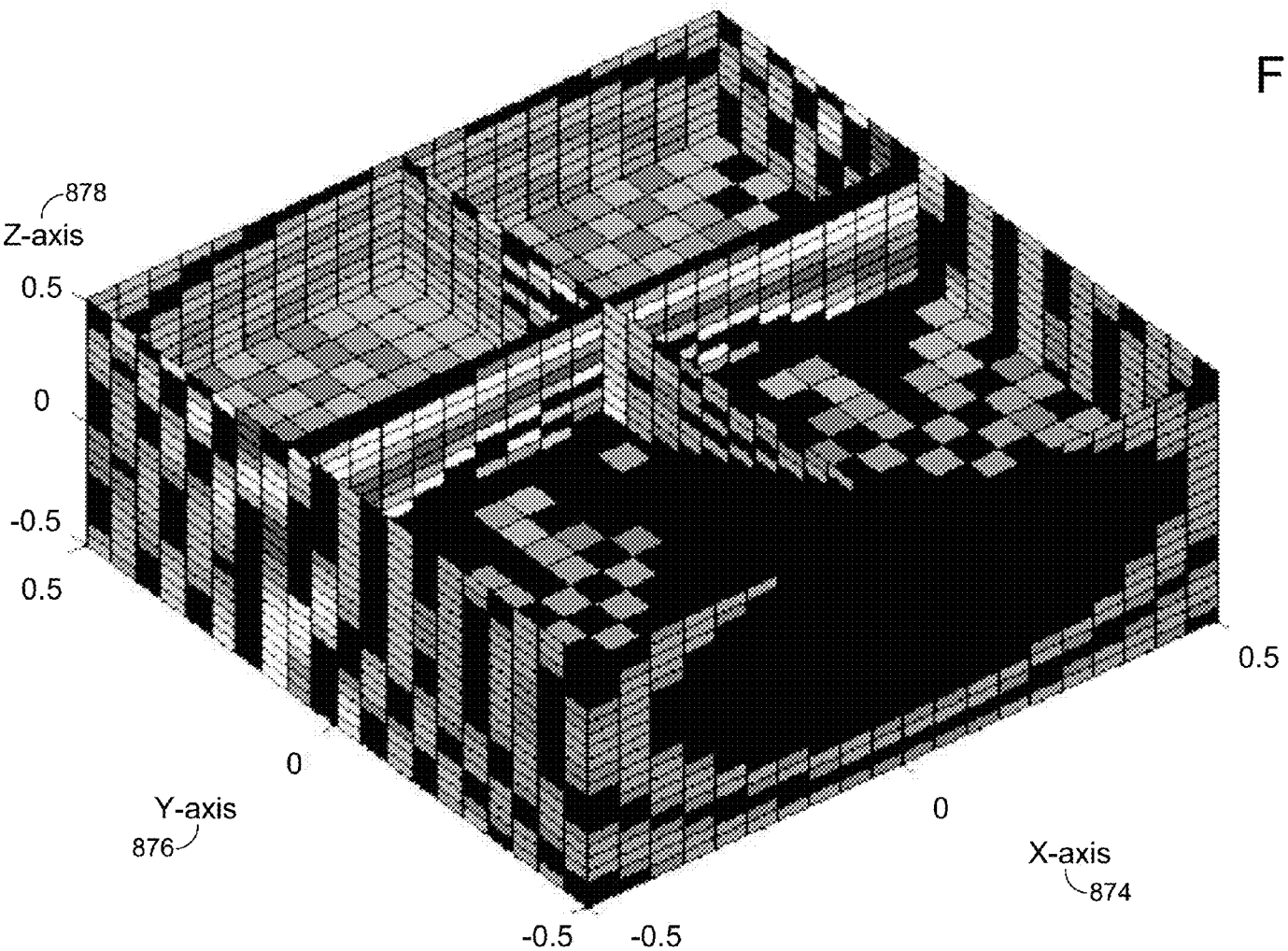
FIG. 8 illustrates a case of recording a source signal arriving from a broadside direction.

FIG. 8 illustrates a case of using the end-fire pairing of the first microphone 704*a* (on the front) and the third microphone 704*c* (on the back) with the distance of the thickness of the device 702 to record a source signal arriving from a broadside direction. In this case, the X axis 874 increases to the right, the Y axis 876 increases to the left and the Z axis 878 increases to the top. In this example, the coordinates of the two microphones 704*a*, 704*c* may be (x=0, y=0, z=0) and (x=0, y=0.10, z=−0.01). Stereo beamforming may be applied, such that the area along the y=0 plane may illustrate the beam in the broadside direction and the area around (x=0, y=−0.5, z=0) may illustrate the nullbeam in the end-fire direction. When the commentator is talking from the broadside direction (e.g., into the rear face of the device 702), it may be difficult to distinguish the commentator's voice from sounds from a scene at the front face of the device 702, due to an ambiguity with respect to rotation about the axis of the microphone 704*a*, 704*c* pair. In this example, the stereo effect to separate the commentator's voice from the scene may not be enhanced.

Figure 9:
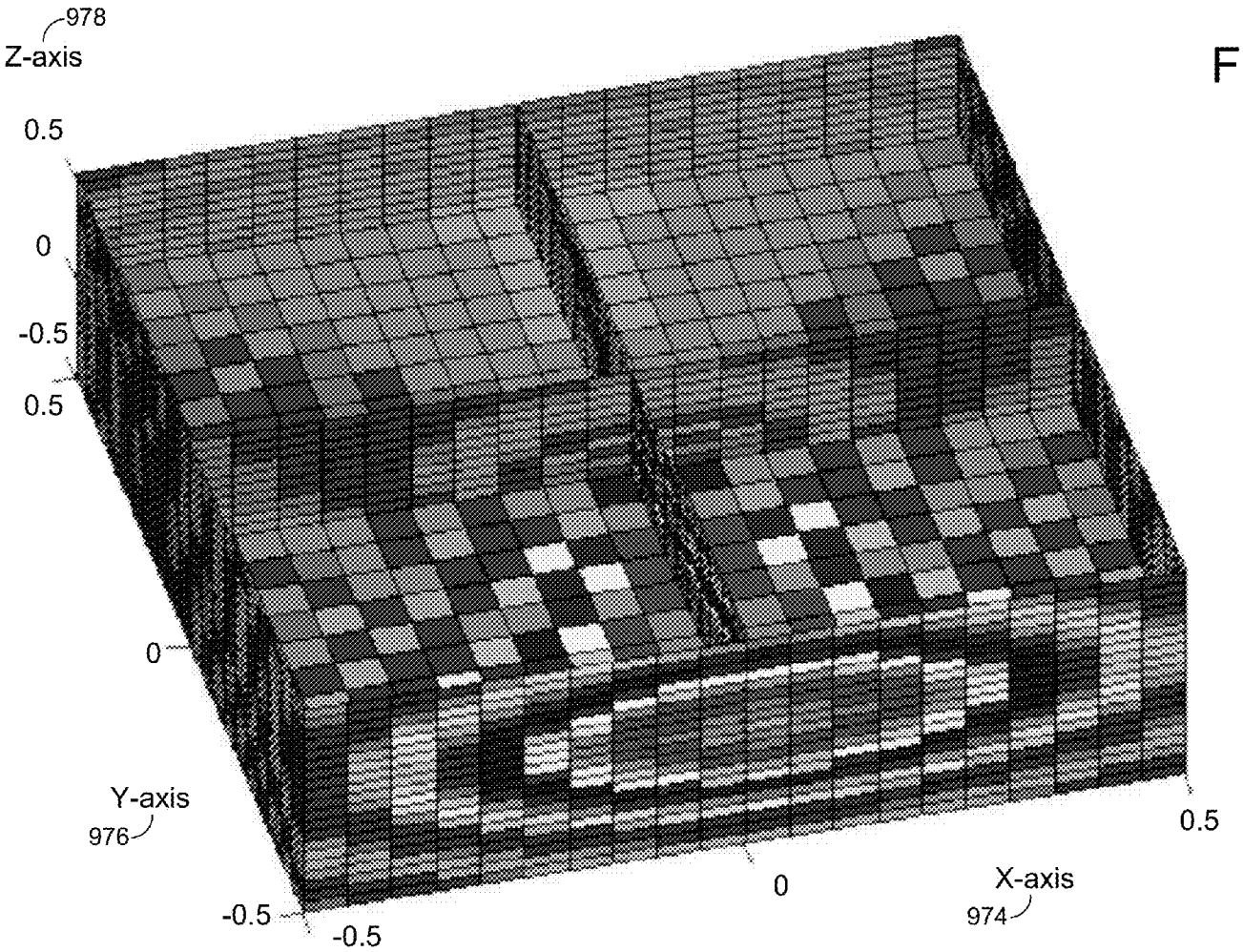
FIG. 9 illustrates another case of recording a source signal arriving from a broadside direction.

FIG. 9 illustrates another case of using the end-fire pairing of the first microphone 704*a* (on the front) and the third microphone 704*c* (on the back) with the distance of the thickness of the device 702 to record a source signal arriving from a broadside direction, with the microphone 704*a* (on the front), 704*c* (on the back) coordinates may be the same as FIG. 8. In this case, the X axis 974 increases to the right, the Y axis 976 increases to the left and the Z axis 978 increases to the top. In this example, the beam may be oriented toward the end-fire direction (through the point (x=0, y=−0.5, z=0)) such that the user's (e.g., commentator's) voice may be nulled out in one channel. The beam may be formed using a null beamformer or another approach. A blind source separation (BSS) approach, for example, such as independent component analysis (ICA) or independent vector analysis (IVA), may provide a wider stereo effect than a null beamformer. Note that in order to provide a wider stereo effect for the taped scene itself, it may be sufficient to use the end-fire pairing of the same microphones 704*a*, 704*c* with the distance toward z-axis 978 (e.g., as shown in the rear view of FIG. 1).

Figure 10:
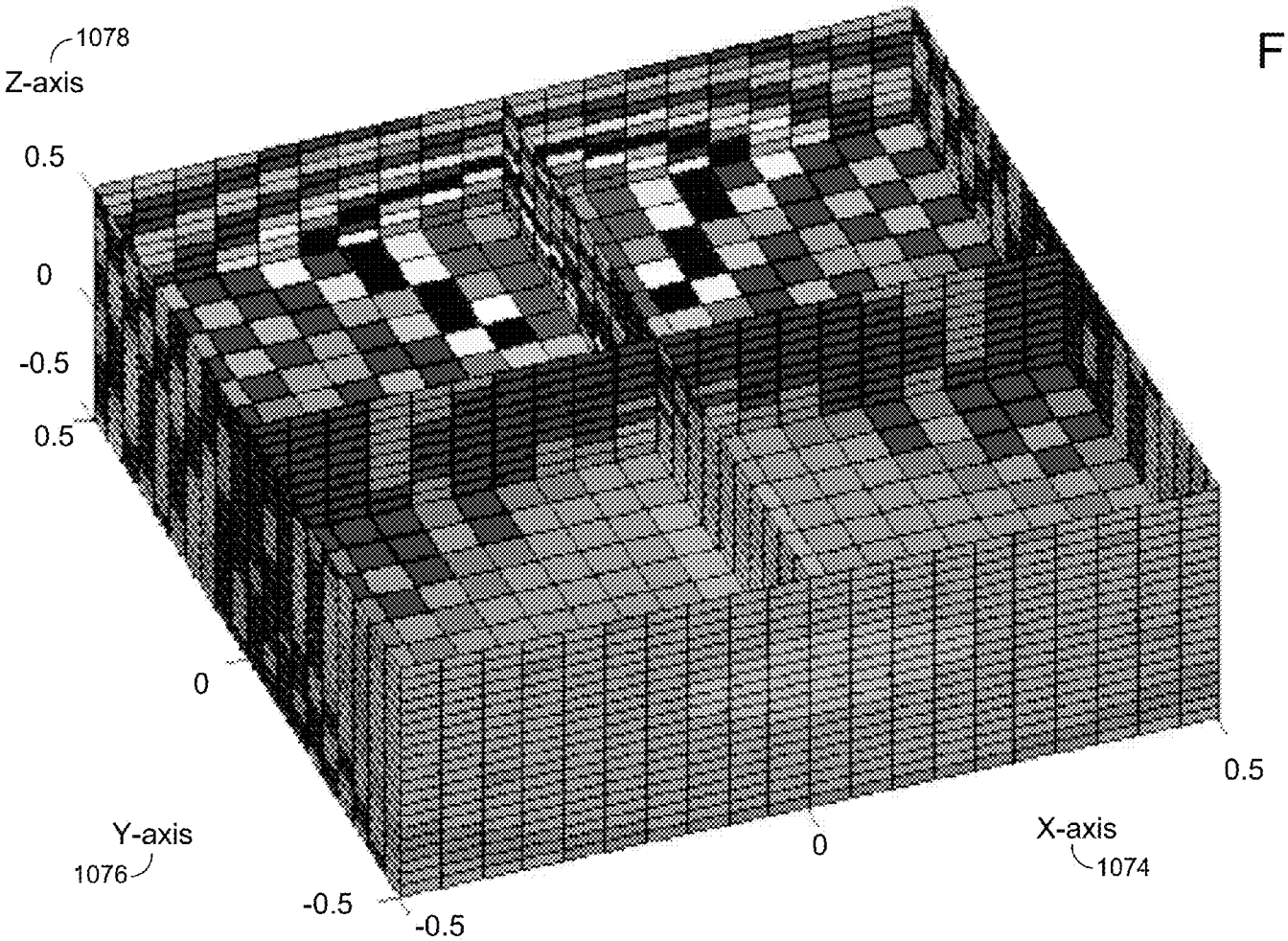
FIG. 10 illustrates a case of combining end-fire beams.
Figure 20:
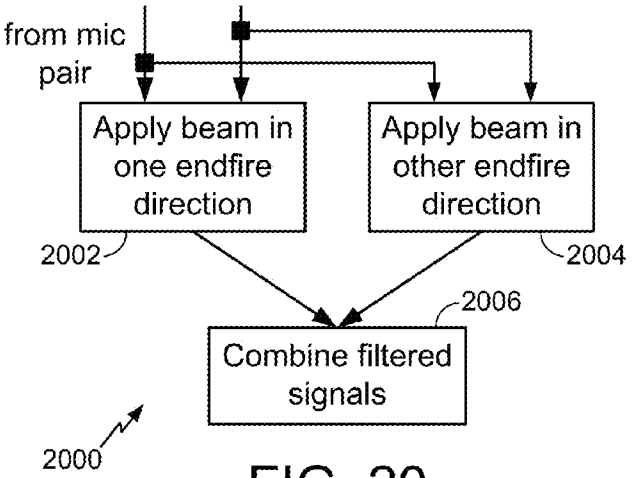
FIG. 20 illustrates a flowchart of a method of combining end-fire beams.

FIG. 10 is plot illustrating a case of combining end-fire beams. In this case, the X axis 1074 increases to the right, the Y axis 1076 increases to the left and the Z axis 1078 increases to the top. With the wireless communication device 702 in a broadside holding position, it may be desirable to combine end-fire beams to the left and right sides (e.g., as shown in FIGS. 9 and 10) to enhance a stereo effect as compared to the original recording. Such processing may also include adding an inter-channel delay (e.g., to simulate microphone spacing). Such a delay may serve to normalize the output delay of both beamformers to a common reference point in space. When stereo channels are played back over headphones, manipulating delays can also help to rotate the spatial image in a preferred direction. The device 702 may include an accelerometer, magnetometer and/or gyroscope that indicate the holding position (e.g., as may be described in U.S. patent application Ser. No. 13/280,211, entitled "SYSTEMS, METHODS, APPARATUS AND COMPUTER-READABLE MEDIA FOR ORIENTATION-SENSITIVE RECORDING CONTROL"). FIG. 20, discussed below, illustrates a flowchart of such a method.

When the device is in an end-fire holding position, the recording may provide a wide stereo effect. In this case, spatial filtering (e.g., using a null beamformer or a BSS solution, such as ICA or IVA) may enhance the effect slightly.

In a dual-microphone case, a stereo recorded file may be enhanced through spatial filtering (e.g., to increase separation of the user's voice and the recorded scene) as described above. It may be desirable to generate several different directional channels from the captured stereo signal (e.g., for surround sound), such as to upmix the signal to more than two channels. For example, it may be desirable to upmix the signal to five channels (for a 5.1 surround sound scheme, for example) such that it may be played back using a different one of an array of five speakers for each channel. Such an approach may include applying spatial filtering in corresponding directions to obtain the upmixed channels. Such an approach may also include applying a multichannel encoding scheme to the upmixed channels (e.g., a version of Dolby Surround).

For a case in which more than two microphones 704*a-d* are used for recording, it may be possible to record in multiple directions (e.g., five directions, according to a 5.1 standard) using spatial filtering and different microphone 704*a-d* combinations, then to play back the recorded signal (e.g., using five loudspeakers). Such processing may be performed without upmixing.

Figure 11:
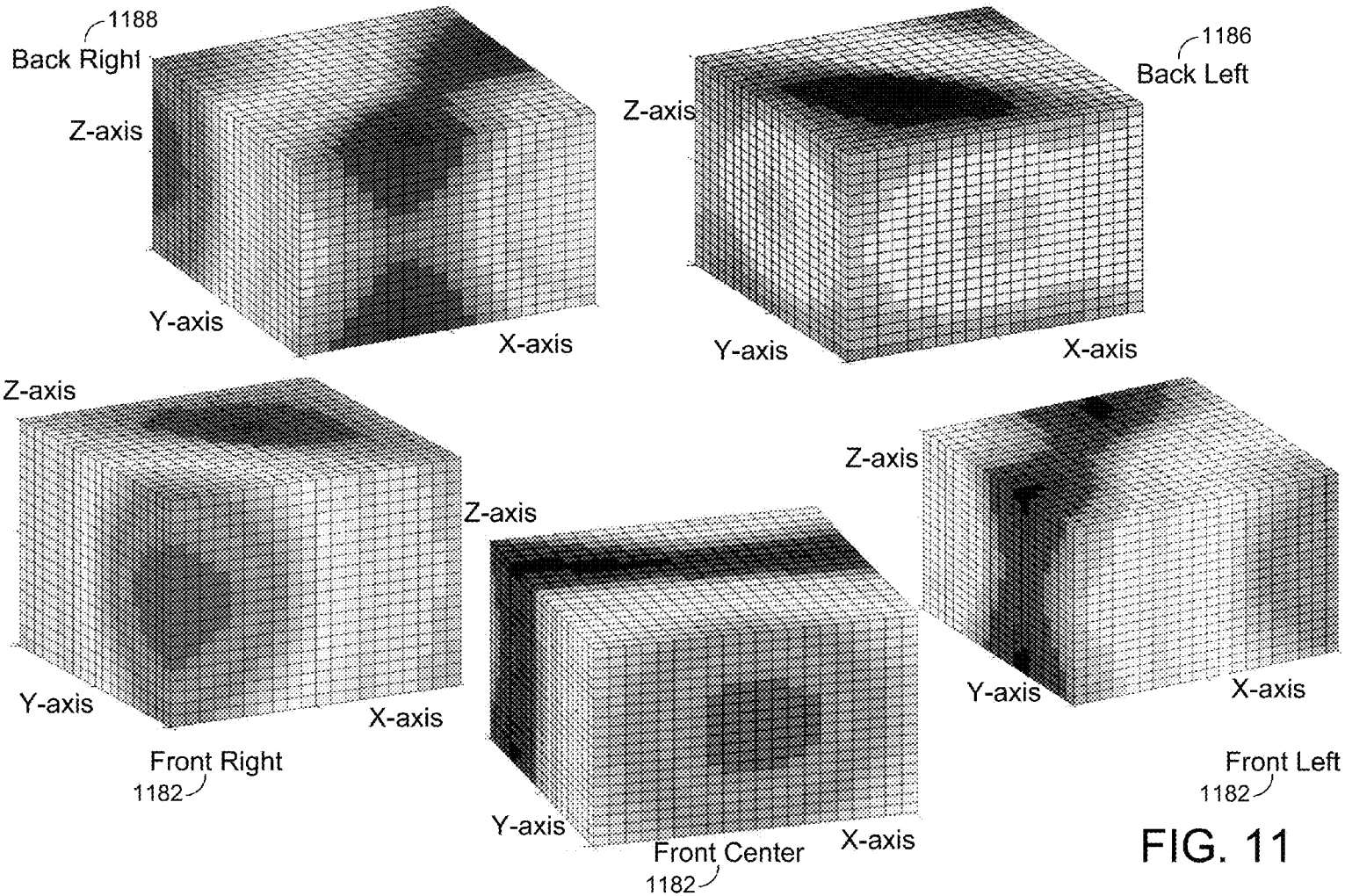
FIG. 11 illustrates examples of plots for beams in front center, front left, front right, back left, and back right directions.

FIG. 11 illustrates examples of plots for such beams in front center (FC) 1180, front left (FL) 1182, front right (FR) 1184, back left (BL) 1186 and back right (BR) 1188 directions. The X, Y, and Z axes are oriented similarly in these plots (the middle of each range is zero and the extremes are +/−0.5, with the X axis increasing to the right, the Y axis increasing toward the left, and the Z axis increasing toward the top), and the dark areas indicate beam or null beam directions as stated. The beams for each plot are directed through the following points (z=0): (x=0, y=+0.5) for front center (FC) 1180, (x=+0.5, y=+0.5) for front right (FR) 1184, (x=+0.5, y=−0.5) for back right (BR) 1188, (x=−0.5, y=−0.5) for back left (BL) 1186, and (x=−0.5, y=+0.5) for front left (FL) 1182.

The audio signals associated with the four different directions (FR 1184, BR 1188, BL 1186, FL 1182) may be compressed using speech codecs on a wireless communication device 702. At the receiver side, the center sound that a user playing/or decoding the four reconstructed audio signals associated with the different directional sounds may be generated by the combination of the FR 1184, BR 1188, BL 1186, FL 1182 channels. These audio signals associated with different directions may be compressed and transmitted in real-time using a wireless communication device 702. Each of the four independent sources may be compressed and transmitted from a certain low band frequency (LB) frequency up to a certain upper band frequency (UB).

The effectiveness of a spatial filtering technique may be limited to a bandpass range depending on factors such as small inter-microphone spacing, spatial aliasing and scattering at high frequencies. In one example, the signal may be lowpass-filtered (e.g., with a cutoff frequency of 8 kHz) before spatial filtering.

For a case in which sound from a single point source is being captured, complementing such beamforming with masking of signals arriving from other directions may lead to strong attenuation of non-direct-path signals and/or audible distortion at the level of aggressiveness needed to achieve the desired masking effect. Such artifacts may be undesirable for high-definition (HD) audio. In one example, HD audio may be recorded at a sampling rate of 48 kHz. To mitigate such artifacts, instead of using the aggressively spatially filtered signal, it may be desirable to use only the energy profile of the processed signal for each channel and to apply a gain panning rule according to the energy profile for each channel on the original input signals or spatially processed output before masking. Note that as sound events may be sparse in the time-frequency map, it may be possible to use such a post-gain-panning method even with multiple-source cases.

Figure 12:
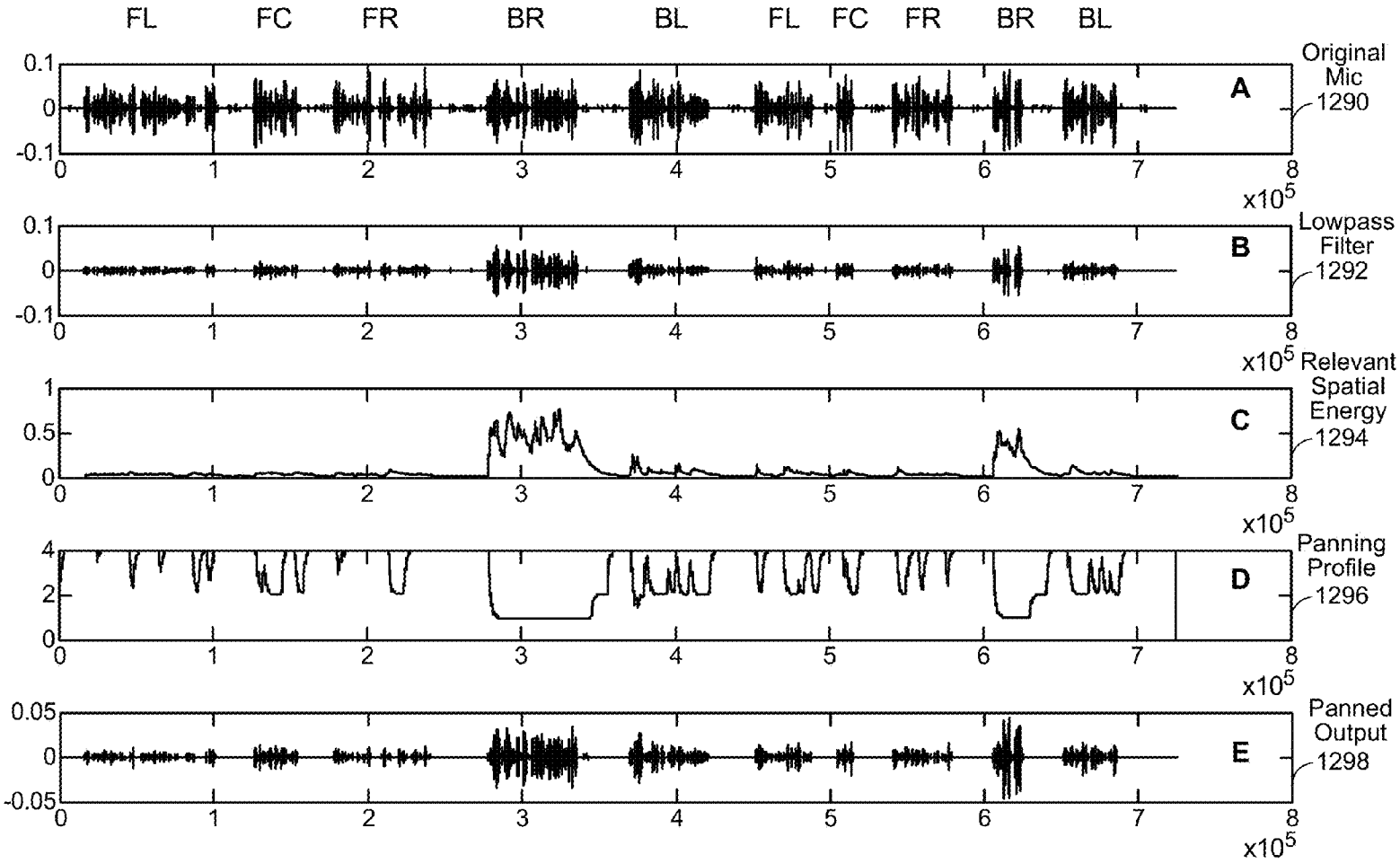
FIG. 12 illustrates an example of processing to obtain a signal for a back-right spatial direction.

FIG. 12 illustrates an example of processing to obtain a signal for a back-right spatial direction. Plot A 1290 (amplitude vs. time) illustrates the original microphone recording. Plot B 1292 (amplitude vs. time) illustrates a result of lowpass-filtering the microphone signal (with a cutoff frequency of 8 kHz) and performing spatial filtering with masking. Plot C 1294 (magnitude vs. time) illustrates relevant spatial energy, based on energy of the signal in plot B 1292 (e.g., sum of squared sample values). Plot D 1296 (state vs. time) illustrates a panning profile based on energy differences indicated by the low-frequency spatial filtering, and plot E 1298 (amplitude vs. time) illustrates the 48-kHz panned output.

For a dual-mic-pair case, it may be desirable to design at least one beam for one pair and at least two beams in different directions for the other pair. The beams may be designed or learned (e.g., with a blind source separation approach, such as independent component analysis or independent vector analysis). Each of these beams may be used to obtain a different channel of the recording (e.g., for a surround sound recording).

Figure 13:
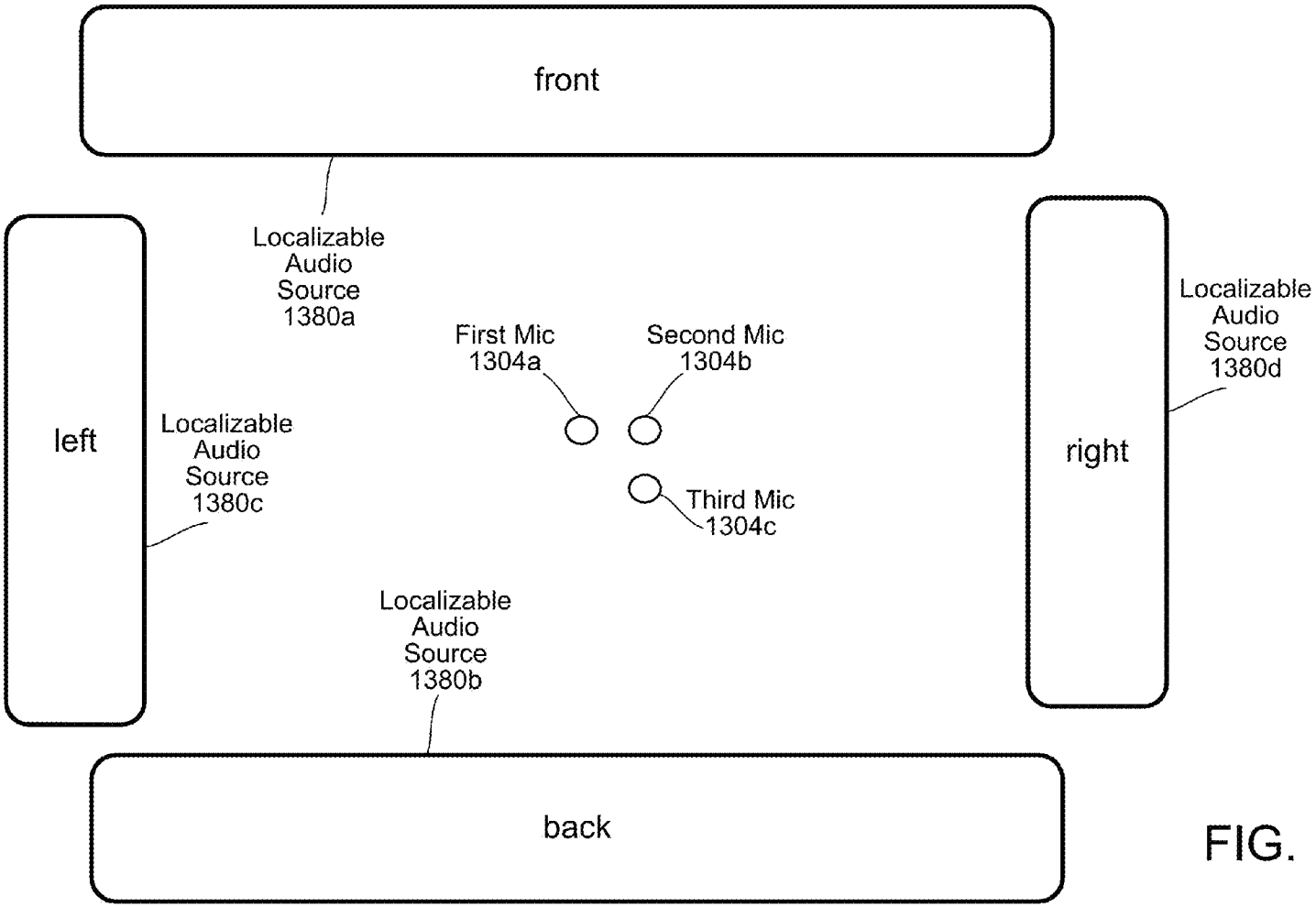
FIG. 13 illustrates a null beamforming approach using two-microphone-pair blind source separation with an array of three microphones.

FIG. 13 illustrates a null beamforming approach using two-microphone-pair blind source separation (e.g., independent component analysis or independent vector analysis) with an array of three microphones 1304*a-c*. For front and back localizable audio sources 1380*a*, 1380*b*, the second mic 1304*b* and third mic 1304*c* may be used. For left and right localizable audio sources 1380*c*, 1380*d*, the first mic 1304*a* and the second mic 1304*b* may be used. It may be desirable for the axes of the two microphone 1304*a-c* pairs to be orthogonal or at least substantially orthogonal (e.g., not more than five, ten, fifteen or twenty degrees from orthogonal).

Figure 14:
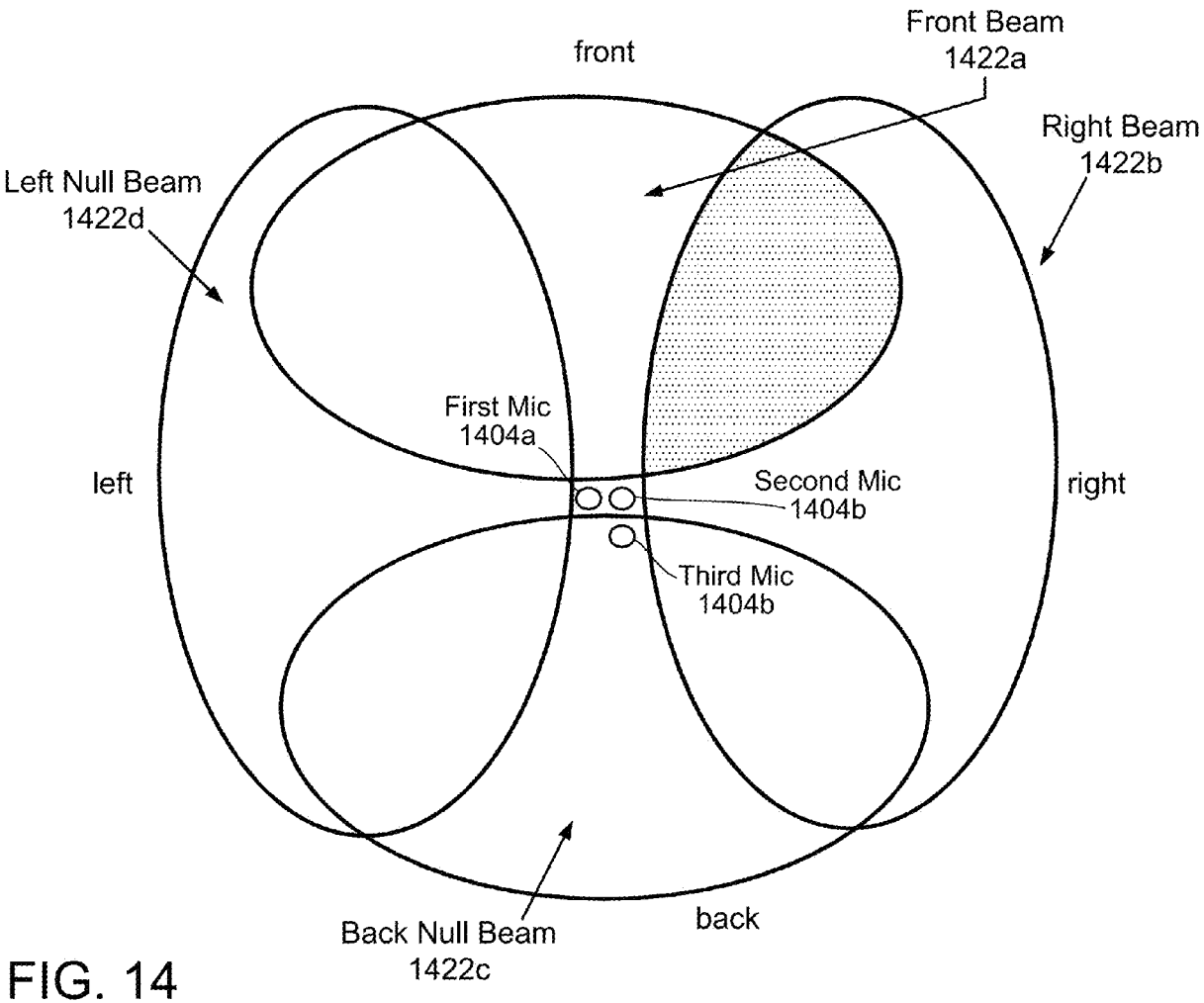
FIG. 14 illustrates an example in which beams in the front and right directions are combined to obtain a result for the front-right direction.

Some of the channels may be produced by combining two of more of the beams. FIG. 14 illustrates an example in which a front beam 1422*a* and a right beam 1422*b* (i.e., beams in the front and right directions) may be combined to obtain a result for the front right direction. The beams may be recorded by one or more microphones 1404*a-c* (e.g., a first mic 1404*a*, a second mic 1404*b* and a third mic 1404*c*). Results for the front left, back right, and/or back left directions may be obtained in the same way. In this example, combining overlapping beams 1422*a-d* in such a manner may provide a signal that is six dB louder for signals arriving from the corresponding corner than for signals arriving from other locations. In some implementations, a back null beam 1422*c* and a left mull beam 1422*d* may be formed (i.e., beams in the left and back directions may be null). In some cases an inter-channel delay may be applied to normalize the output delay of both beamformers to a common reference point in space. When the "left-right end-fire pair" and the "front-back end-fire pair" are combined, it may be desirable to set the reference point to the center of gravity of the microphone 1404*a-c* array. Such an operation may support maximized beaming at the desired corner location with adjusted delay between the two pairs.

Figure 15:
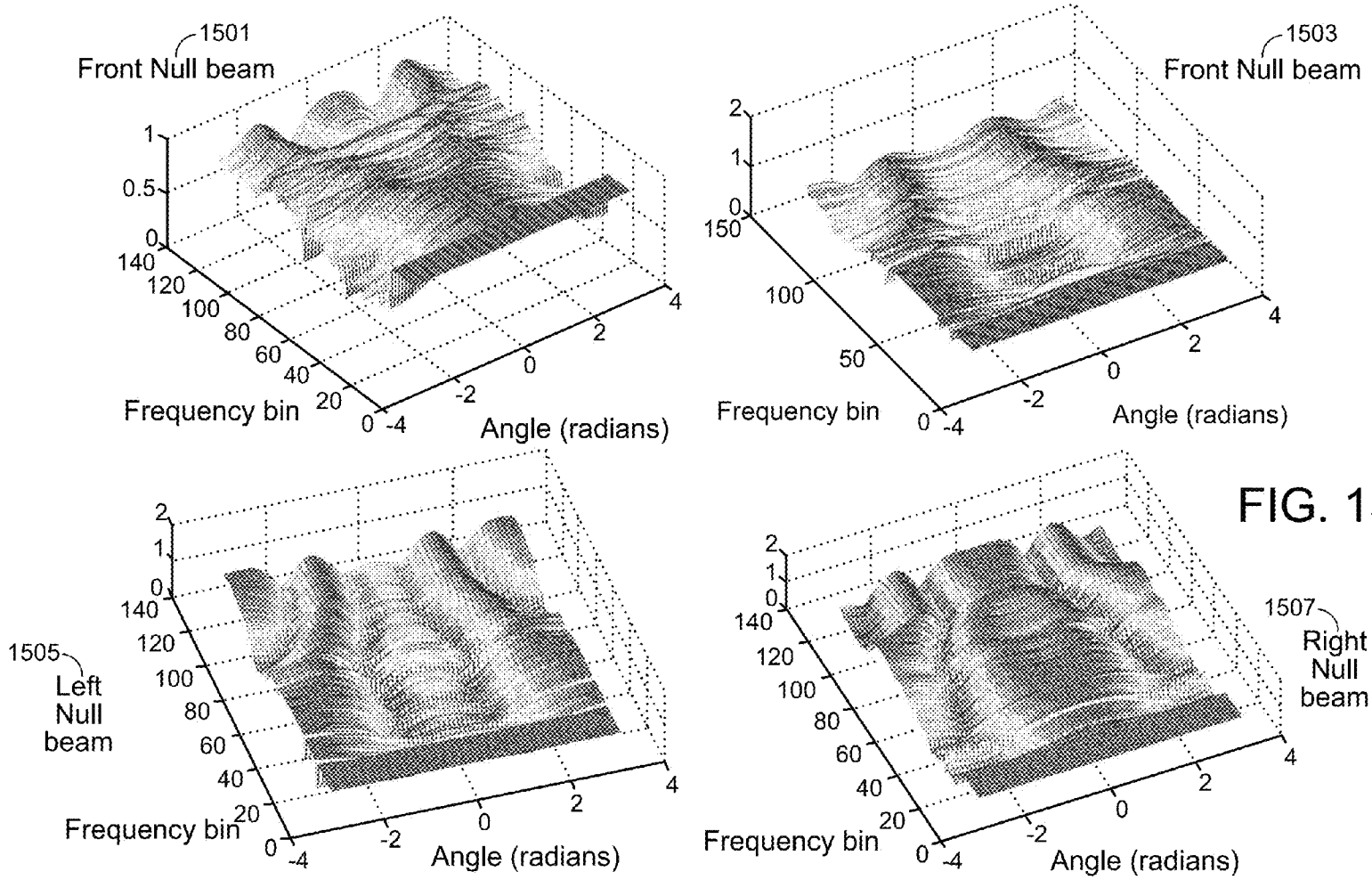
FIG. 15 illustrates examples of null beams for an approach as illustrated in FIG. 13.

FIG. 15 illustrates examples of null beams in a front 1501, back 1503, left 1505 and right 1507 directions for an approach as illustrated in FIG. 13. Beams that may be designed using minimum variance distortionless response beamformers or converged blind source separation (e.g., independent component analysis or independent vector analysis) filters learned on scenarios in which the relative positions of the device 702 and the sound source (or sources) are fixed. In these examples, the range of frequency bins shown corresponds to the band of from 0 to 8 kHz. It may be seen that the spatial beampatterns are complementary. It may also be seen that, because of the different spacing between the microphones 1304*a-c* of the left-right pair and the microphones 1304*a-c* of the front-back pair in these examples, spatial aliasing affects these beampatterns differently.

Because of spatial aliasing, depending on the inter-microphone distances it may be desirable to apply the beams to less than the entire frequency range of the captured signals (e.g., to the range of from 0 to 8 kHz as noted above). After the low-frequency content is spatially filtered, the high-frequency content may be added back, with some adjustment for spatial delay, processing delay and/or gain matching. In some cases (e.g., handheld device form factors), it may also be desirable to filter only a middle range of frequencies (e.g., only down to 200 or 500 Hz), as some loss of directivity may be expected anyway due to microphone spacing limitations.

If some kind of non-linear phase distortion exists, then a standard beam/null-forming technique that is based on the same delay for all frequencies according to the same direction of arrival (DOA) may perform poorly, due to differential delay on some frequencies as caused by the non-linear phase distortion. A method based on independent vector analysis as described herein operates on a basis of source separation, however, and such a method may therefore be expected to produce good results even in the presence of differential delay for the same direction of arrival. Such robustness may be a potential advantage of using independent vector analysis for obtaining surround processing coefficients.

For a case in which no spatial filtering is done above some cutoff frequency (e.g., 8 kHz), providing the final high-definition signal may include high-pass filtering the original front/back channels and adding back the band of from 8 to 24 kHz. Such an operation may include adjusting for spatial and high-pass filtering delays. It may also be desirable to adjust the gain of the 8-24-kHz band (e.g., so as not to confuse the spatial separation effect). The examples illustrated in FIG. 12 may be filtered in the time domain, although application of the approaches described herein to filtering in other domains (e.g., the frequency domain) is expressly contemplated and hereby disclosed.

Figure 16:
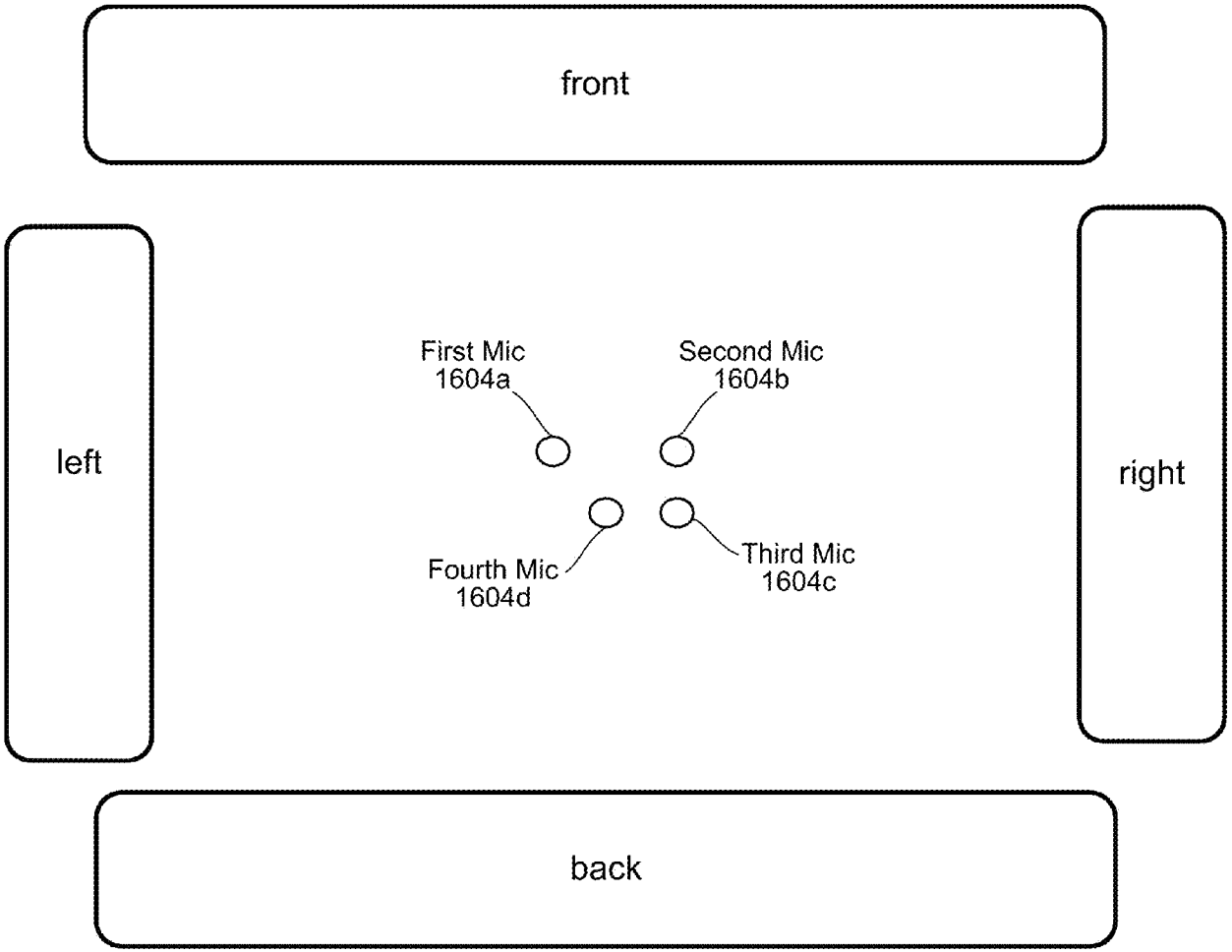
FIG. 16 illustrates a null beamforming approach using four-channel blind source separation with an array of four microphones.
Figure 23:
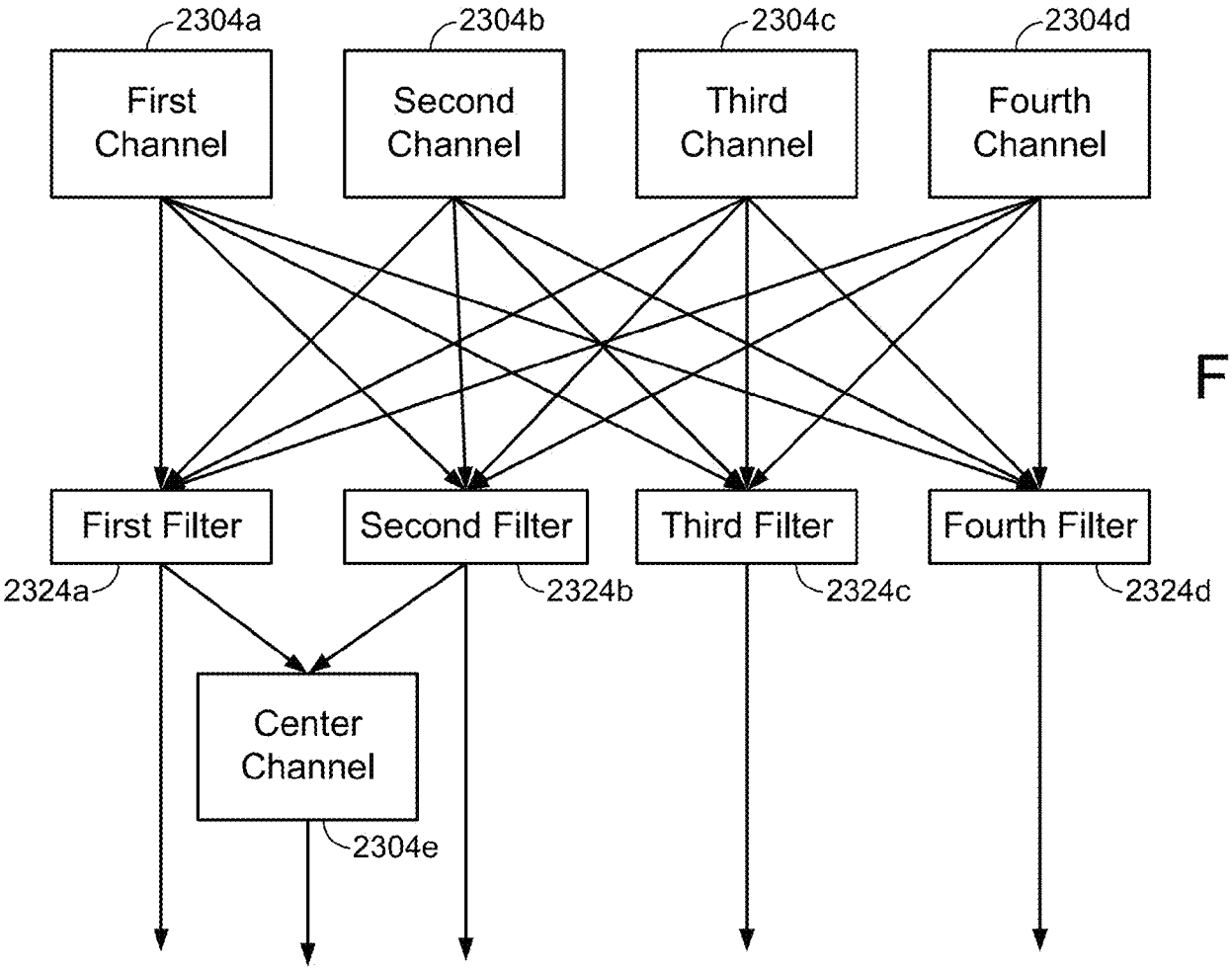
FIG. 23 illustrates a flowchart for a method of using four-channel blind source separation with an array of four microphones.
Figure 25:
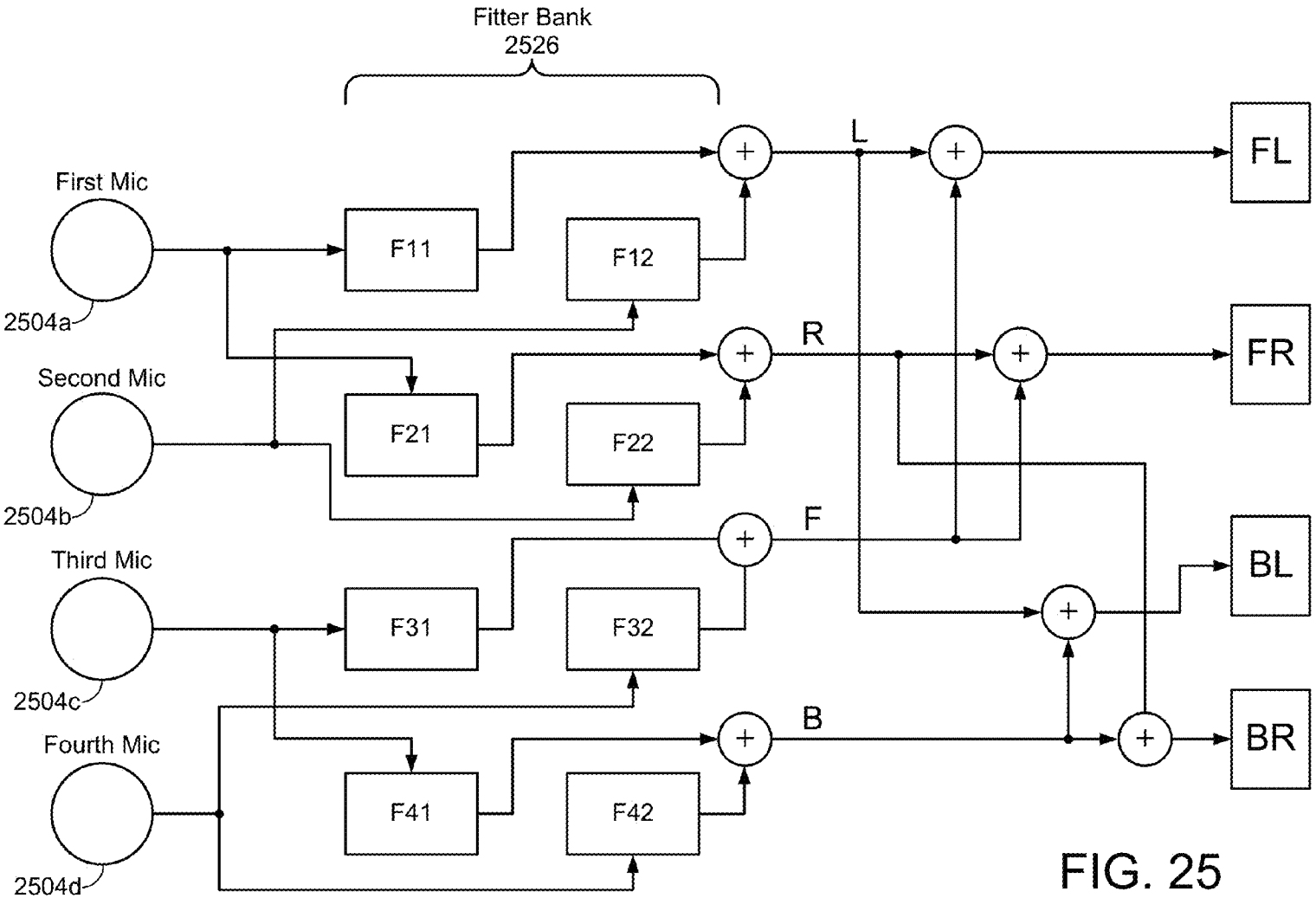
FIG. 25 illustrates a routing diagram for a 2×2 filter bank.

FIG. 16 illustrates a null beamforming approach using four-channel blind source separation (e.g., independent component analysis or independent vector analysis) with an array of four microphones 1604*a-d*. It may be desirable for the axes of at least two of the various pairs of the four microphones 1604*a-d* may be orthogonal or at least substantially orthogonal (e.g., not more than five, ten, fifteen or twenty degrees from orthogonal). Such four-microphone 1604*a-d* filters may be used in addition to dual-microphone pairing to create beampatterns into corner directions. In one example, the filters may be learned using independent vector analysis and training data, and the resulting converged independent vector analysis filters are implemented as fixed filters applied to four recorded microphone 1604*a-d* inputs to produce signals for each of the respective five channel directions in 5.1 surround sound (FL, FC, FR, BR, BL). To exploit the five speakers fully, the front-center channel FC may be obtained, for example, using the following equation: $(FL+FR)/\sqrt{2}$. FIG. 23, described below, illustrates a flowchart for such a method. FIG. 25, described below, illustrates a partial routing diagram for such a filter bank, in which mic n provides input to filters in column n, for $1<=n<=4$, and each of the output channels is a sum of the outputs of the filters in the corresponding row.

In one example of such a learning process, an independent sound source is positioned at each of four designated locations (e.g., the four corner locations FL, FR, BL and BR) around the four-microphone 1604*a-d* array, and the array is used to capture a four-channel signal. Note that each of the captured four-channel outputs is a mixture of all four sources. A blind source separation technique (e.g., independent vector analysis) may then be applied to separate the four independent sources. After convergence, the separated four independent sources as well as a converged filter set, which is essentially beaming toward the target corner and nulling toward the other three corners, may be obtained.

Figure 17:
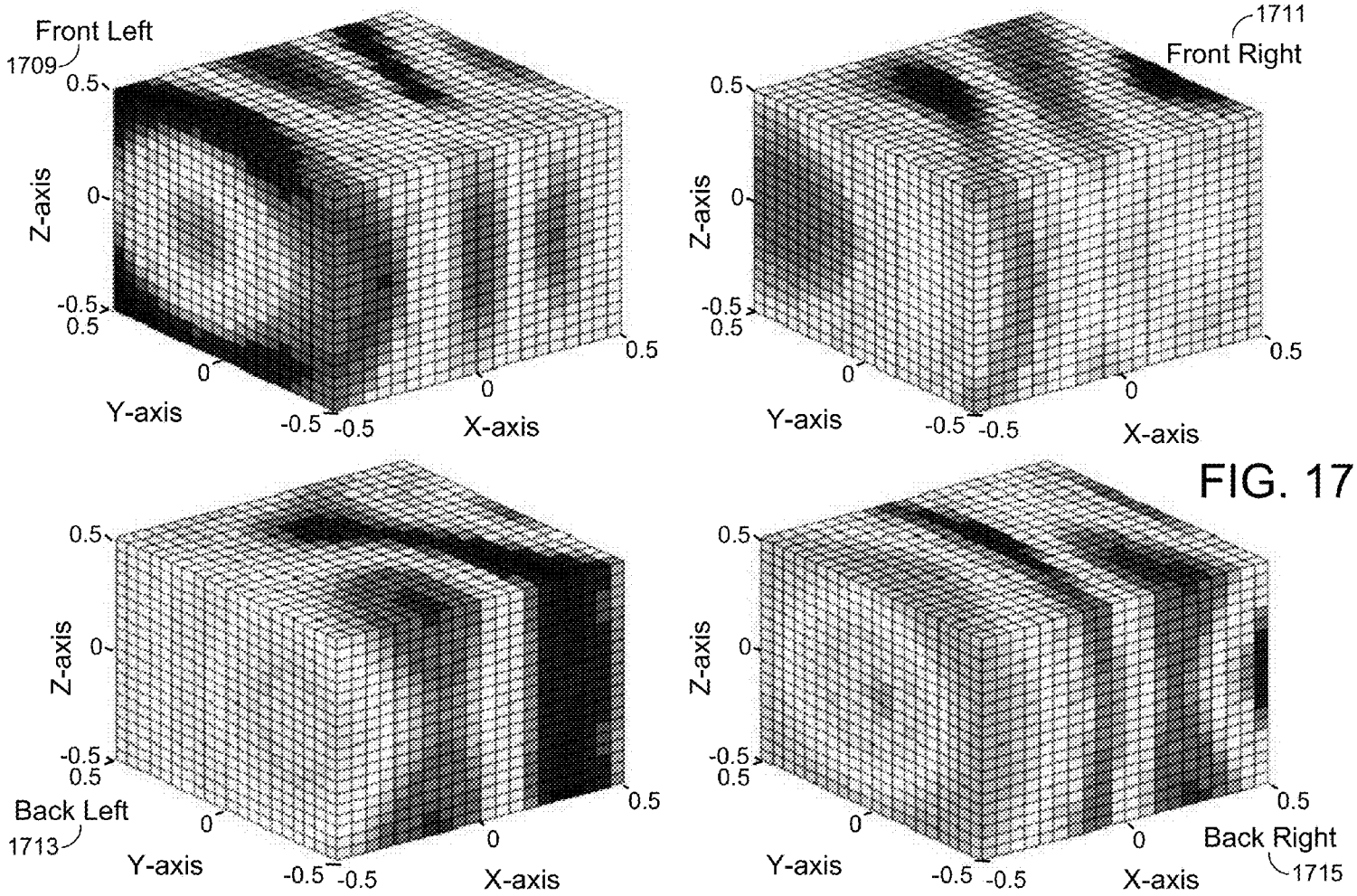
FIG. 17 illustrates examples of beam patterns for a set of four filters for the corner directions FL, FR, BL, and BR.

FIG. 17 illustrates examples of beam patterns for such a set of four filters for the corner directions front left (FL) 1709, front right (FR) 1711, back left (BL) 1713 and back right (BR) 1715. For landscape recording mode, obtaining and applying the filters may include using two front microphones and two back microphones, running a four-channel independent vector analysis learning algorithm for a source at a fixed position relative to the array, and applying the converged filters.

Figure 18:
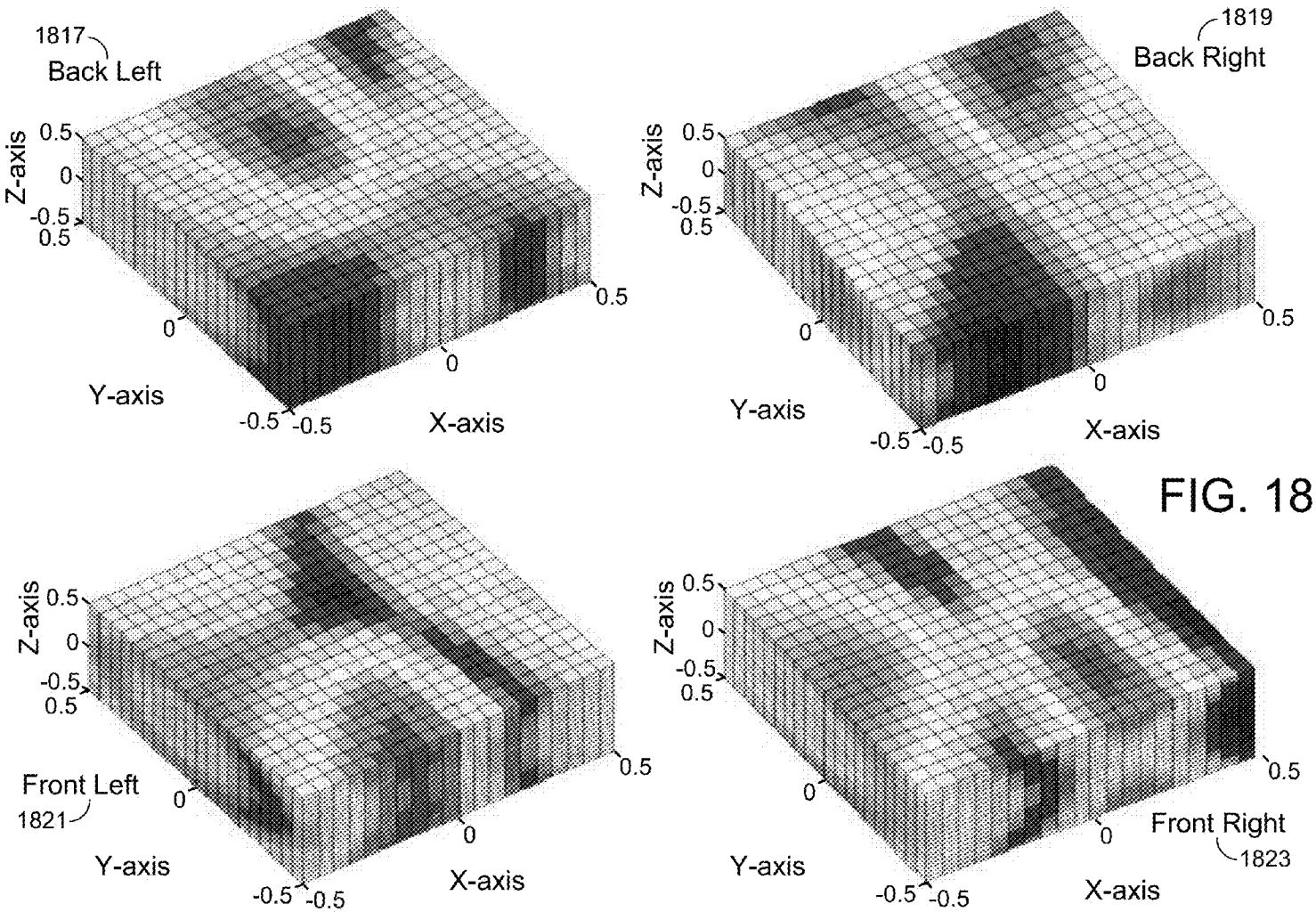
FIG. 18 illustrates examples of independent vector analysis converged filter beam patterns learned on mobile speaker data.
Figure 19:
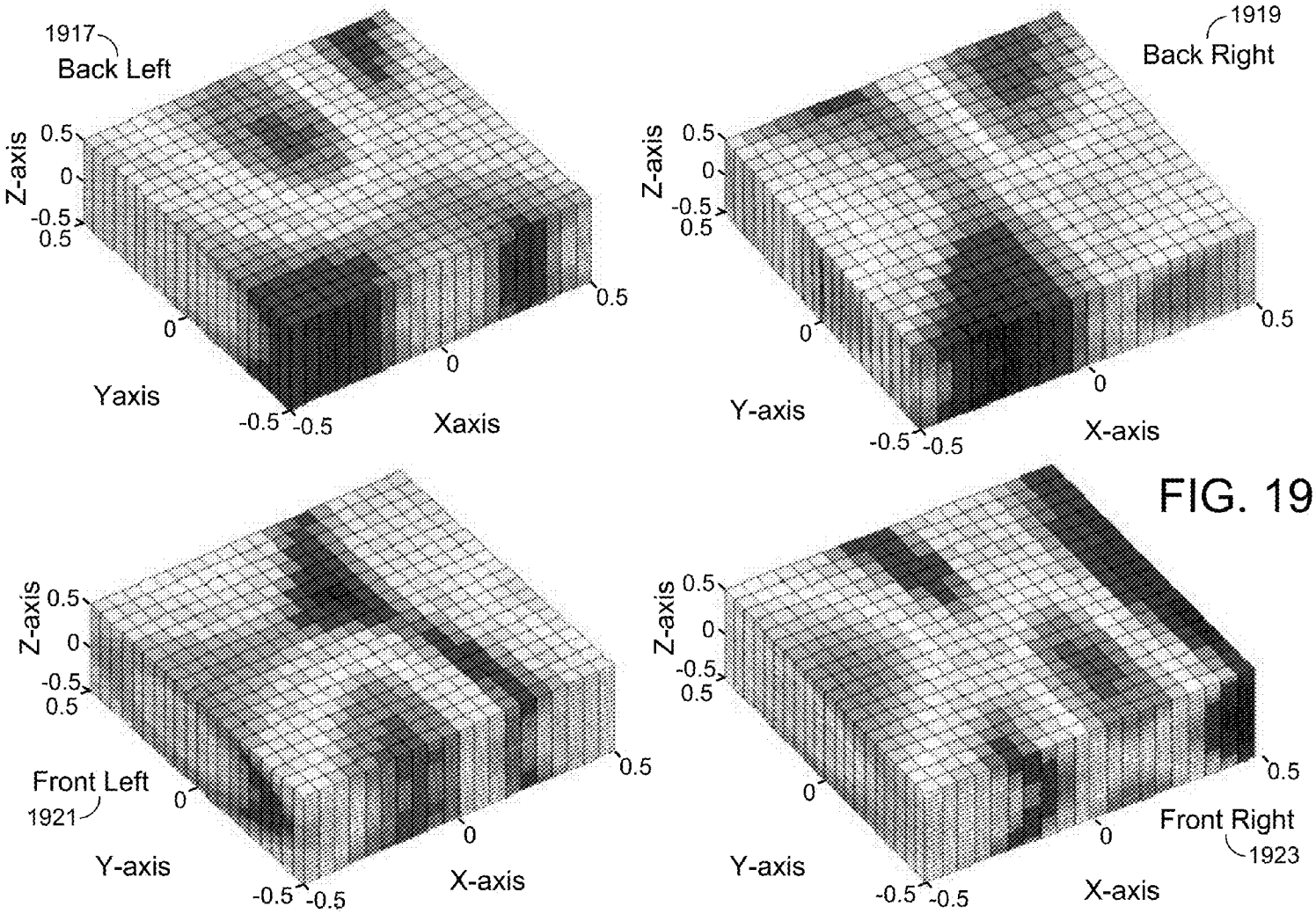
FIG. 19 illustrates examples of independent vector analysis converged filter beam patterns learned on refined mobile speaker data.

The beam pattern may vary depending on the acquired mixture data. FIG. 18 illustrates examples of independent vector analysis converged filter beam patterns learned on mobile speaker data in a back left (BL) 1817 direction, a back right (BR) 1819 direction, a front left (FL) 1821 direction and a front right (FR) 1823 direction. FIG. 19 illustrates examples of independent vector analysis converged filter beam patterns learned on refined mobile speaker data in a back left (BL) 1917 direction, a back right (BR) 1919 direction, a front left (FL) 1921 direction and a front right (FR) 1923 direction. These examples are the same as shown in FIG. 18, except for the front right beam pattern.

The process of training a four-microphone filter using independent vector analysis may include beaming toward the desired direction, but also nulling the interference directions. For example, the filter for the front left (FL) direction is converged to a solution that includes a beam toward the front left (FL) direction and nulls in the front right (FR), back left (BL) and back right (BR) directions. Such a training operation may be done deterministically if the exact microphone array geometry is already known. Alternatively, the independent vector analysis process may be performed with rich training data, in which one or more audio sources (e.g., speech, a musical instrument, etc.) are located at each corner and captured by the four-microphone array. In this case, the training process may be performed once regardless of microphone configuration (i.e., without the necessity of information regarding microphone geometry), and the filter may be fixed for a particular array configuration at a later time. As long as the array includes four microphones in a projected two-dimensional (x-y) plane, the results of this learning processing may be applied to produce an appropriate set of four corner filters. If the microphones of the array are arranged in two orthogonal or nearly orthogonal axes (e.g., within 15 degrees of orthogonal), such a trained filter may be used to record a surround sound image without the constraint of a particular microphone array configuration. For example, a three-microphone array may be sufficient if the two axes are very close to orthogonal, and the ratio between the separations between the microphones on each axis is not important.

As noted above, a high definition signal may be obtained by spatially processing the low frequency and passing the high frequency terms. However, processing of the entire frequency region may be performed instead, if the increase in computational complexity is not a significant concern for the particular design. Because the four-microphone independent vector analysis approach focuses more on nulling than beaming, the effect of aliasing in the high-frequency terms may reduced. Null aliasing may happen at rare frequencies in the beaming direction, such that most of the frequency region in the beaming direction may remain unaffected by the null aliasing, especially for small inter-microphone distances. For larger inter-microphone distances, the nulling may actually become randomized, such that the effect is similar to the case of just passing unprocessed high-frequency terms.

For a small form factor (e.g., a handheld device 102), it may be desirable to avoid performing spatial filtering at low frequencies, as the microphone spacing may be too small to support a good result, and performance in higher frequencies may be compromised. Likewise, it may be desirable to avoid performing spatial filtering at high frequencies, as such frequencies are typically directional already and filtering may be ineffective for frequencies above the spatial aliasing frequency.

If fewer than four microphones are used, it may be difficult to form nulls at the three other corners (e.g., due to insufficient degrees of freedom). In this case, it may be desirable to use an alternative, such as end-fire pairing as discussed with reference to FIGS. 14, 21, and 22.

FIG. 20 illustrates a flowchart of a method 2000 for combining end-fire beams. In one example, a wireless communication device 102 may apply 2002 a beam in one end-fire direction. The wireless communication device 102 may apply 2004 a beam in the other end-fire direction. In some examples a microphone 104*a-e* pair may apply the beams in the end-fire directions. Next, the wireless communication device 102 may combine 2006 the filtered signals.

Figure 21:
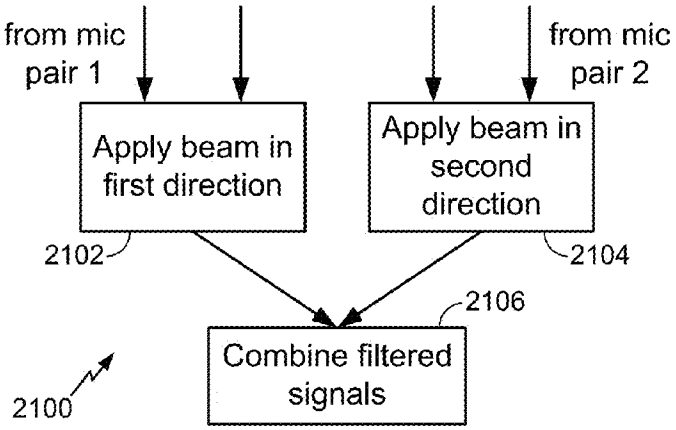
FIG. 21 illustrates a flowchart of a method for a general dual-pair case.

FIG. 21 illustrates a flowchart of a method 2100 for combining beams in a general dual-pair microphone case. In one example, a first microphone 104*a-e* pair may apply 2102 a beam in a first direction. A second microphone 104*a-e* pair may apply 2104 a beam in a second direction. Then, the wireless communication device 102 may combine 2106 the filtered signals.

Figure 22:
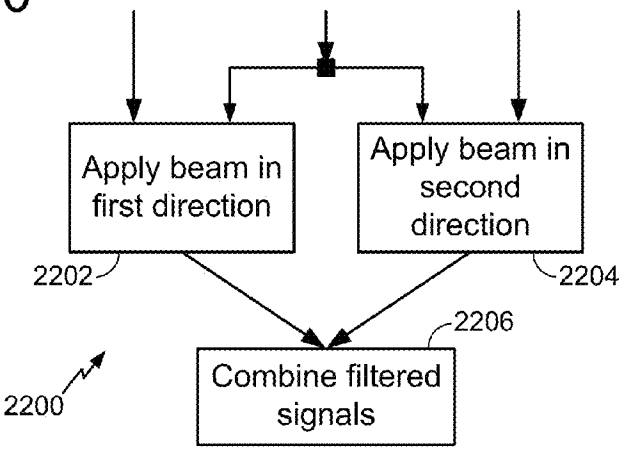
FIG. 22 illustrates an implementation of the method of FIG. 21 for a three-microphone case.

FIG. 22 illustrates a flowchart of a method 2200 of combining beams in a three microphone case. In this example, a first microphone 104*a* and a second microphone 104*b* may apply 2202 a beam in a first direction. The second microphone 104*b* and a third microphone 104*c* may apply 2204 a beam in a second direction. Then, the wireless communication device 102 may combine 2206 the filtered signals. Each pair of end-fire beamforms may have a +90 and −90 degree focusing area. As an example, to have front (+90 of front-back pair) left (+90 of left-right pair), a combination of two-end-fire beamforms both with a +90 degree focus area may be used.

FIG. 23 is a block diagram of an array of four microphones 2304*a-d* (e.g., a first mic channel 2304*a*, a second mic channel 2304*b*, a third mic channel 2304*c* and a fourth mic channel 2304*d*) using four-channel blind source separation. The microphone 2304*a-d* channels may each be coupled to each of four filters 2324*a-d*. To exploit the five speakers fully, the front center channel 2304*e* may be obtained by combining the front right channel 2304*a* and the left channel 2304*b*, e.g., via the output of the first filter 2324*a* and the second filter 2324*b*.

Figure 24:
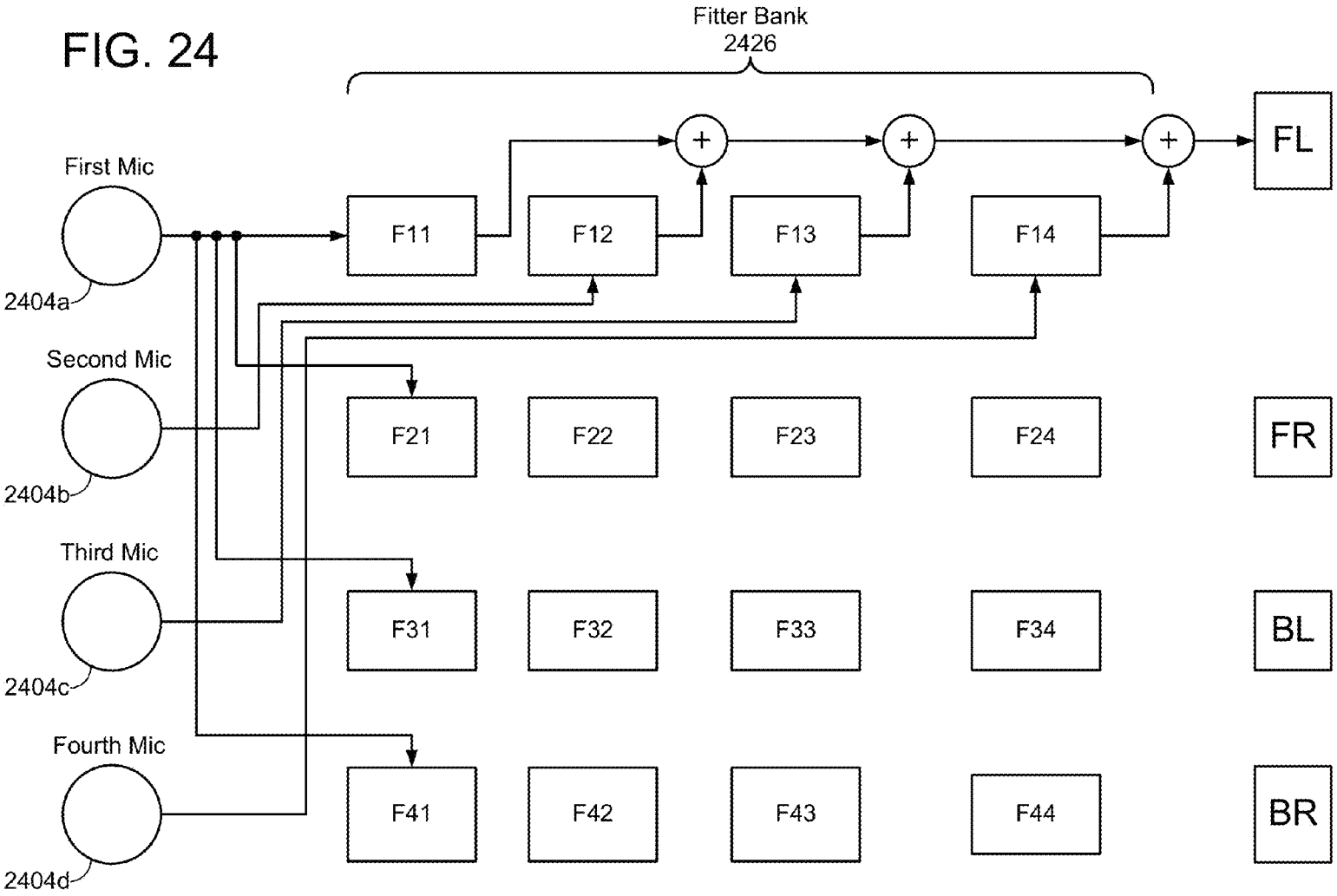
FIG. 24 illustrates a partial routing diagram for a blind source separation filter bank.

FIG. 24 illustrates a partial routing diagram for a blind source separation filter bank 2426. Four microphones 2404 (e.g., a first mic 2404*a*, a second mic 2404*b*, a third mic 2404*c* and a fourth mic 2404*d*) may be coupled to a filter bank 2426 to produce audio signals in the front left (FL) direction, the front right (FR) direction, the back left (BL) direction and the back right (BR) direction.

FIG. 25 illustrates a routing diagram for a 2×2 filter bank 2526. Four microphones 2504 (e.g., a first mic 2504*a*, a second mic 2504*b*, a third mic 2504*c* and a fourth mic 2504*d*) may be coupled to a filter bank 2526 to produce audio signals in the front left (FL) direction, the front right (FR) direction, the back left (BL) direction and the back right (BR) direction. Notice that at the output of the 2×2 filter bank, the 3-D audio signals FL, FR, BR and BL are output. As illustrated in FIG. 23, the center channel may be reproduced from a combination of two of the other filters (the first and second filter).

This description includes disclosures of providing a 5.1-channel recording from a signal recorded using multiple omnidirectional microphones 2504*a-d*. It may be desirable to create a binaural recording from a signal captured using multiple omnidirectional microphones 2504*a-d*. If there is no 5.1 channel surround system from the user side, for example, it may be desirable to downmix the 5.1 channels to a stereo binaural recording so that the user can have experience of being in an actual acoustic space with the surround sound system. Also, this capability can provide an option wherein the user may monitor the surround recording while they are recording the scene on the spot and/or play back the recorded video and surround sound on his mobile device using a stereo headset instead of a home theater system.

The systems and methods described herein may provide for directional sound sources from the array of omnidirectional microphones 2504*a-d*, which are intended to be played through loudspeakers located at the designated locations (FL, FR, C, BL (or surround left), and BR (or surround right)) in a living room space. One method of reproducing this situation with headphones may include an offline process of measuring binaural impulse responses (BIRs) (e.g., binaural transfer functions) from each loudspeaker to a microphone 2504*a-d* located inside of each ear in the desired acoustic space. The binaural impulse responses may encode the acoustic path information, including the direct path as well as the reflection paths from each loudspeaker, for every source-receiver pair among the array of loudspeakers and the two ears. Small microphones 2504*a-d* may be located inside of real human ears, or use a dummy head such as a Head and Torso Simulator (e.g., HATS, Bruel and Kjaer, D K) with silicone ears.

For binaural reproduction, the measured binaural impulse responses may be convolved with each directional sound source for the designated loudspeaker location. After convolving all the directional sources with the binaural impulse responses, the results may be summed for each ear recording. In this case two channels (e.g., left and right) that replicate the left and right signals captured by human ears may be played though a headphone. Note that 5.1 surround generation from the array of omnidirectional microphones 2504*a-d* may be used as a via-point from the array to binaural reproduction. Therefore, this scheme may be generalized depending on how the via-point is generated. For example, more directional sources are created from the signals captured by the array, they may be used as a via-point with appropriately measured binaural impulse responses from the desired loudspeaker location to the ears.

It may be desirable to perform a method as described herein within a portable audio sensing device that has an array of two or more microphones 2504*a-d* configured to receive acoustic signals. Examples of a portable audio sensing device that may be implemented to include such an array and may be used for audio recording and/or voice communications applications include a telephone handset (e.g., a cellular telephone handset); a wired or wireless headset (e.g., a Bluetooth headset); a handheld audio and/or video recorder; a personal media player configured to record audio and/or video content; a personal digital assistant (PDA) or other handheld computing device; and a notebook computer, laptop computer, netbook computer, tablet computer, or other portable computing device. The class of portable computing devices currently includes devices having names such as laptop computers, notebook computers, netbook computers, ultra-portable computers, tablet computers, mobile Internet devices, smartbooks and smartphones. Such a device may have a top panel that includes a display screen and a bottom panel that may include a keyboard, wherein the two panels may be connected in a clamshell or other hinged relationship. Such a device may be similarly implemented as a tablet computer that includes a touchscreen display on a top surface. Other examples of audio sensing devices that may be constructed to perform such a method and to include instances of array and may be used for audio recording and/or voice communications applications include set-top boxes and audio- and/or video-conferencing devices.

Figure 26A:
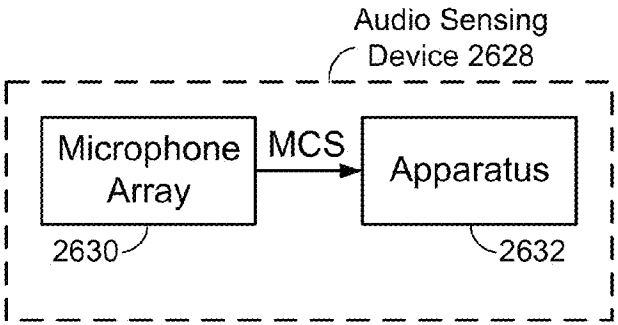
FIG. 26A illustrates a block diagram of a multi-microphone audio sensing device according to a general configuration.

FIG. 26A illustrates a block diagram of a multi-microphone audio sensing device 2628 according to a general configuration. The audio sensing device 2628 may include an instance of any of the implementations of microphone array 2630 disclosed herein, and any of the audio sensing devices disclosed herein may be implemented as an instance of the audio sensing device 2628. The audio sensing device 2628 may also include an apparatus 2632 that may be configured to process the multichannel audio signal (MCS) by performing an implementation of one or more of the methods as disclosed herein. The apparatus 2632 may be implemented as a combination of hardware (e.g., a processor) with software and/or with firmware.

Figure 26B:
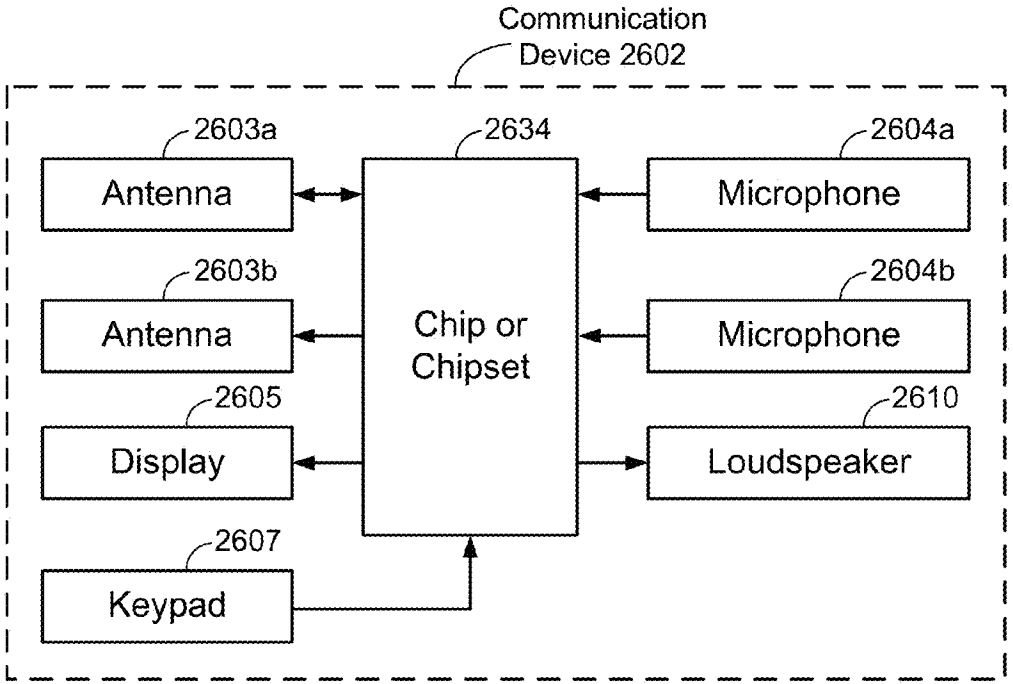
FIG. 26B illustrates a block diagram of a communications device.

FIG. 26B illustrates a block diagram of a communications device 2602 that may be an implementation of the device 2628. The wireless communication device 2602 may include a chip or chipset 2634 (e.g., a mobile station modem (MSM) chipset) that includes the apparatus 2632. The chip/chipset 2634 may include one or more processors. The chip/chipset 2634 may also include processing elements of the array 2630 (e.g., elements of the audio preprocessing stage described below). The chip/chipset 2634 may also include a receiver, which may be configured to receive a radio-frequency (RF) communications signal and to decode and reproduce an audio signal encoded within the RF signal, and a transmitter, which may be configured to encode an audio signal that may be based on a processed signal produced by the apparatus 2632 and to transmit an RF communications signal that describes the encoded audio signal. For example, one or more processors of the chip/chipset 2634 may be configured to perform a noise reduction operation as described above on one or more channels of the multichannel signal such that the encoded audio signal is based on the noise-reduced signal.

Each microphone of the array 2630 may have a response that is omnidirectional, bidirectional, or unidirectional (e.g., cardioid). The various types of microphones that may be used in the array 2630 may include (without limitation) piezoelectric microphones, dynamic microphones, and electret microphones. In a device for portable voice communications, such as a handset or headset, the center-to-center spacing between adjacent microphones of the array 2630 may be in the range of from about 1.5 cm to about 4.5 cm, although a larger spacing (e.g., up to 10 or 15 cm) may also be possible in a device such as a handset or smartphone, and even larger spacings (e.g., up to 20, 25 or 30 cm or more) may be possible in a device such as a tablet computer. The microphones of the array 2630 may be arranged along a line (with uniform or non-uniform microphone spacing) or, alternatively, such that their centers lie at the vertices of a two-dimensional (e.g., triangular) or three-dimensional shape.

It is expressly noted that the microphones may be implemented more generally as transducers sensitive to radiations or emissions other than sound. In one such example, the microphone pair may be implemented as a pair of ultrasonic transducers (e.g., transducers sensitive to acoustic frequencies greater than fifteen, twenty, twenty-five, thirty, forty or fifty kilohertz or more).

During the operation of a multi-microphone audio sensing device 2628, the array may 2630 produce a multichannel signal in which each channel is based on the response of a corresponding one of the microphones to the acoustic environment. One microphone may receive a particular sound more directly than another microphone, such that the corresponding channels differ from one another to provide collectively a more complete representation of the acoustic environment than can be captured using a single microphone. In some implementations, the chipset 2634 may be coupled to one or more microphones 2604*a-b*, a loudspeaker 2610, one or more antennas 2603*a-b*, a display 2605 and/or a keypad 2607.

Figure 27A:
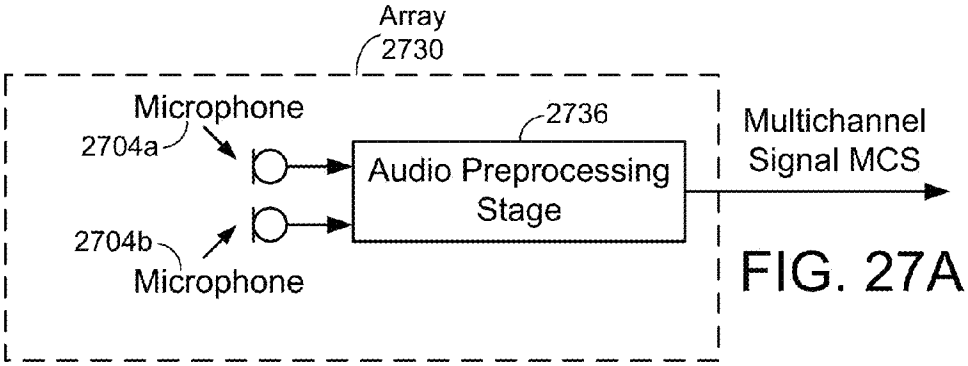
FIG. 27A illustrates a block diagram of a microphone array.

FIG. 27A is a block diagram of an array 2730 of microphones 2704*a-b* configured to perform one or more operations. It may be desirable for the array 2730 to perform one or more processing operations on the signals produced by the microphones 2704*a-b* to produce the multichannel signal. The array 2730 may include an audio preprocessing stage 2736 configured to perform one or more such operations that may include (without limitation) impedance matching, analog-to-digital conversion, gain control, and/or filtering in the analog and/or digital domains.

Figure 27B:
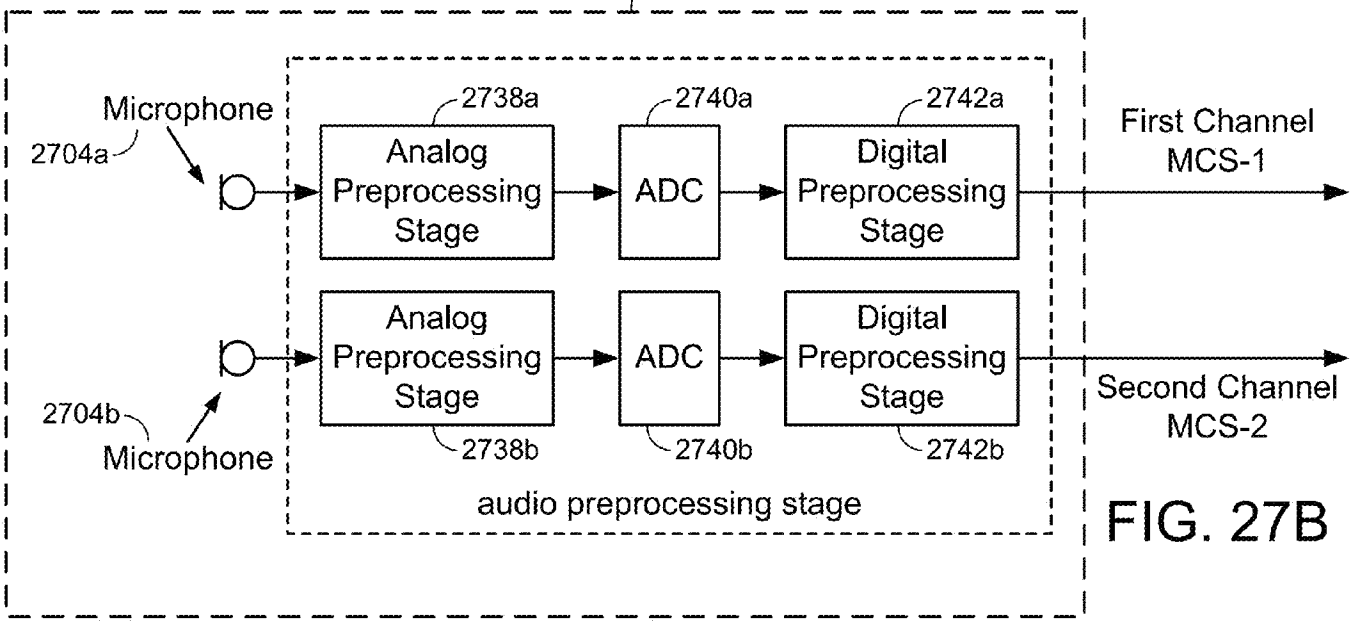
FIG. 27B illustrates a block diagram of a microphone array.

FIG. 27B is another block diagram of a microphone array 2730 configured to perform one or more operations. The array 2730 may include an audio preprocessing stage 2736 that may include analog preprocessing stages 2738*a* and 2738*b*. In one example, stages 2738*a* and 2738*b* may each be configured to perform a highpass filtering operation (e.g., with a cutoff frequency of 50, 100, or 200 Hz) on the corresponding microphone signal.

It may be desirable for the array 2730 to produce the multichannel signal as a digital signal, that is to say, as a sequence of samples. The array 2730, for example, may include analog-to-digital converters (ADCs) 2740*a* and 2740*b* that are each arranged to sample the corresponding analog channel. Typical sampling rates for acoustic applications may include 8 kHz, 12 kHz, 16 kHz, and other frequencies in the range of from about 8 to about 16 kHz, although sampling rates as high as about 44 kHz may also be used. In this particular example, the array 2730 may also include digital preprocessing stages 2742*a* and 2742*b* that are each configured to perform one or more preprocessing operations (e.g., echo cancellation, noise reduction, and/or spectral shaping) on the corresponding digitized channel to produce the corresponding channels MCS-1, MCS-2 of multichannel signal MCS. Although FIGS. 27A and 27B show two-channel implementations, it will be understood that the same principles may be extended to an arbitrary number of microphones 2704*a-b* and corresponding channels of multichannel signal MCS.

Current formats for immersive audio reproduction include (a) binaural 3D, (b) transaural 3D, and (c) 5.1/7.1 surround sound. Both for binaural and transaural 3D typically just stereo channels/signals are transmitted. For surround sound more than just stereo signals may be transmitted. This disclosure proposes a coding scheme used in mobile devices for transmitting more than stereo for surround sound.

Current systems may transmit "B-format audio" as illustrated in FIG. 1, from the Journal of Audio Eng. Soci. Vol. 57, No. 9, 2009 September. The B-format audio has 1 via-point with 4 channels and requires a special recording setup. Other systems, are focused on broadcasting, not voice-communication.

The present systems and methods have four via points used in a real-time communication system, where a via point may exist at each of four corners (e.g., front left, front right, back left and back right) of a surround sound system. Transmitting the sounds of these four corners may be done together or independently. In these configurations the four audio signals may be compressed using any number of speech codecs. In some cases, there may be no need for a recording setup (e.g., such as that used in the B-format audio). The z-axis can be omitted. Doing so does not degrade the signal as the information can still be discerned by the human ears.

The new coding scheme is able to provide compression with distortion, primarily limited to that inherent by the speech codecs. The final audio output may be interpolated for possible loudspeaker placement. In addition, it can be compatible with other formats, such as B-format (except for the z-axis, and binaural recording). Moreover, the new coding scheme may benefit by the use of echo cancellers that work in tandem with the speech codecs, located in the audio path of most mobile devices, as the four audio signals may be largely uncorrelated.

The present systems and methods may address the issue of real-time communication. In some examples, frequency bands from a certain lower band (LB) frequency up to a certain upper band (UB) frequency (e.g., [LB, UB]) may be transmitted as individual channels. Above the certain upper band (UB) frequency to the Nyquist frequency (e.g., [UB, NF]) different channels may be transmitted depending on the available channel capacity. For example, if four channels are available, four audio channels may be transmitted. If two channels are available, the front and back channels may be transmitted after averaging the front two and back two channels. If one channel is available, the average of all microphone inputs may be transmitted. In some configurations, no channels are transmitted and the high band (e.g., [UB, NF]) may be generated from the low band (e.g., [LB, UB]) using a technique similar to spectral band replication. For those bands below the lower band frequency (LB), (e.g., [0, LB]), the average of all microphone inputs may be transmitted.

In some examples, the encoding of audio signals may include selective encoding. For example, if a user wants to send one specific directional source, (e.g., the user's voice), the wireless communication device can allocate coding bit resources more for that direction, by minimizing dynamic range of the other channels as well as decreasing the energy of the other directions. Additionally or alternatively, the wireless communication device can transmit one or two channels if the user is interested in a specific directional source (e.g., the user's voice).

Figure 28:
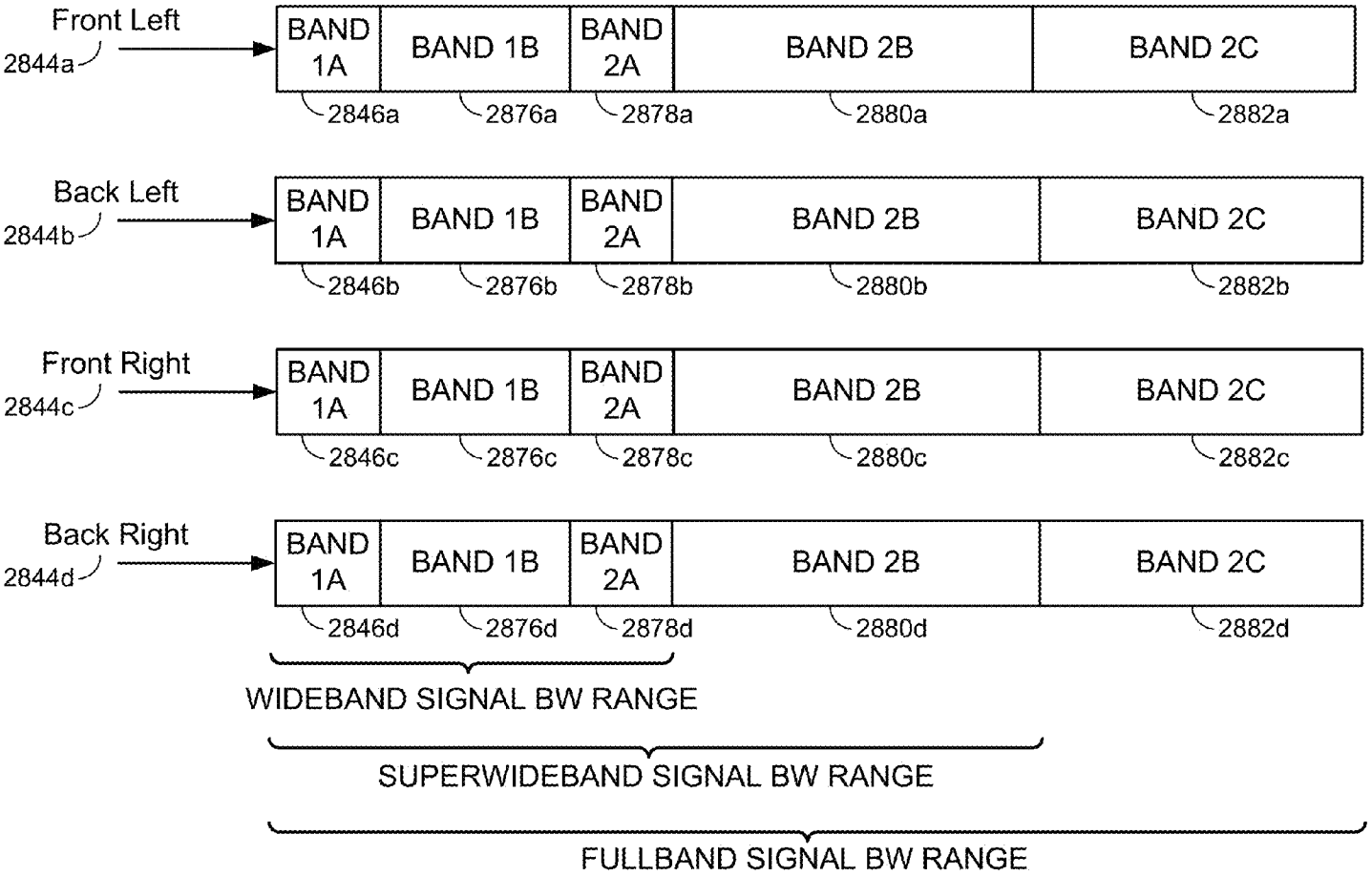
FIG. 28 illustrates a chart of different frequency ranges and bands over which different speech codecs operate over.

FIG. 28 illustrates a chart of frequency bands of one or more audio signals 2844*a-d*. The audio signals 2844*a-d* may represent audio signals received from different directions. For example, one audio signal 2844*a* may be an audio signal from a front left (FL) direction in a surround sound system, another audio signal 2844*b* may be an audio signal from a back left (BL) direction, another audio signal 2844*c* may be an audio signal from a front right (FR) direction and another audio signal 2844*d* may be an audio signal from a back right (BR) direction.

According to some configurations, an audio signal 2844*a-d* may be divided into one or more bands. For example, a front left audio signal 2844*a* may be divided into band 1A 2846*a*, band 1B 2876*a*, band 2A 2878*a*, band 2B 2880*a* and band 2C 2882*a*. The other audio signals 2844*b-d* may be divided similarly. As used herein the term "band 1B" may refer to the frequency bands that fall between a certain low band frequency (LB) and a certain upper band frequency (UB) (e.g., [LB, UB]). The bands of an audio signal 2844*a-d* may include one or more types of bands. For example, an audio signal 2844*a* may include one or more narrowband signals. In some implementations, a narrowband signal may include band 1A 2846*a-d* and a portion of band 1B 2876*a-d* (e.g., the portion of band 1B 2876*a-d* that is less than 4 kHz). In other words, if the certain upper band frequency (UB) is greater than 4 kHz, band 1B 2876*a-d* may be larger than a narrowband signal. In other implementations, a narrowband signal may include band 1A 2846*a-d*, band 1B 2876*a-d*, and a portion of band 2A 2878*a-d* (e.g., the portion of band 2A 2878*a-d* that is less than 4 kHz). The audio signal 2844*a* may also include one or more non-narrowband signals (e.g., a portion of band 2A 2878*a* (the portion greater than 4 kHz), band 2B 2880*a* and band 2C 2882*a*). As used herein, the term "non-narrowband" refers to any signal that is not a narrowband signal (e.g., a wideband signal, a superwideband signal and a fullband signal).

The ranges of the bands may be as follows: band 1A 2846*a-d* may span from 0-200 Hz. In some implementations the upper range of band 1A 2846*a-d* may be up to approximately 500 Hz. Band 1B 2876*a-d* may span from the maximum frequency of band 1A 2846*a-d* (e.g., 200 Hz or 500 Hz) up to approximately 6.4 kHz. Band 2A 2878*a-d* may span from the maximum range of band 1B 2876*a-d* (e.g., 6.4 kHz) and approximately 8 kHz. Band 2B 2880*a-d* may span from the maximum range of band 2A 2878*a-d* (e.g. 8 kHz) up to approximately 16 kHz. Band 2C 2882*a-d* may span from the maximum range of band 2B 2880*a-d* (e.g., approximately 16 kHz) up to approximately 24 kHz.

In some implementations, the upper range of band 1B 2876*a-d* may depend on one or more factors including, but not limited to, the geometric placement of the microphones and the mechanical design of the microphones (e.g., unidirectional microphones vs. omnidirectional microphones). For example, the upper range of band 1B 2876*a-d* may be different when the microphones are positioned closer together than when the microphones are positioned farther apart. In this implementation, the other bands (e.g., bands 2A-C 2878*a-d*, 2880*a-d*, 2882*a-d*) may be derived from band 1B 2876*a-d*.

The frequency ranges up to the upper boundary of band 1B 2876*a-d* may be a narrowband signal (e.g., up to 4 kHz) or slightly higher than a narrowband limit (e.g., 6.4 KHz). As described above, if the upper boundary of band 1B 2876*a-d* is less than a narrowband signal (e.g., 4 kHz), a portion of band 2A 2878*a-d* may include a narrowband signal. By comparison, if the upper boundary of band 1B 2876*a-d* is greater than a narrowband signal (e.g., 4 kHz), band 2A 2878*a-d* may not include a narrowband signal. A portion of the frequency ranges up to the upper boundary of band 2A 2878*a-d* (e.g., 8 kHz) may be a wideband signal (e.g., the portion greater than 4 kHz). The frequency ranges up to the upper boundary of band 2B 2880*a-d* (e.g., 16 kHz) may be a superwideband signal. The frequency ranges up to the upper boundary of band 2C 2882*a-d* (e.g., 24 kHz) may be a fullband signal.

Depending on the availability of the network, and availability of speech codecs available in the mobile device 102, different configurations of codecs may be used. Where compression is involved, a distinction is sometimes made between audio codecs and speech codecs. Speech codecs may be referred to as voice codecs. Audio codecs and speech codecs have different compression schemes and the amount of compression may vary widely between the two. Audio codecs may have better fidelity, but may require more bits when compressing an audio signal 2844*a-d*. Thus, the compression ratio (i.e., the number of bits of the input signal in the codec to the number of bits of the output signal of the codec) may be lower for audio codecs than speech codecs. Consequently, because of over-the-air bandwidth constraints in a cell (an area covered by multiple base stations), audio codecs were not used in older 2G (Second Generation) and 3G (Third Generation) communication systems, to transmit voice, as the number of bits required to transmit a speech packet was undesirable. As a result, speech codecs were and have been used in 2G and 3 G communication systems to transmit compressed speech over-the air in a voice channel from one mobile device to another mobile device.

Although audio codecs exist in mobile devices, the transmission of audio packets, i.e., the description for the compression of audio by an audio codec, has been done over the air data channel. Examples of audio codecs include MPEG-2/AAC Stereo, MPEG-4 BSAC Stereo, Real Audio, SBC Bluetooth, WMA and WMA 10 Pro. It should be noted that these audio codecs may be found in mobile devices in 3G systems, but the compressed audio signals were not transmitted over the air, in real-time, over a traffic channel or voice channel. Speech codecs are used to compress audio signals and transmit over the air, in real time. Examples of speech codecs include AMR Narrowband Speech Codec (5.15 kbp), AMR Wideband Speech Codec (8.85 Kbps), G.729AB Speech Codec (8 kbps), GSM-EFR Speech Codec (12.2 kbps), GSM-FR Speech Codec (13 kbps), GSM-HR speech Codec (5.6 kpbs), EVRC-NB, EVRC-WB. Compressed speech (or audio) is packaged in a vocoder packet and sent over the air in a traffic channel. The speech codec is sometimes called a vocoder. Before being sent over the air, the vocoder packet is inserted into a larger packet. In 2G and 3 G communications voice is transmitted in voice-channels, although voice can also be transmitted in data channels using VoIP (voice-over-IP).

Depending on the over-the air bandwidth, various codec schemes may be used for encoding the signals between the upper band (UB) frequency and the Nyquist Frequency (NF). Examples of these schemes are presented in FIGS. 29-33.

Figure 29A:
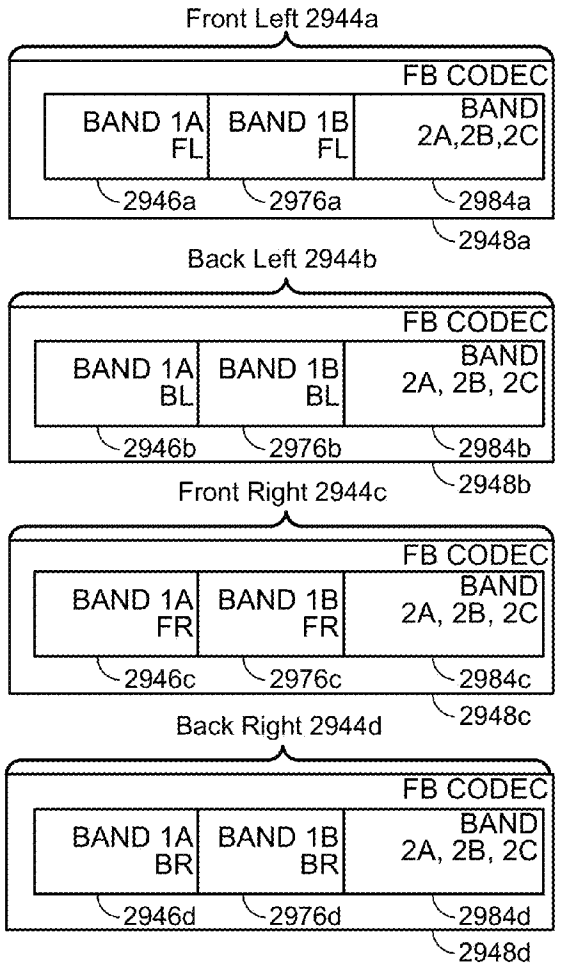
FIGS. 29A, 29B, and 29C each illustrate possible schemes for a first configuration using four non-narrowband codecs for each type of signal that may be compressed, i.e., fullband (FB), superwideband (SWB) and wideband (WB)

FIG. 29A illustrates one possible scheme for a first configuration using four fullband codecs 2948*a-d*. As described above, the audio signals 2944*a-d* may represent audio signals 2944*a-d* received from different locations (e.g., a front left audio signal 2944*a*, a back left audio signal 2944*b*, a front right audio signal 2944*c* and a back right audio signal 2944*d*). Similarly, as described above, an audio signal 2944*a-d* may be divided into one or more bands. Using a fullband codec 2948*a-d*, an audio signal 2944*a* may include band 1A 2946*a*, band 1B 2976*a* and bands 2A-2C 2984*a*. In some cases, the frequency ranges of the bands may be those described earlier.

In this example, each audio signal 2944*a-d* may use a fullband codec 2948*a-d* for compression and transmission of the various bands of the audio signal 2944*a-d*. For example, those bands of each audio signal 2944*a-d* that fall within the frequency range defined by a certain low band frequency (LB) and a certain upper band frequency (UB) (e.g., including band 1B 2976*a-d*) may be filtered. According to this configuration, for bands that include frequencies greater than the certain upper band frequency (UB) and less than the Nyquist Frequency (e.g., bands 2A-2C 2984*a-d*), the original audio signal captured at the nearest microphone to the desired corner location 2944*a-d* may be encoded. Similarly, for bands that include frequencies less than the certain low band frequency (LB) (e.g., band 1A 2946*a-d*), the original audio signal captured at the nearest microphone to the desired corner location 2944*a-d* may be encoded. In some configurations, encoding the original audio signal captured at the nearest microphone to the desired corner location 2944*a-d* may denote a designated direction for bands 2A-2C 2984*a-d* since it captures natural delay and gain difference among the microphone channels. In some examples, the difference between capturing the nearest microphone to the desired location and the filtered range is that the effect of the directionality is not so much compared with the filtered frequency region.

Figure 29B:
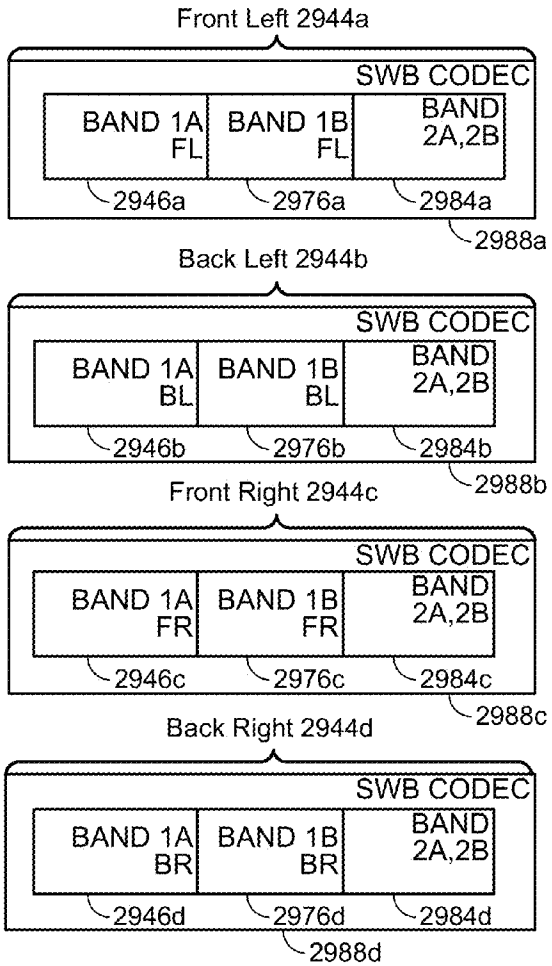

FIG. 29B illustrates one possible scheme for a first configuration using four superwideband codecs 2988*a-d*. Using a superwideband codec 2988*a-d*, an audio signal 2944*a-d* may include band 1A 2946*a-d*, band 1B 2976*a-d* and bands 2A-2B 2986*a-d*.

In this example, those bands of each audio signal 2944*a-d* that fall within the frequency range defined by a certain low band frequency (LB) and a certain upper band frequency (UB) (e.g., including band 1B 2976*a-d*) may be filtered. According to this configuration, for bands that include frequencies greater than the certain upper band frequency (UB) and less than the Nyquist Frequency (e.g., bands 2A-2B 2986*a-d*), the original audio signal captured at the nearest microphone to the desired corner location 2944*a-d* may be encoded. Similarly, for bands that include frequencies less than the certain low band frequency (LB) (e.g., band 1A 2946*a-d*), the original audio signal captured at the nearest microphone to the desired corner location 2944*a-d* may be encoded.

Figure 29C:
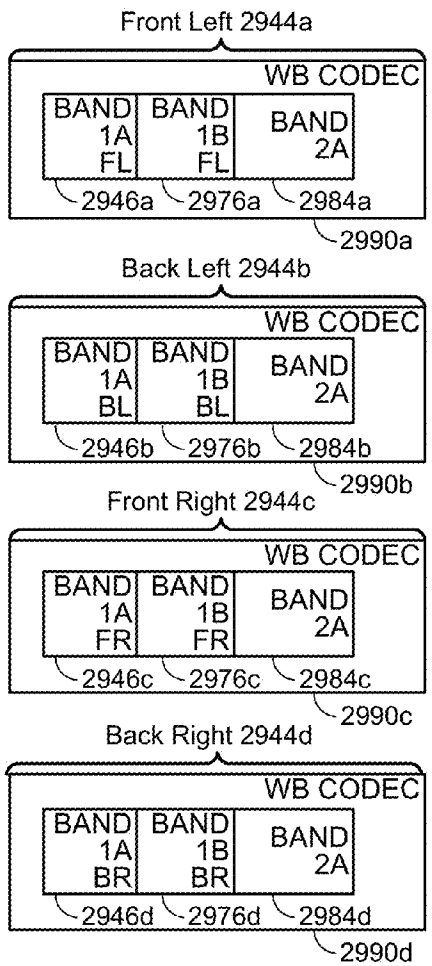

FIG. 29C illustrates one possible scheme for a first configuration using four wideband codecs 2990*a-d*. Using a wideband codec 2990*a-d*, an audio signal 2944*a-d* may include band 1A 2946*a-d*, band 1B 2976*a-d* and band 2A 2978*a-d*.

In this example, those bands of each audio signal 2944*a-d* that fall within the frequency range defined by a certain low band frequency (LB) and a certain upper band frequency (UB) (e.g., including band 1B 2976*a-d*) may be filtered. According to this configuration, for bands that include frequencies greater than the certain upper band frequency (UB) and less than the Nyquist Frequency (e.g., band 2A 2978*a-d*), the original audio signal captured at the nearest microphone to the desired corner location 2944*a-d* may be encoded. Similarly, for bands that include frequencies less than the certain low band frequency (LB) (e.g., band 1A 2946*a-d*), the original audio signal captured at the nearest microphone to the desired corner location 2944*a-d* may be encoded.

Figure 30A:
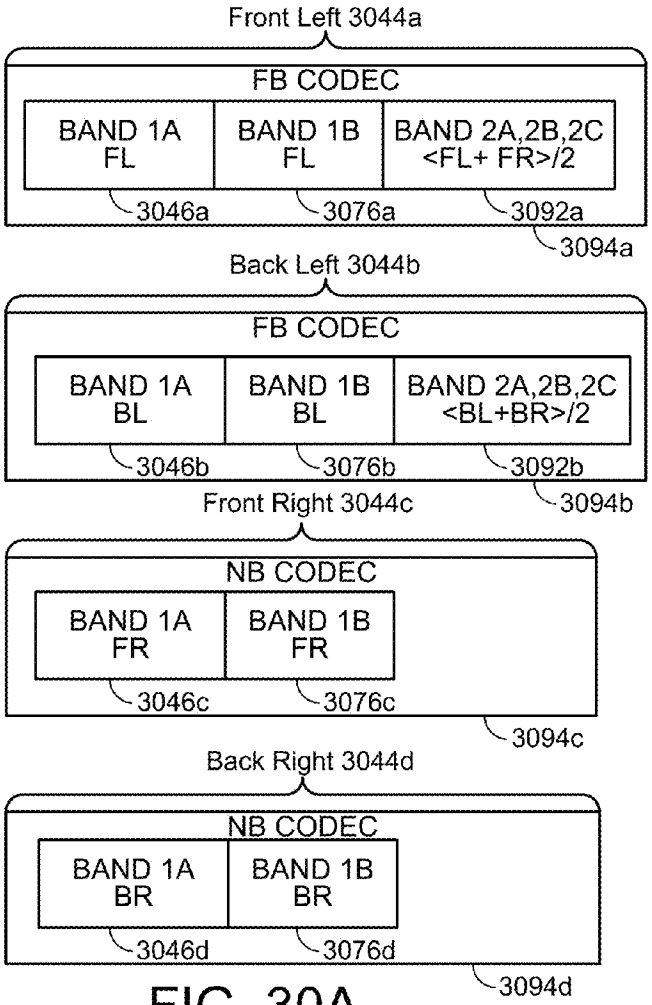
FIG. 30A illustrates a possible scheme for a second configuration, where two codecs have averaged audio signals.

FIG. 30A illustrates a possible scheme for a second configuration where two codecs 3094*a-d* have averaged audio signals. In some examples, different codecs 3094*a-d* may be used for different audio signals 3044*a-d*. For example, a front left audio signal 3044*a* and a back left audio signal 3044*b* may use fullband codecs 3094*a*, 3094*b*, respectively. Furthermore, a front right audio signal 3044*c* and a back right audio signal 3044*d* may use narrowband codecs 3094*c*, 3094*d*. While FIG. 30A depicts two fullband codecs 3094*a*, 3094*b*, and two narrowband codecs 3094*c*, 3094*d*, any combination of codecs may be used, and the present systems and methods are not limited by the configuration depicted in FIG. 30A. For example, the front right audio signal 3044*c* and the back right audio signal 3044*d* may use wideband or superwideband codecs instead of the narrowband codecs 3094*c-d* depicted in FIG. 30A. In some examples, if the upper band frequency (UB) is greater than the narrow band limit (e.g., 4 kHz), the front right audio signal 3044*c* and the back right audio signal 3044*d* may use wideband codecs to improve the spatial coding effect or may use narrowband codecs if the network resource is limited.

In this configuration, the fullband codecs 3094*a*, 3094*b* may average one or more audio signals 3044*a-d* for the frequency range above a certain upper boundary of the front right audio signal 3044*c* and the back right audio signal 3044*d*. For example, the fullband codecs 3094*a*, 3094*b* may average the audio signal bands that include frequencies greater than the certain upper band frequency (UB) (e.g., band 2A-2C 3092*a*, 3092*b*). Audio signals 3044*a-d* originating from the same general direction may be averaged together. For example, a front left audio signal 3044*a* and a front right audio signal 3044*c* may be averaged together, and a back left audio signal 3044*b* and a back right audio signal 3044*d* may be averaged together.

An example of averaging audio signals 3044*a-d* is given as follows. A front left audio signal 3044*a* and a back left audio signal 3044*b* may use fullband codecs 3094*a*, 3094*b*. In this example, a front right audio signal 3044*c* and a back right audio signal 3044*d* may use narrowband codecs 3094*c*, 3094*d*. In this example, the fullband codecs 3094*a*, 3094*b* may include those filtered bands between the certain low band frequency (LB) and the certain upper band frequency (UB) (e.g., band 1B 3076*a-b*) for the respective audio signals (e.g., front left audio signal 3044*a* and back left audio signal 3044*b*). The fullband codecs 3094*a*, 3094*b* may also average the audio signal bands containing frequencies above the certain upper band frequency (UB) (e.g., band 2A-2C 3092*a-b*) of similarly directed audio signals (e.g., front audio signals 3044*a*, 3044*c*, and back audio signals 3044*b*, 3044*d*). Similarly, the fullband codecs 3094*a*, 3094*b* may include bands below the certain low band frequency (LB) (e.g., band 1A 3046*a-b*).

Further, in this example, the narrowband codecs 3094*c*, 3094*d* may include those filtered bands containing frequencies between the certain low band frequency (LB) and the maximum of 4 kHz and the certain upper band frequency (UB) (e.g., band 1B 3076*c*, 3076*d*) for the respective audio signals (e.g., front right audio signal 3044*c*, back right audio signal 3044*d*). The narrowband codecs 3094*c*, 3094*d* may also include bands below the certain low band frequency (LB) for the respective audio signals (e.g., front right audio signal 3044*c*, back right audio signal 3044*d*). In this example, if the certain upper band frequency (UB) is less than 4 kHz, the original audio signal captured at the nearest microphone to the desired corner location 3044*a-d* may be encoded.

As described above, while FIG. 30A depicts two fullband codecs 3094*a*, 3094*b* and two narrowband codecs 3094*c*, 3094*d*, any combination of codecs could be used. For example, two superwideband codecs could replace the two fullband codecs 3094*a*, 3094*b*.

Figure 30B:
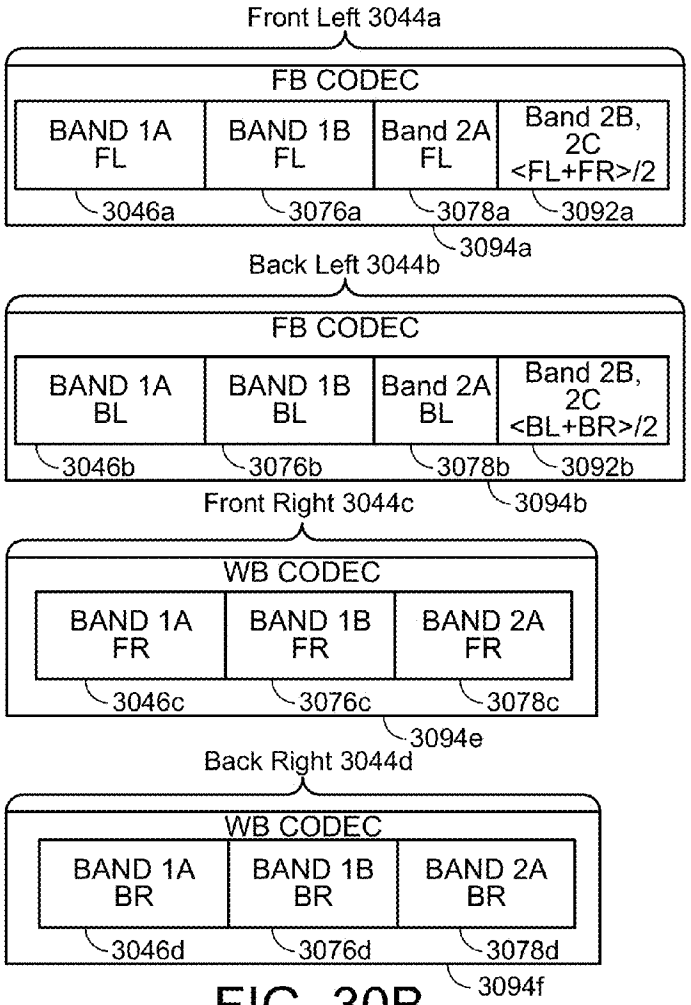
FIG. 30B illustrates a possible scheme for a second configuration where one or more codecs have averaged audio signals.

FIG. 30B illustrates a possible scheme for a second configuration where one or more codecs 3094*a-b, e-f* have averaged audio signals. In this example, a front left audio signal 3044*a* and a back left audio signal 3044*b* may use fullband codecs 3094*a*, 3094*b*. In this example, a front right audio signal 3044*c* and a back right audio signal 3044*d* may use wideband codecs 3094*e*, 3094*f*. In this configuration, the fullband codecs 3094*a*, 3094*b* may average one or more audio signals 3044*a-d* for a portion of the frequency range above an upper boundary. For example, the fullband codecs 2094*a*, 2094*b* may average one or more audio signals 3044*a-d* for a portion of the frequency range (e.g., band 2B, 2C 3092*a*, 3092*b*) of the front right audio signal 3044*c* and the back right audio signal 3044*d*. Audio signals 3044*a-d* originating from the same general direction may be averaged together. For example, a front left audio signal 3044*a* and a front right audio signal 3044*c* may be averaged together, and a back left audio signal 3044*b* and a back right audio signal 3044*d* may be averaged together.

In this example, the fullband codecs 3094*a*, 3094*b* may include bands 1A 3046*a-b*, band 1B 3076*a-b*, band 2A 3078*a-b*, and an averaged band 2B, 2C 3092*a-b*. The wideband codecs 3094*e*, 3094*f* may include those filtered bands containing frequencies between the certain low band frequency (LB) and the certain upper band frequency (UB) (e.g., band 1B 3076*c-d*) for the respective audio signals (e.g., front right audio signal 3044*c* and back right audio signal 3044*d*). The wideband codecs 3094*e*, 3094*f* may also include the original audio signal captured at the nearest microphone signal for band 2A 3078*c-d*. By encoding the nearest microphone signal, the directionality may still be encoded by intrinsic time and level differences among the microphone channels (although not as dramatic as spatial processing of frequencies between the certain lower band frequency (LB) and the certain upper band frequency (UB). The wideband codecs 3094*e*, 3094*f* may also include bands below the certain low band frequency (LB) (e.g., band 1A 3046*c-d*) for the respective audio signals (e.g., front right audio signal 3044*c* and back right audio signal 3044*d*).

Figure 31A:
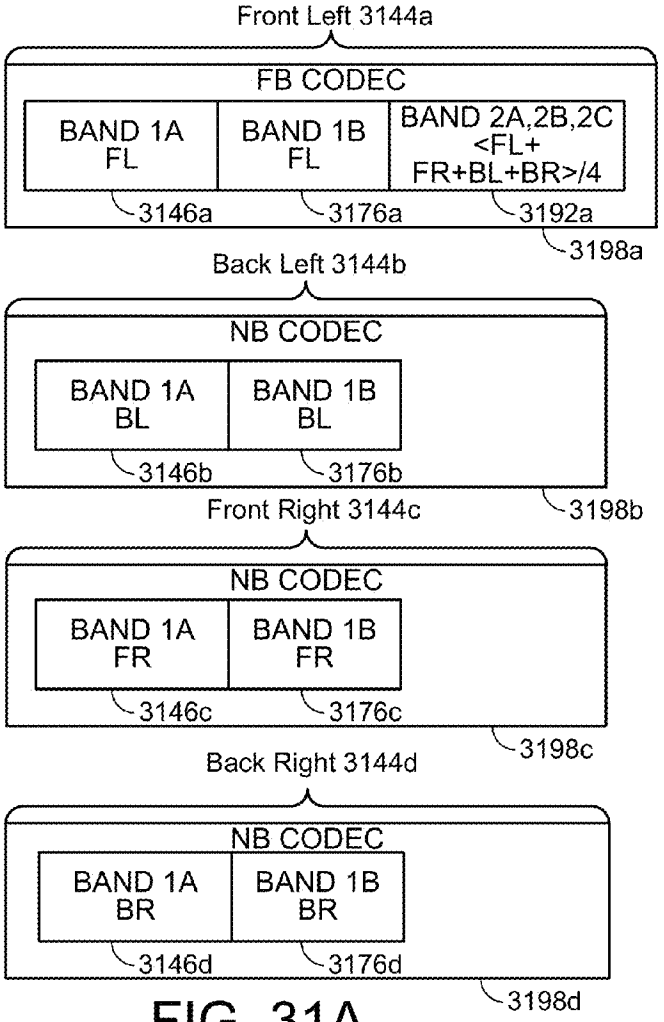
FIG. 31A illustrates a possible scheme for a third configuration, where one or more of the codecs may average one or more audio signals.

FIG. 31A illustrates a possible scheme for a third configuration where one or more of the codecs may average one or more audio signals. An example of averaging in this configuration is given as follows. A front left audio signal 3144*a* may use a fullband codec 3198*a*. A back left audio signal 3144*b*, a front right audio signal 3144*c* and a back right audio signal 3144*d* may use narrowband codecs 3198*b*, 3198*c* 3198*d*.

In this example, the fullband codec 3198*a* may include those filtered bands containing frequencies between the certain low band frequency (LB) and the certain upper band frequency (UB) (band 1B 3176*a*) for the audio signal 3144*a*. The fullband codec 3198*a* may also average the audio signal bands containing frequencies above the certain upper band frequency (UB) (e.g., band 2A-2C 3192*a*) of the audio signals 3144*a-d*. Similarly, the fullband codec 3198*a* may include bands below the certain low band frequency (LB) (e.g., band 1A 3146*a*).

The narrowband codecs 3198*b-d* may include those filtered bands including frequencies between the certain low band frequency (LB) and the maximum of 4 kHz and the certain upper band frequency (UB) (e.g., band 1B 3176*b-d*) for the respective audio signals (e.g., 3144*b-d*). The narrowband codecs 3198*b-d* may also include bands containing frequencies below the certain low band frequency (LB) (e.g., band 1A 3146*b-d*) for the respective audio signals (e.g., 3144*b-d*).

Figure 31B:
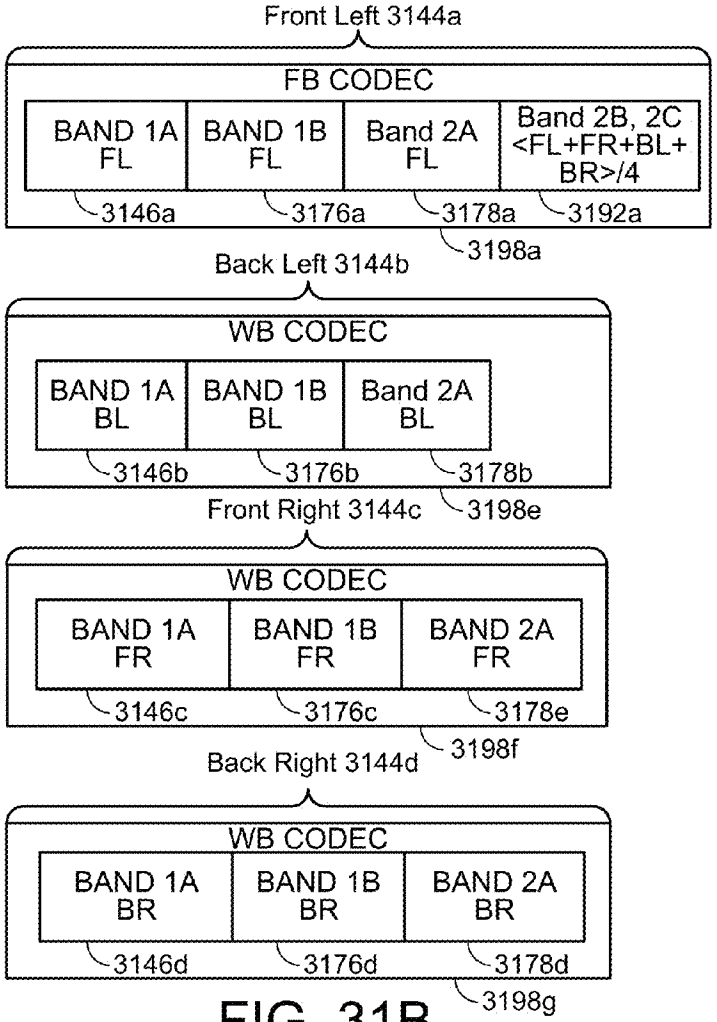
FIG. 31B illustrates a possible scheme for a third configuration where one or more of the non-narrowband codecs have averaged audio signals.

FIG. 31B illustrates a possible scheme for a third configuration where one or more of the non-narrowband codecs have averaged audio signals. In this example, a front left audio signal 3144*a* may use a fullband codec 3198*a*. A back left audio signal 3144*b*, a front right audio signal 3144*c* and a back right audio signal 3144*d* may use wideband codecs 3194*e*, 3194*f* and 3194*g*. In this configuration, the fullband codec 3198*a* may average one or more audio signals 3144*a-d* for a portion of the frequency range (e.g., band 2B-2C 3192*a*, 3192*b*) of the audio signals 3144*a-d*.

In this example, the fullband codec 3198*a* may include band 1A 3146*a*, band 1B 3176*a*, band 2A 3178*a* and band 2B-2C 3192*a*. The wideband codecs 3198*e-g* may include those filtered bands including frequencies between the certain low band frequency (LB) and the certain upper band frequency (UB) (e.g., band 1B 3176*b-d*) for the respective audio signals (e.g., 3144*b-d*). The wideband codecs 3198*e-g* may also include the original audio signal captured at the nearest microphone to the desired corner location for frequencies above the certain upper band frequency (UB) (e.g., band 2A 3178*b-d*). The wideband codecs 3198*e-g* may also include bands containing frequencies below the certain low band frequency (LB) (e.g., band 1A 3146*b-d*) for the respective audio signals (e.g., 3144*b-d*).

Figure 32:
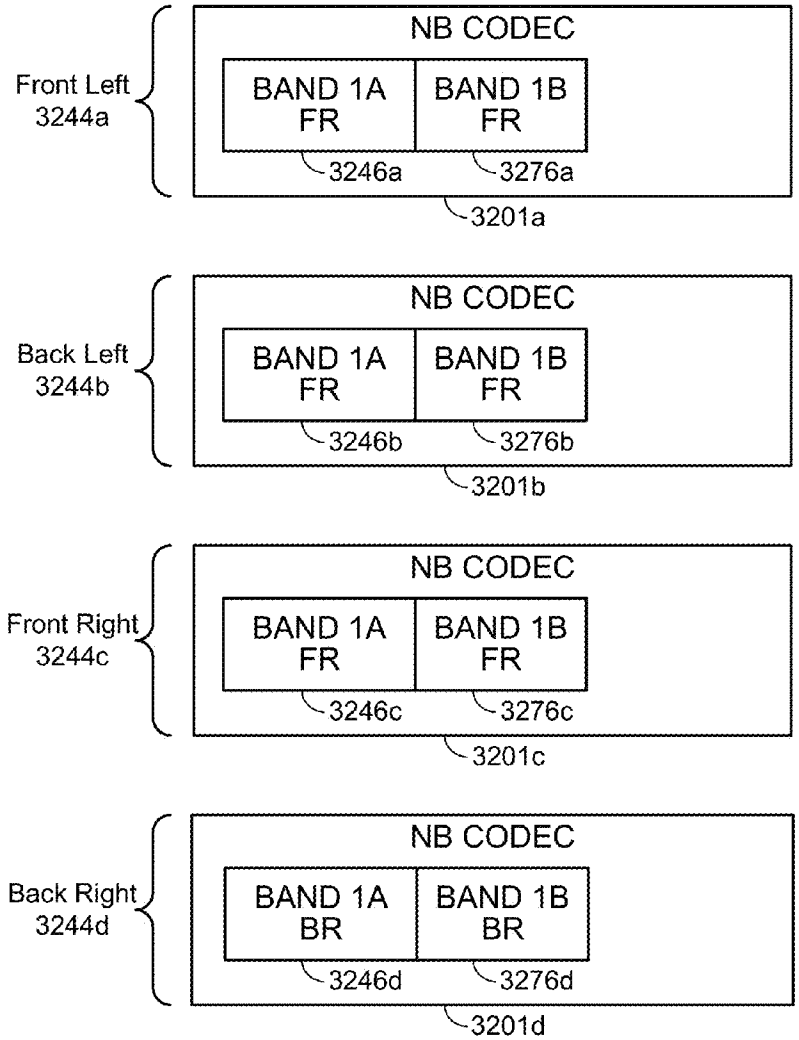
FIG. 32 illustrates four narrowband codecs.

FIG. 32 illustrates four narrowband codecs 3201*a-d*. In this example, those bands containing frequencies between the certain low band frequency (LB) and the maximum of 4 kHz and the certain upper band frequency (UB) may be filtered for each audio signal 3244*a-d*. If the certain upper band frequency (UB) is less than 4 kHz the original audio signal from the nearest microphone may be encoded for the frequency range greater than the certain upper band frequency (UB) up to 4 kHz. In this example, four channels may be generated, corresponding to each audio signal 3244*a-d*. Each channel may include the filtered bands (e.g., including at least a portion of band 1B 3276*a-d*) for that audio signal 3244*a-d*. The narrowband codecs 3201*a-d* may also include bands containing frequencies below the certain low band frequency (LB) (e.g., band 1A 3246*a-d*) for the respective audio signals (e.g., 3244*a-d*).

Figure 33:
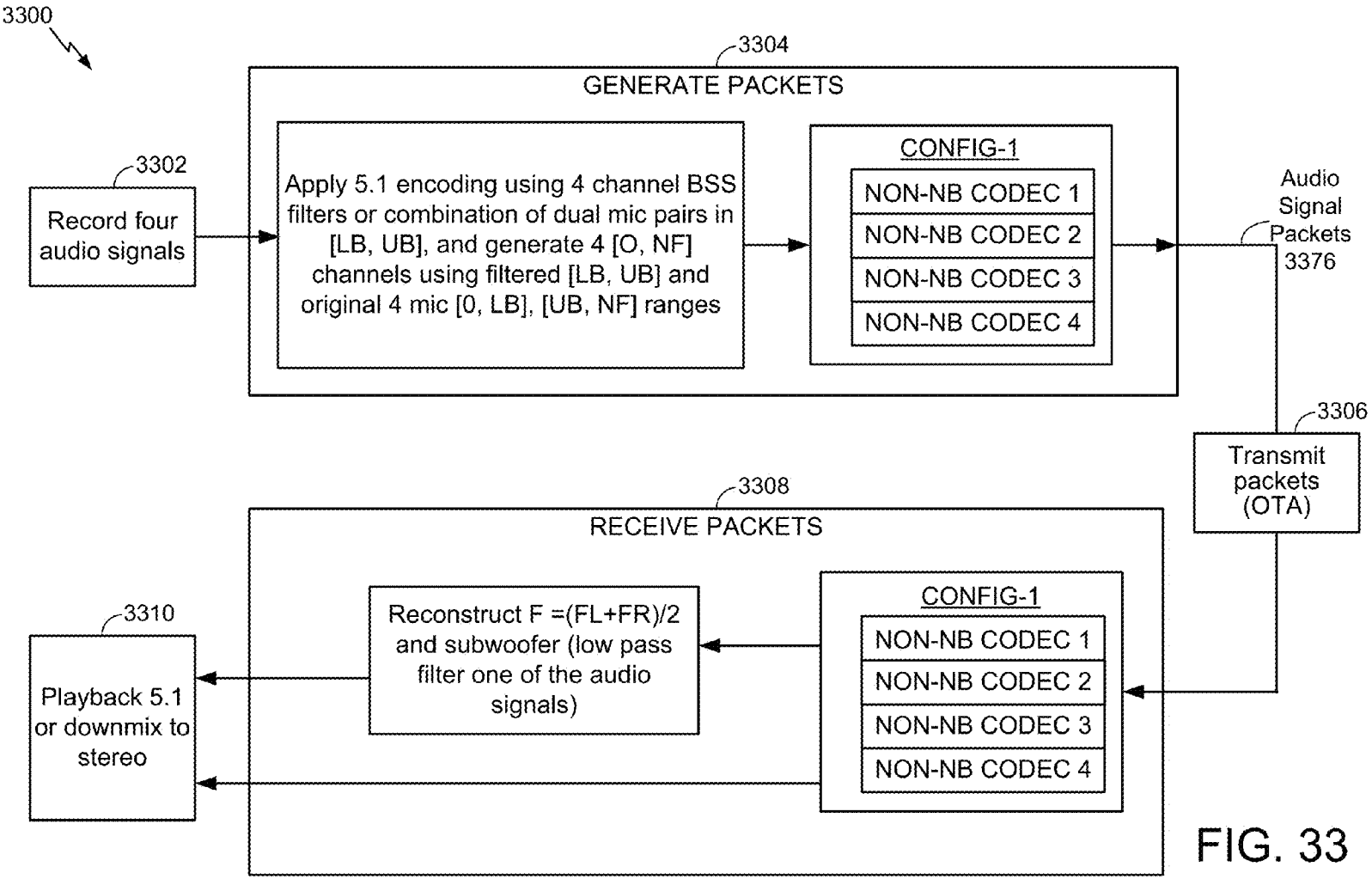
FIG. 33 is a flowchart illustrating an end-to-end system of an encoder/decoder system using four non-narrowband codecs of any scheme of FIG. 29A, FIG. 29B or FIG. 29C.

FIG. 33 is a flowchart illustrating a method 3300 for generating and receiving audio signal packets 3376 using four non-narrowband codecs of any scheme of FIG. 29A, FIG. 29B or FIG. 29C. The method 3300 may include recording 3302 four audio signals 2944*a-d*. In this configuration, four audio signals 2944*a-d* may be recorded or captured by a microphone array. As an example, the arrays 2630, 2730 illustrated in FIGS. 26 and 27 may be used. The recorded audio signals 2944*a-d* may correspond to directions from which the audio is received. For example, a wireless communication device 102 may record four audio signals coming from four directions (e.g., front left 2944*a*, back left 2944*b*, front right 2944*c* and back right 2944*d*).

The wireless communication device 102 may then generate 3304 the audio signal packets 3376. In some implementations, generating 3304 the audio signal packets 3376 may include generating one or more audio channels. For example, given the codec configuration of FIG. 29A, the bands of an audio signal that fall within a certain low band frequency (LB) and a certain upper band frequency (UB) (e.g., [LB, UB]) may be filtered. In some implementations, filtering these bands may include applying a blind source separation (BSS) filter. In other implementations, one or more of the audio signals 2944*a-d* falling within the low band frequency (LB) and the upper band frequency (UB) may be combined in pairs. For bands that are greater than the upper band frequency (UB) up to the Nyquist Frequency and for bands that are less than the low band frequency (LB), the original audio signal 2944*a-d* may be combined with the filtered audio signal into an audio channel. In other words, an audio channel (corresponding to an audio signal 2944*a-d*) may include the filtered bands between the certain low band frequency (LB) and the certain upper band frequency (UB) (e.g., band 1B 2976*a-d*) as well as the original bands above the certain upper band frequency (UB) up to the Nyquist Frequency (e.g., 2A-2C 2984*a-d*) and the original bands below the low band frequency (LB) (e.g., band 1A 2946*a-d*).

Generating 3304 the audio signal packets 3376 may also include applying one or more non-narrowband codecs to the audio channels. According to some configurations, the wireless communication device 102 may use one or more of the first configuration of codecs as depicted in FIGS. 29A-C to encode the audio channels. For example, given the codecs depicted in FIG. 29A, the wireless communication device 102 may encode the four audio channels using fullband codecs 2948*a-d* for each audio channel. Alternatively, the non-narrowband codecs in FIG. 33 may be superwideband codecs 2988*a-d*, as illustrated in FIG. 29B or wideband codecs 2990*a-d*, as illustrated in FIG. 29C. Any combination of codecs may be used.

With the audio signal packets 3376 generated, the wireless communication device 102 may transmit 3306 the audio signal packets 3376 to a decoder. The decoder may be included in audio output device, such as a wireless communication device 102. In some implementations, the audio signal packets 3376 may be transmitted over-the-air.

The decoder may receive 3308 the audio signal packets 3376. In some implementations, receiving 3308 the audio signal packets 3376 may include decoding the received audio signal packets 3376. The decoder may do so according to the first configuration. Drawing from the above example, the decoder may decode the audio channels using a fullband codec for each audio channel. Alternatively, the decoder may use superwideband codecs 2988*a-d* or wideband codecs 2990*a-d*, depending on how the transmission packets 3376 were generated.

In some configurations, receiving 3308 the audio signal packets 3376 may include reconstructing a front center channel. For example, a receiving audio output device may combine the front left audio channel and the front right audio channel to generate a front center audio channel.

Receiving 3308 the audio signal packets 3376 may also include reconstructing a subwoofer channel. This may include passing one or more of the audio signals 2944*a-d* through a low pass filter.

The received audio signal may then be played 3310 back on an audio output device. In some cases this may include playing the audio signal back in a surround sound format. In other cases, the audio signal may be downmixed and played back in a stereo format.

Figure 34:
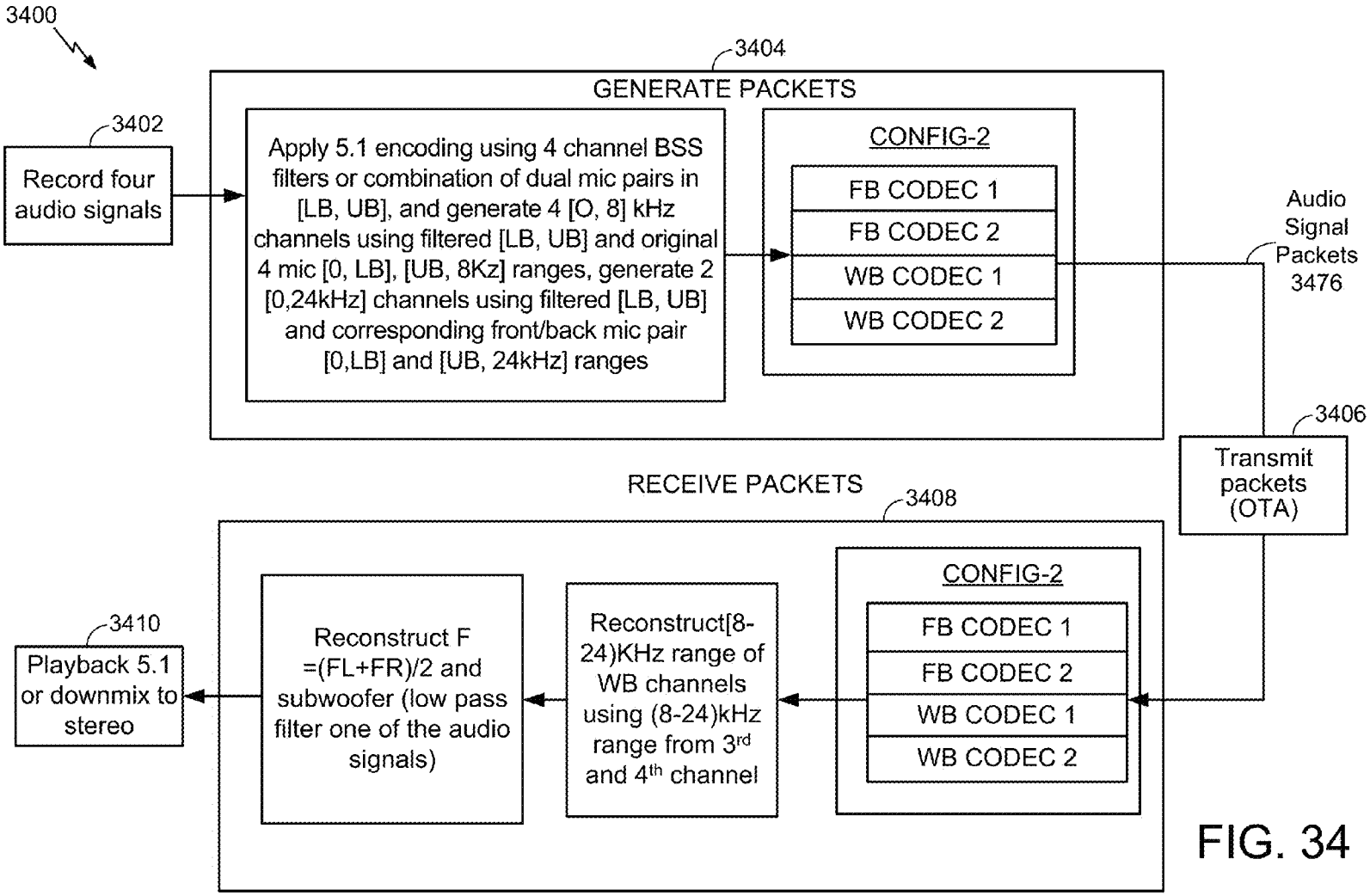
FIG. 34 is a flowchart illustrating an end-to-end system of an encoder/decoder system using four codecs (e.g., from either FIG. 30A or FIG. 30B)

FIG. 34 is a flowchart illustrating another method 3400 for generating and receiving audio signal packets 3476 using four codecs (e.g., from either FIG. 30A or FIG. 30B). The method 3400 may include recording 3402 one or more audio signals 3044*a-d*. In some implementations, this may be done as described in connection with FIG. 33. The wireless communication device 102 may then generate 3404 the audio signal packets 3476. In some implementations, generating 3404 the audio signal packets 3476 may include generating one or more audio channels. For example, the bands of an audio signal 3044*a-d* that fall within a certain low band frequency (LB) and a certain upper band frequency (UB) (e.g., [LB, UB]) may be filtered. In some implementations, this may be done as described in FIG. 33.

In some implementations, four low band channels (e.g., corresponding to the four audio signals 3044*a-d* illustrated in FIG. 30A or 30B) may be generated. The low band channels may include frequencies between [0, 8] kHz of the audio signals 3044*a-d*. These four low band channels may include the filtered signal between the certain low band frequency (LB) and the certain upper band frequency (UB) (e.g., band 1B 3076*a-d*) as well as the original audio signal greater than the certain upper band frequency (UB) up to 8 kHz and the original audio signal below the low band frequency (LB) (e.g., band 1A 3046*a-d*) of the four audio signals 3044*a-d*. Similarly, two high band channels, corresponding to the averaged front/back audio signals, may be generated. The high band channels may include frequencies from zero up to twenty four kHz. The high band channels may include the filtered signal between the certain low band frequency (LB) and the certain upper band frequency (UB) (e.g., band 1B 3076*a-d*) for the audio signals 3044*a-d* as well as the original audio signal greater than the certain upper band frequency (UB) up to 8 kHz and the original audio signal below the low band frequency (LB) (e.g., band 1A 3046*a-d* of the four audio signals 3044*a-d*). The high band channels may also include the averaged audio signal above 8 kHz up to 24 kHz.

Generating 3404 the audio signal packets 3476 may also include applying one or more codecs 3094*a-f* to the audio channels. According to some configurations, the wireless communication device 102 may use one or more of the second configuration of codecs 3094*a-f* as depicted in FIGS. 30A and 30B to encode the audio channels.

For example, given the codecs as depicted in FIG. 30B, the wireless communication device 102 may encode the front left audio signal 3044*a* and the back left audio signal 3044*b* using fullband codecs 3094*a*, 3094*b* respectively and may encode the front right audio signal 3044*c* and the back right audio signal 3044*d* using wideband codecs 3094*c*, 3094*d* respectively. In other words, four audio signal packets 3476 may be generated. For the packets 3476 corresponding to the audio signals 3044*a-d* using fullband codecs 3094*a*, 3094*b* (e.g., front left audio signal 3044*a* and back left audio signal 3044*b*), the packets 3476 may include the low band channels (e.g., [0, 8] kHz) of that audio signal 3044*a-d* (e.g., audio signals 3044*a*, 3044*b*) and the high band channels up to 24 kHz (e.g., the largest frequency allowed by fullband codecs 3094*a*, 3094*b*) of the averaged audio signals 3044*a-d* in that general direction (e.g., front audio signals 3044*a*, 3044*c*, and back audio signals 3044*b*, 3044*d*). For the audio signal packets 3476 corresponding to the audio signals 3044*a-d* using wideband codecs 3094*e-f* (e.g., front right audio signal 3044*c* and back right audio signal 3044*d*), the audio signal packet 3476 may include the low band channels (e.g., [0, 8] kHz) of that audio signal 3044*a-d* (e.g., audio signals 3044*c*, 3044*d*).

With the audio signal information generated, the wireless communication device 102 may transmit 3406 the audio signal information. In some implementations, this may be done as described in connection with FIG. 33.

The decoder may receive 3408 the audio signal information. In some implementations, receiving 3408 the audio signal information may include decoding the received audio signal information. In some implementations this may be done as described in connection with FIG. 33. Given the codec scheme of FIG. 30B, the decoder may decode the front left audio signal 3044*a* and the back left audio signal 3044*b* using a fullband codec 3094*a*, 3094*b* and may decode the front right audio signal 3044*b* and the back right audio signal 3044*d* using a wideband codec 3094*e*, 3094*f*. The audio output device may also reconstruct the [8, 24] kHz range of the wideband audio channels using a portion of the averaged high band channels (e.g., the [8, 24] kHz portion) as contained in the fullband audio channels, (e.g., using the averaged high band channel of the front left audio signal for the front right audio channel and using the averaged high band channel of the back left audio signal for the back right audio channel).

In some configurations, receiving 3408 the audio signal information may include reconstructing a front center channel. In some implementations this may be done as described in connection with FIG. 33.

Receiving 3408 the audio signal information may also include reconstructing a subwoofer signal. In some implementations, this may be done as described in connection with FIG. 33.

The received audio signal may then be played 3410 back on an audio output device. In some implementations, this may be done as described in connection with FIG. 33.

Figure 35:
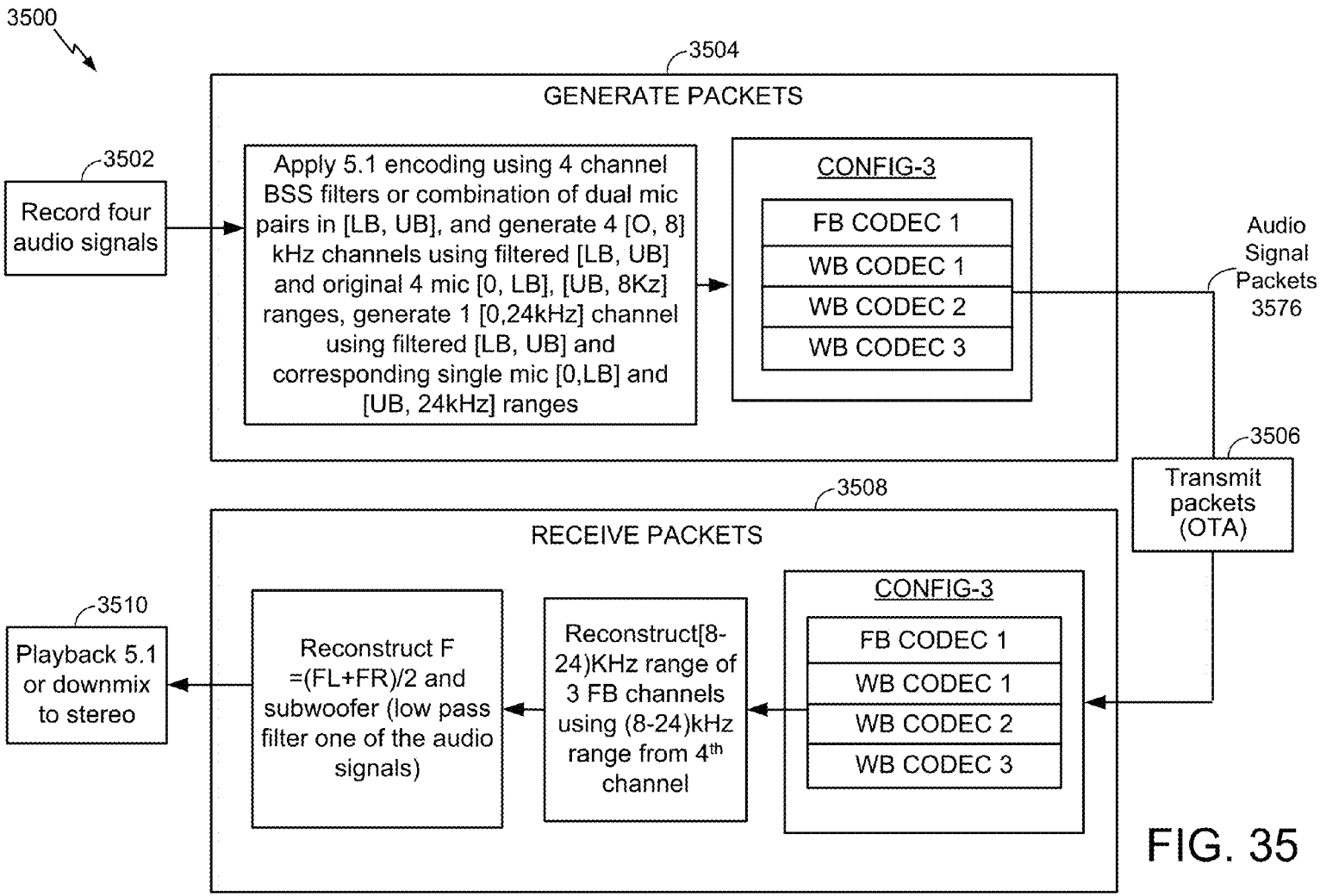
FIG. 35 is a flowchart illustrating an end-to-end system of an encoder/decoder system using four codecs (e.g., from either FIG. 31A or FIG. 31B)

FIG. 35 is a flowchart illustrating another method 3500 for generating and receiving audio signal packets 3576 using four codecs (e.g., from either FIG. 31A or FIG. 31B). The method 3500 may include recording 3502 one or more audio signals 3144*a-d*. In some implementations, this may be done as described in connection with FIG. 33

The wireless communication device 102 may then generate 3504 the audio signal packets 3576. In some implementations, generating 3504 the audio signal packets 3576 may include generating one or more audio channels. For example, the bands of an audio signal 3144 that fall within a certain low band frequency (LB) and a certain upper band frequency (UB) (e.g., band 1B 3176*a-d*) may be filtered. In some implementations, this may be done as described in FIG. 33.

In some implementations, four low band channels, corresponding to the four audio signals 3144, may be generated. In some implementations, this may be done as described in FIG. 34. Similarly, a high band channel, corresponding to the averaged audio signals (e.g., front left audio signal 3144*a*, back left audio signal 3144*b*, front right audio signal 3144*c* and back right audio signal 3144*d*), may be generated. In some implementations, this may be done as described in FIG. 34.

Generating 3504 the audio signal packets 3576 may also include applying one or more codecs 3198*a-g* to the audio channels. According to some configurations, the wireless communication device 102 may use one or more of the third configuration of codecs 3198*a-g* as depicted in FIGS. 31A and 31B to encode the audio channels. For example, given the codecs as depicted in FIG. 31B, the wireless communication device 102 may encode the front left audio signal 3144*a* using a fullband codec 3198*a* and may encode the back left audio signal 3144*b*, the front right audio signal 3144*c* and the back right audio signal 3144*d* using wideband codec 3198*e*, wideband codec 3198*f* and wideband codec 3198*g* respectively. In other words, four audio signal packets 3576 may be generated.

For the packet 3576 corresponding to the audio signal 3144*a* using a fullband codec 3198*a*, the packet 3576 may include the low band channels of that audio signal 3144*a* and the high band channel up to twenty four kHz (e.g., the maximum frequency allowed by a fullband codec 3198*a*) of the averaged audio signals 3144*a-d*. For the audio signal packets 3576 corresponding to the audio signals 3144*a-d* using wideband codecs 3198*e-g* (e.g., audio signals 3144*b-d*), the audio signal packet 3576 may include the low band channels of that audio signal 3144*a-d* (e.g., audio signals 3144*b-d*) and the original audio signal greater than the certain upper band frequency (UB) up to 8 kHz.

With the audio signal information generated, the wireless communication device 102 may transmit 3506 the audio signal information. In some implementations, this may be done as described in connection with FIG. 33.

The decoder may receive 3508 the audio signal information. In some implementations, receiving 3508 the audio signal information may include decoding the received audio signal information. In some implementations this may be done as described in connection with FIG. 33. The audio output device may also reconstruct the [8, 24] kHz range of the wideband audio channels using a portion of the averaged high band channels (e.g., the [8, 24] kHz portion) as contained in the fullband audio channels.

In some configurations, receiving 3508 the audio signal information may include reconstructing a front center channel. In some implementations this may be done as described in connection with FIG. 33.

Receiving 3508 the audio signal information may also include reconstructing a subwoofer signal. In some implementations, this may be done as described in connection with FIG. 33.

The received audio signal may then be played 3510 back on an audio output device. In some implementations, this may be done as described in connection with FIG. 33.

Figure 36:
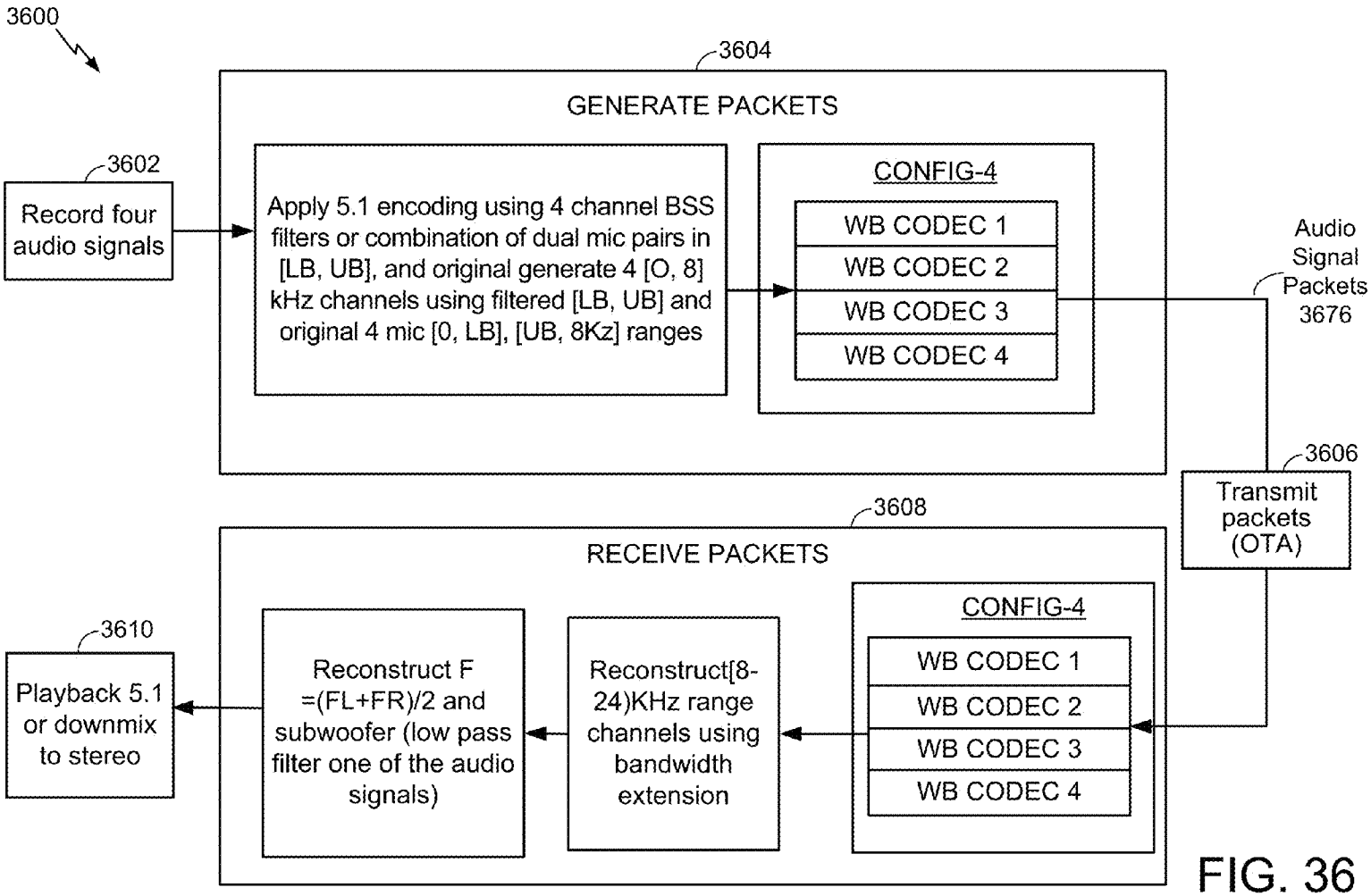
FIG. 36 is a flowchart illustrating another method for generating and receiving audio signal packets using a combination of four non-narrowband codecs (e.g., from FIG. 29A, FIG. 29B or FIG. 29C) to encode and either four wideband codecs or narrowband codecs to decode.

FIG. 36 is a flowchart illustrating another method 3600 for generating and receiving audio signal packets 3676 using a combination of four narrowband codecs (e.g., from FIG. 29A, FIG. 29B or FIG. 29C) to encode and either four wideband codecs or narrowband codecs to decode. The method 3600 may include recording 3602 one or more audio signals 2944. In some implementations, this may be done as described in connection with FIG. 33.

The wireless communication device 102 may then generate 3604 the audio signal packets 3676. Generating 3604 the audio signal packets 3676 may include generating one or more audio channels. In some implementations, this may be done as described in FIG. 33.

Generating 3604 the audio signal packets 3676 may also include applying one or more non-narrowband codecs, as depicted in FIGS. 29A-C, to the audio channels. For example, the wireless communication device 102 may use the wideband codecs 2988*a-d* depicted in FIG. 29B, to encode the audio channels.

With the audio signal packets 3676 generated, the wireless communication device 102 may transmit 3606 the audio signal packets 3676 to a decoder. In some implementations, this may be done as described in FIG. 33.

The decoder may receive 3608 the audio signal packets 3676. In some implementations, receiving 3608 the audio signal packets 3676 may include decoding the received audio signal packets 3676. The decoder may use one or more wideband codecs or one or more narrowband codecs to decode the audio signal packets 3676. The audio output device may also reconstruct the [8, 24] kHz. range of the audio channels based on the received audio signal packets 3676 using bandwidth extension of the wideband channels. In this example no transmission from the upper band frequency (UB) to the Nyquist Frequency is necessary. This range may be generated from the low band frequency to the upper band frequency (UB) range using techniques similar to spectral band replication (SBR). Bands below the low band frequency (LB) may be transmitted, for example, by averaging the microphone inputs.

In some configurations, receiving 3608 the audio signal packets 3676 may include reconstructing a front center channel. In some implementations, this may be done as described in FIG. 33.

Receiving 3608 the audio signal packets 3676 may also include reconstructing a subwoofer channel. In some implementations, this may be done as described in FIG. 33. The received audio signal may then be played 3310 back on an audio output device. In some implementations, this may be done as described in FIG. 33.

Coding bits may be assigned, or distributed, based on a specific direction. This direction may be selected by the user. For example, the direction where the user's voice is coming from may have more bits assigned to it. This may be performed by minimizing the dynamic range of other channels, as well as, decreasing the energy of the other directions. In addition, in a different configurations, the visualization of the energy distribution of the four corners of the surround sound may be generated. The user selection of which directional sound should have more bits allocated, i.e., sound better, or have a better desired sound direction may be selected based on the visualization of the energy distribution. In this configuration, one or two channels are encoded with more bits, but one or more channels are transmitted.

Figure 37:
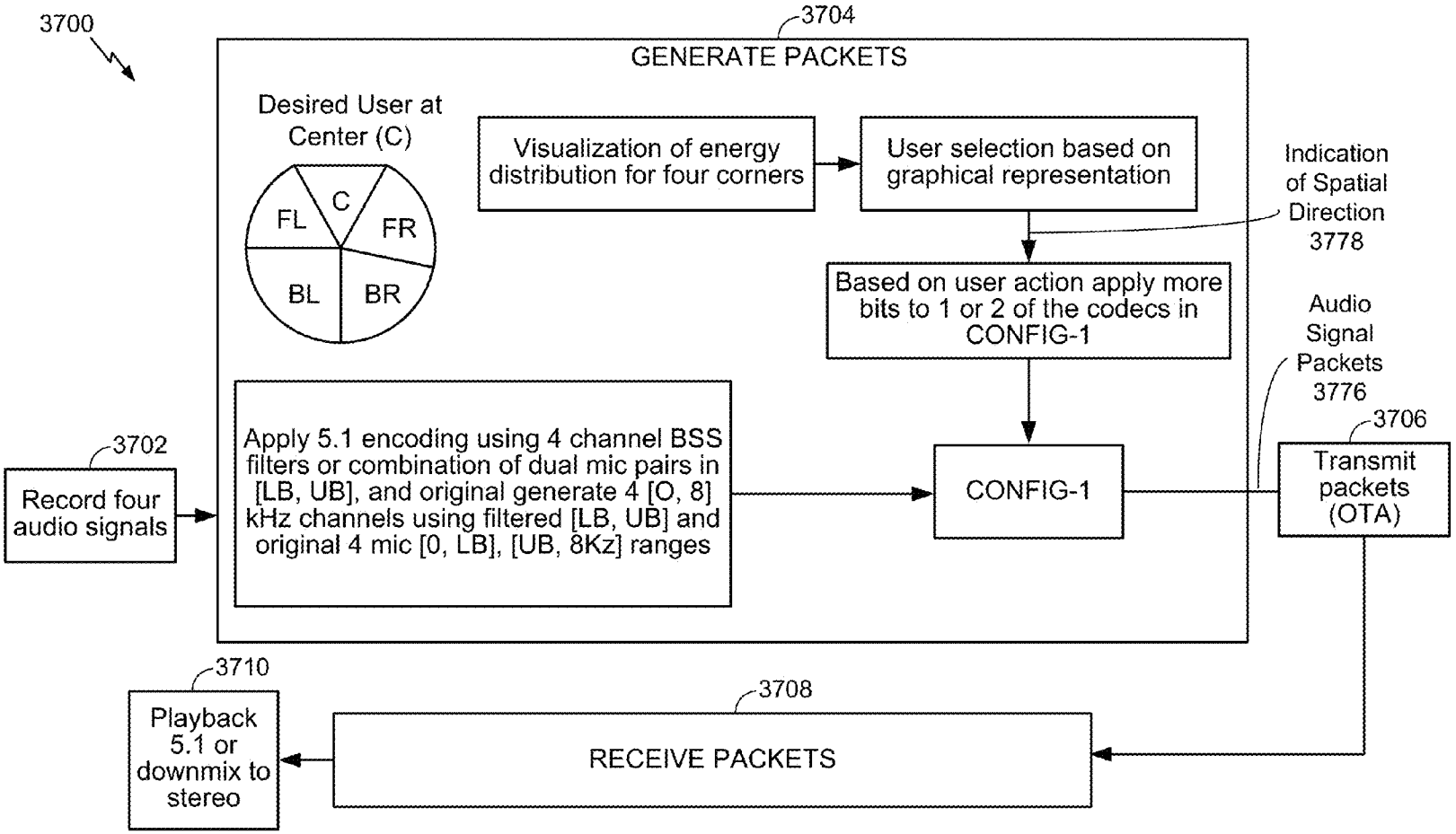
FIG. 37 is a flowchart illustrating an end-to-end system of an encoder/decoder system, where different bit allocation during compression of one or two audio signals based on a user selection associated with the visualization of energy of the four corners of sound, but four packets are transmitted in over the air channels.

FIG. 37 is a flowchart illustrating another method 3700 for generating and receiving audio signal packets 3776 where different bit allocation during encoding for one or two audio channels may be based on a user selection. In some implementations, different bit allocation during encoding for one or two audio signals may be based on a user selection associated with the visualization of the energy distribution of the four directions of a surround sound system. In this implementation, four encoded sources are transmitted over the air channels.

The method 3700 may include recording 3702 one or more audio signals 2944. In some implementations, this may be done as described in connection with FIG. 33. The wireless communication device 102 may then generate 3704 the audio signal packets 3776. Generating 3704 the audio signal packets 3776 may include generating one or more audio channels. In some implementations, this may be done as described in FIGS. 33-36.

Generating 3704 the audio signal packets 3776 may also include generating a visualization of the energy distribution of the four corners (e.g., the four audio signals 2944*a-d*). From this visualization a user may select which directional sound should have more bits allocated (e.g., where the user's voice is coming from). Based on the user selection (e.g., an indication of spatial direction 3878), the wireless communication device 102 may apply more bits to one or two of the codecs of the first configuration of codecs (e.g., the codecs depicted in FIGS. 29A-C). Generating 3704 the audio signal information may also include applying one or more non-narrowband codecs to the audio channels. In some implementations this may be done as described in FIG. 33 accounting for the user selection.

With the audio signal packets 3776 generated, the wireless communication device 102 may transmit 3706 the audio signal packets 3776 to a decoder. In some implementations, this may be done as described in connection with FIG. 33. The decoder may receive 3708 the audio signal information. In some implementations, this may be done as described in connection with FIG. 33.

The received audio signal may then be played 3710 back on an audio output device. In some implementations, this may be done as described in connection with FIG. 33. Similarly, transmission of one or two channels may be performed if the user is interested in a specific directional source (e.g. user's voice, or some other sound that the user is interested in honing in on). In this configuration, one channel is encoded and transmitted.

Figure 38:
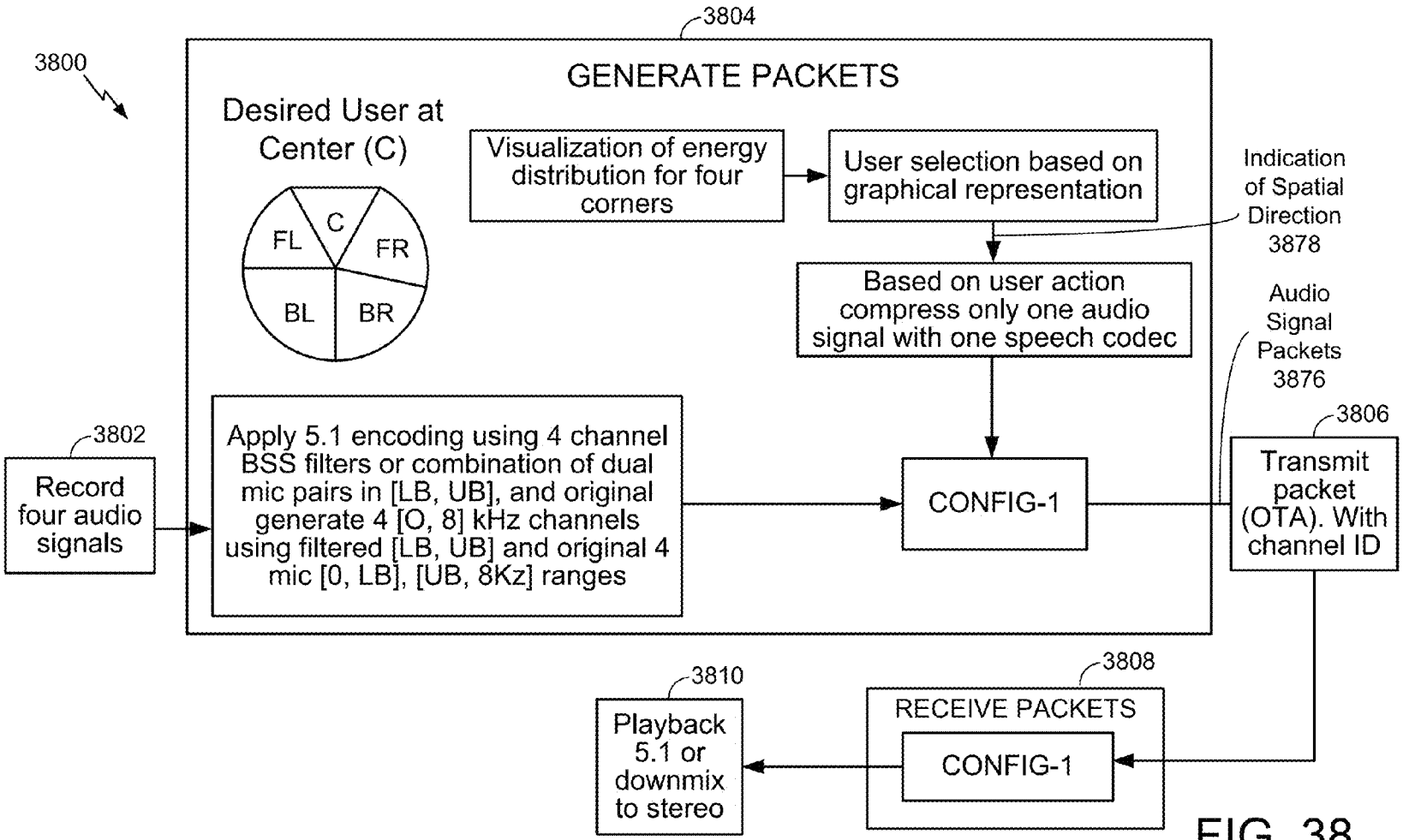
FIG. 38 is a flowchart illustrating an end-to-end system of an encoder/decoder system, where one audio signal is compressed and transmitted based on user selection associated with the visualization of energy of the four corners of sound.

FIG. 38 is a flowchart illustrating another method 3800 for generating and receiving audio signal packets 3876 where one audio signal is compressed and transmitted based on user selection. The method 3800 may include recording 3802 one or more audio signals 2944*a-d*. In some implementations, this may be done as described in connection with FIG. 33.

The wireless communication device 102 may then generate 3804 the audio signal packets 3876. Generating 3804 the audio signal packets 3876 may include generating one or more audio channels. In some implementations, this may be done as described in FIGS. 33-36. Generating 3804 the audio signal packets 3876 may also include generating a visualization of the energy distribution of the four corners (e.g., the four audio signals 2944*a-d*). From this visualization a user may select which directional sound (e.g., indication of spatial direction 3878) should be encoded and transmitted (e.g., where the user's voice is coming from). Generating 3804 the audio signal information may also include applying a non-narrowband codec (as depicted in FIGS. 29A-C) to the selected audio channel. In some implementations this may be done as described in connection with FIG. 33 accounting for the user selection.

With the audio signal information generated, the wireless communication device 102 may transmit 3806 the audio signal packet 3876 to a decoder. In some implementations, this may be done as described in connection with FIG. 33. Along with the audio signal packet 3876, the wireless communication device may transmit 3806 a channel identification.

The decoder may receive 3808 the audio signal information. In some implementations, this may be done as described in connection with FIG. 33.

The received audio signal may then be played 3810 back on an audio output device. In some implementations, the received audio signal may be played 3810 back as described in connection with FIG. 33. By encoding and decoding the user-defined channels and zeroing the other channel outputs, an enhanced yet spatialized output may be produced using multi-channel reproduction and/or a headphone rendering system.

Figure 39:
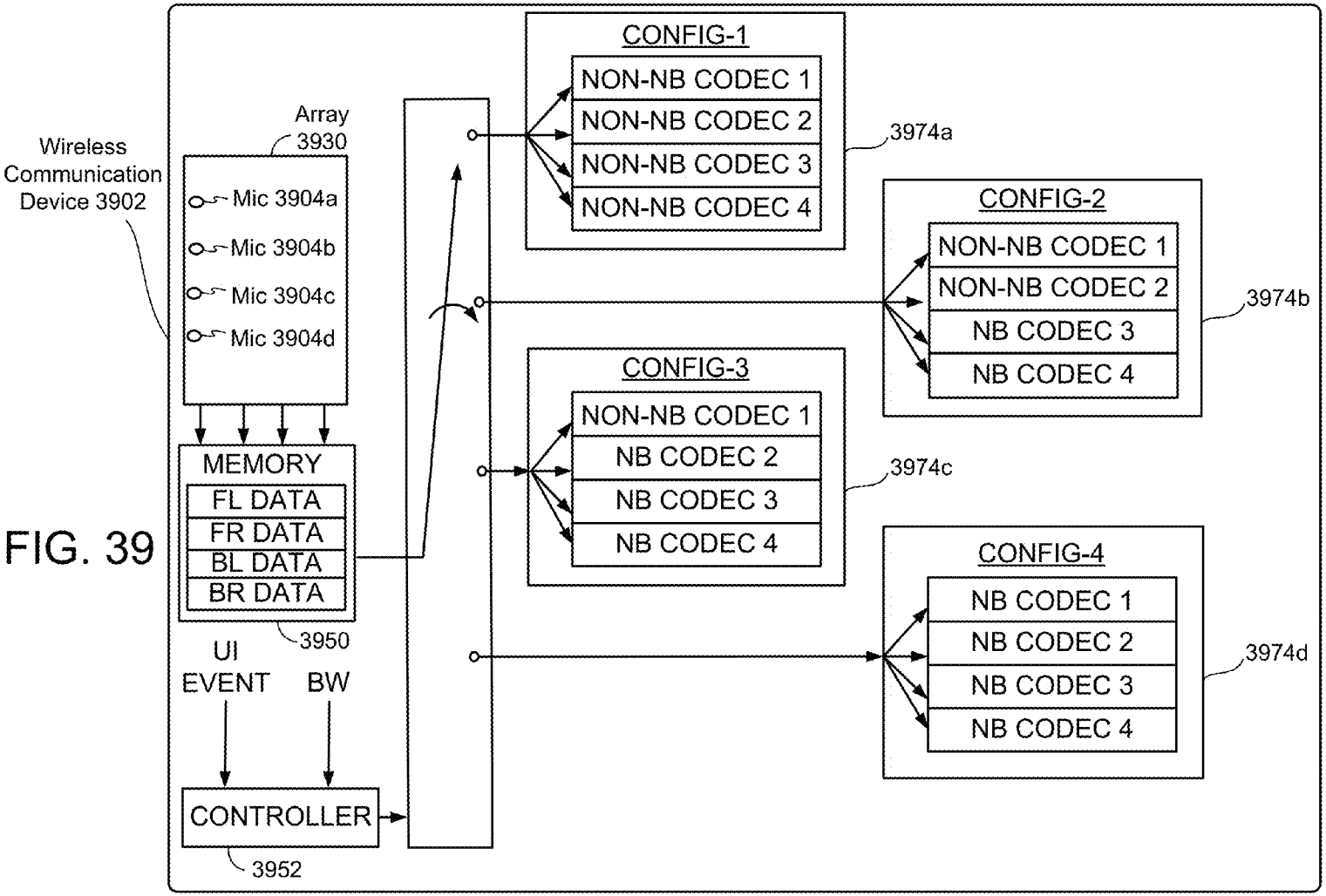
FIG. 39 is a block diagram illustrating an implementation of a wireless communication device comprising four configurations of codec combinations.

FIG. 39 is a block diagram illustrating an implementation of a wireless communication device 3902 that may be implemented in generating audio signal packets 3376 comprising four configurations of codec combinations 3974*a-d*. The communication device 3902 may include an array 3930, similar to the array 2630 described previously. The array 3930 may include one or more microphones 3904*a-d* similar to the microphones described previously. For example, the array 3930 may include four microphones 3904*a-d* that receive audio signals from four recording directions (e.g., front left, front right, back left and back right).

The wireless communication device 3902 may include memory 3950 coupled to the microphone array 3930. The memory 3950 may receive audio signals provided by the microphone array 3930. For example, the memory 3950 may include one or more data sets pertaining to the four recorded directions. In other words, the memory 3950 may include data for the front left microphone 3904*a* audio signal, the front right microphone 3904*b* audio signal, the back right microphone 3904*c* audio signal and the back left microphone 3904*d* audio signal.

The wireless communication device 3902 may also include a controller 3952 that receives processing information. For example, the controller 3952 may receive user information input into a user interface. More specifically, a user may indicate a desired recording direction. In other examples, a user may indicate one or more audio channels to allocate more processing bits to, or a user may indicate which audio channels to encode and transmit. The controller 3952 may also receive a bandwidth information. For example, the bandwidth information may indicate to the controller 3952 the bandwidth allocated (e.g., fullband, superwideband, wideband and narrowband) to the wireless communication device 3902 for transmission of the audio signal information.

Based on the information from the controller 3952, (e.g., user input and bandwidth information) and the information stored in the memory 3950, the communication device 3902 may select from one or more codec configurations 3974*a-d*, a particular configuration to apply to the audio channels. In some implementations, the codec configurations 3974*a-d* present on the wireless communication device may include the first configurations of FIGS. 29A-C, the second configurations of FIG. 30A-B, the third configurations of FIGS. 31A-B and the configuration of FIG. 32. For example, the wireless communication device 3902 may use the first configuration of FIG. 29A to encode the audio channels.

Figure 40:
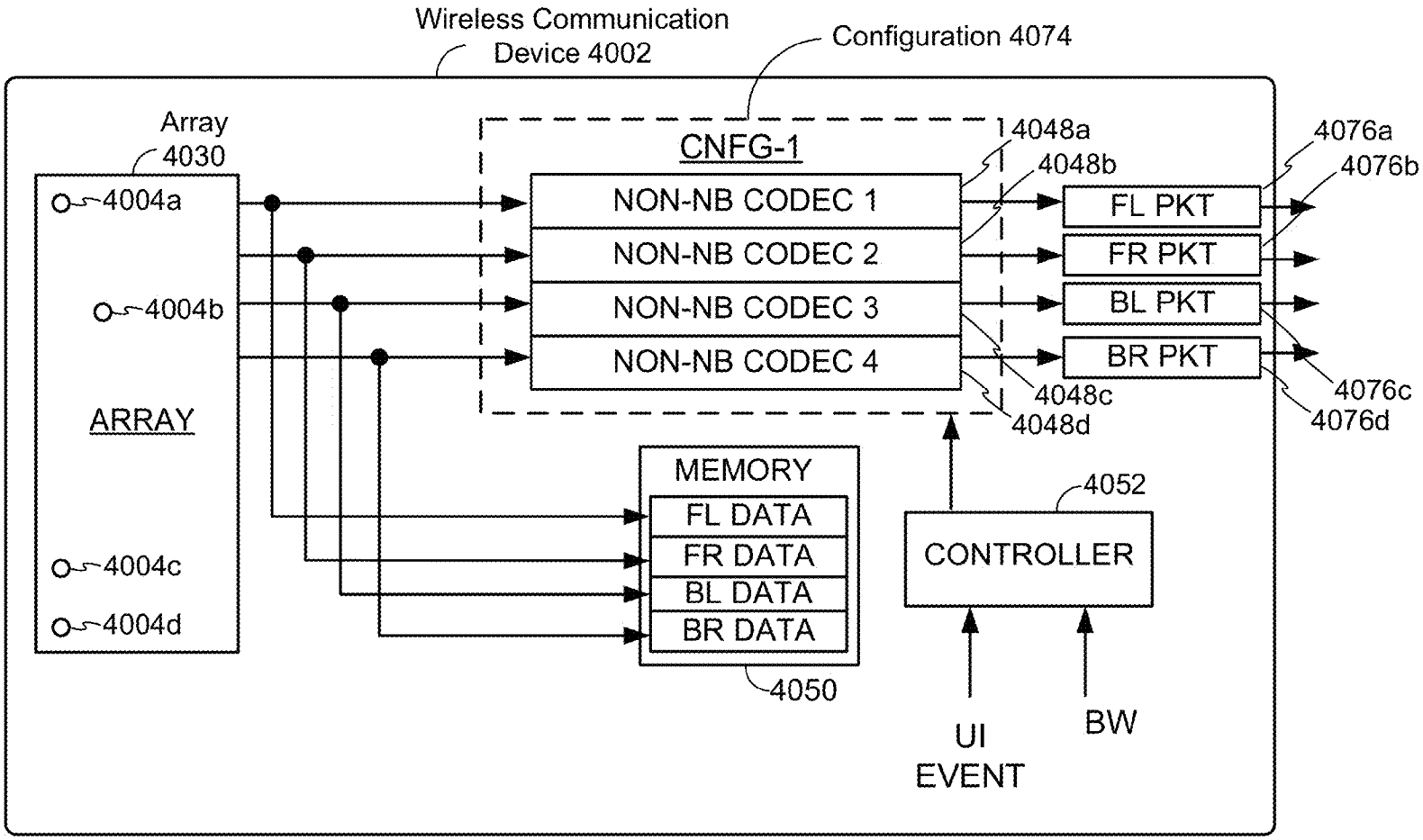
FIG. 40 is a block diagram illustrating an implementation of a wireless communication device illustrating a configuration where the 4 wideband codecs of FIG. 29 are used to compress.

FIG. 40 is a block diagram illustrating an implementation of a wireless communication device 4002 comprising a configuration 4074 of four non-narrowband codecs 4048*a-d* similar to the non-narrowband codecs of FIGS. 29A-C to compress the audio signals. The wireless communication device 4002 may include an array 4030 of microphones 4004*a-d*, memory 4050, a controller 4052, or some combination of these elements, corresponding to elements described earlier. In this implementation, the wireless communication device 4002 may include a configuration 4074 of codecs 4048*a-d* used to encode the audio signal packets 3376. For example, the wireless communication device 4002 may include and implement one or more wideband codecs 2990*a-d* as described in FIG. 29B to encode the audio signal information. Alternatively, fullband codecs 2948*a-d* or superwideband codecs 2988*a-d* may be used. The wireless communication device 4002 may transmit the audio signal packets 4076*a-d* (e.g., a FL, FR, BL and BR packet) to a decoder.

Figure 41:
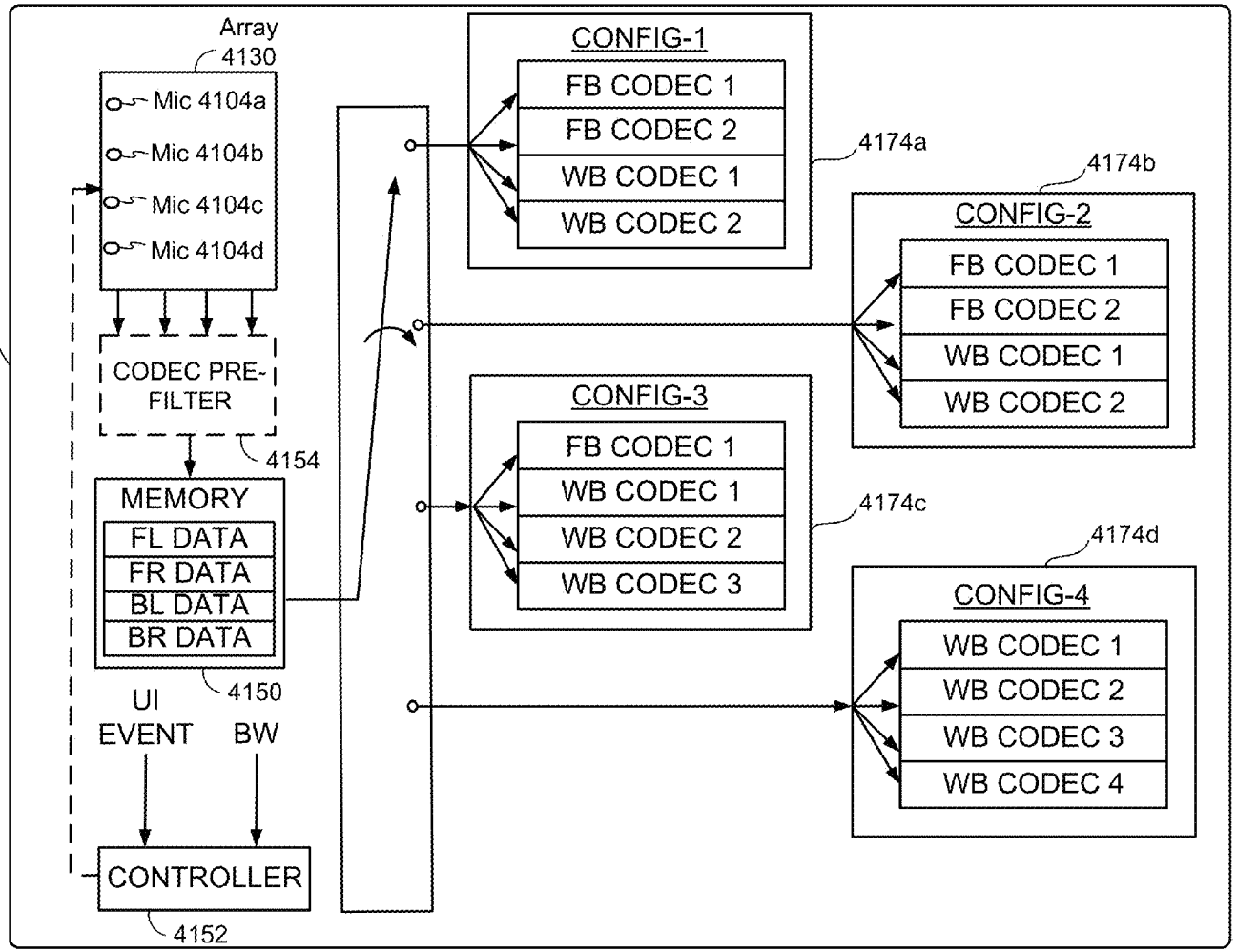
FIG. 41 is a block diagram illustrating an implementation of a communication device comprising four configurations of codec combinations, where an optional codec pre-filter may be used.

FIG. 41 is a block diagram illustrating an implementation of communication device 4102 comprising four configurations 4174*a-d* of codec combinations, where an optional codec pre-filter 4154 may be used. The wireless communication device 4102 may include an array 4130 of microphones 4104*a-d*, memory 4150, a controller 4152, or some combination of these elements, corresponding to elements described earlier. The codec pre-filter 4154 may use information from the controller 4152 to control what audio signal data is stored in the memory, and consequently, which data is encoded and transmitted.

Figure 42:
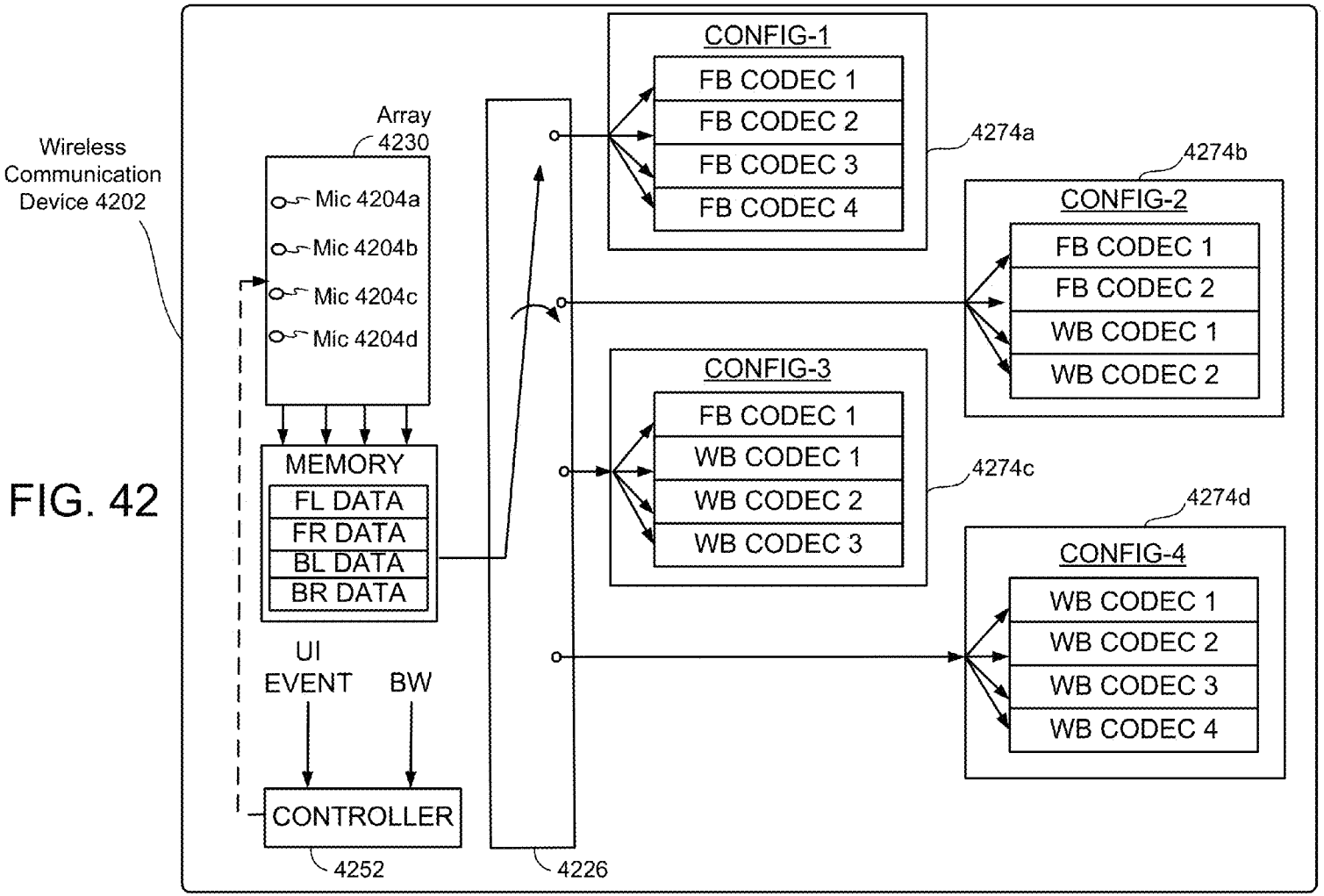
FIG. 42 is a block diagram illustrating an implementation of a communication device comprising four configurations of codec combinations, where optional filtering may take place as part of a filter bank array.

FIG. 42 is a block diagram illustrating an implementation of communication device 4202 comprising four configurations 4274*a-d* of codec combinations, where optional filtering may take place as part of a filter bank array 4226. The wireless communication device 4202 may include microphones 4204*a-d*, memory 4250, a controller 4252, or some combination of these elements, corresponding to elements described earlier. In this implementation, optional filtering may take place as part of a filter bank array 4226, where 4226 may be similar to corresponding elements described earlier.

Figure 43:
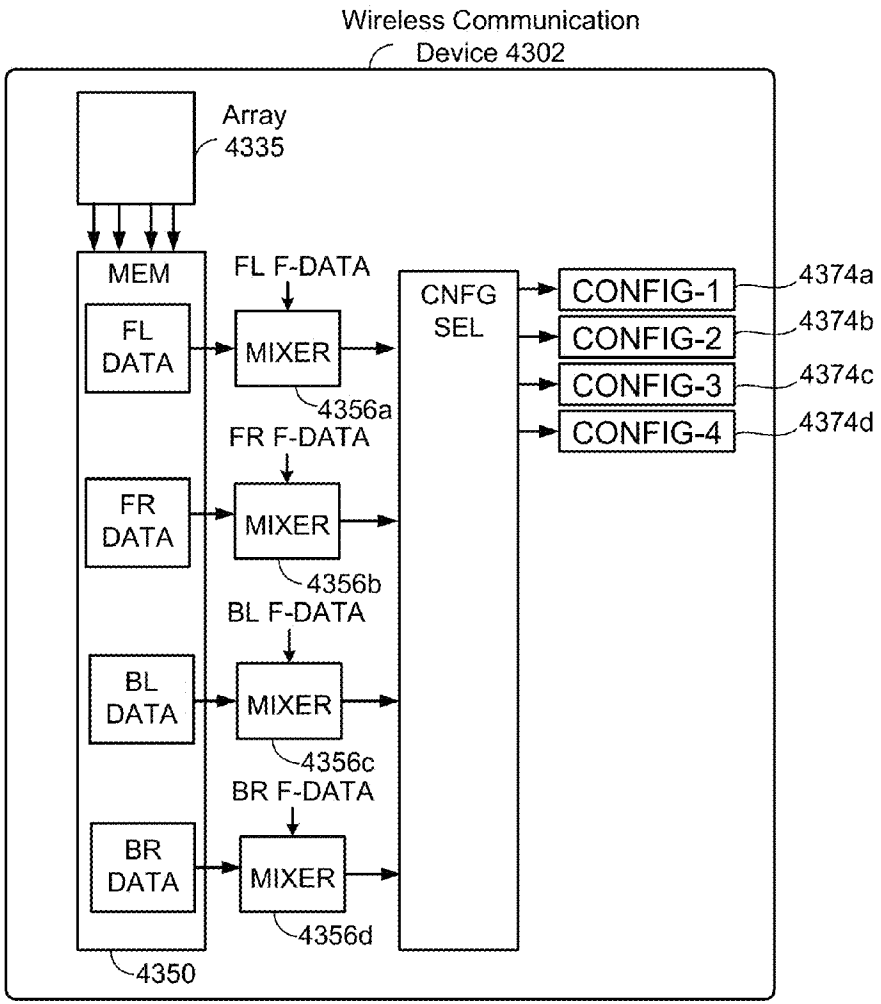
FIG. 43 is a block diagram illustrating an implementation of a communication device comprising four configurations of codec combinations, where the sound source data from an auditory scene may be mixed with data from one or more files prior to encoding with one of the codec configurations.

FIG. 43 is a block diagram illustrating an implementation of communication device 4302 comprising four configurations 4374*a-d* of codec combinations, where the sound source data from an auditory scene may be mixed with data from one or more files prior to encoding with one of the codec configurations 4374*a-d*. The wireless communication device 4302 may include an array 4330 of microphones, memory 4350 and/or a controller 4352, or some combination of these elements, corresponding to elements described earlier. In some implementations, the wireless communication device 4302 may include one or more mixers 4356*a-d*. The one or more mixers 4356*a-d* may mix the audio signals with data from one or more files prior to encoding with one of the codec configurations.

Figure 44:
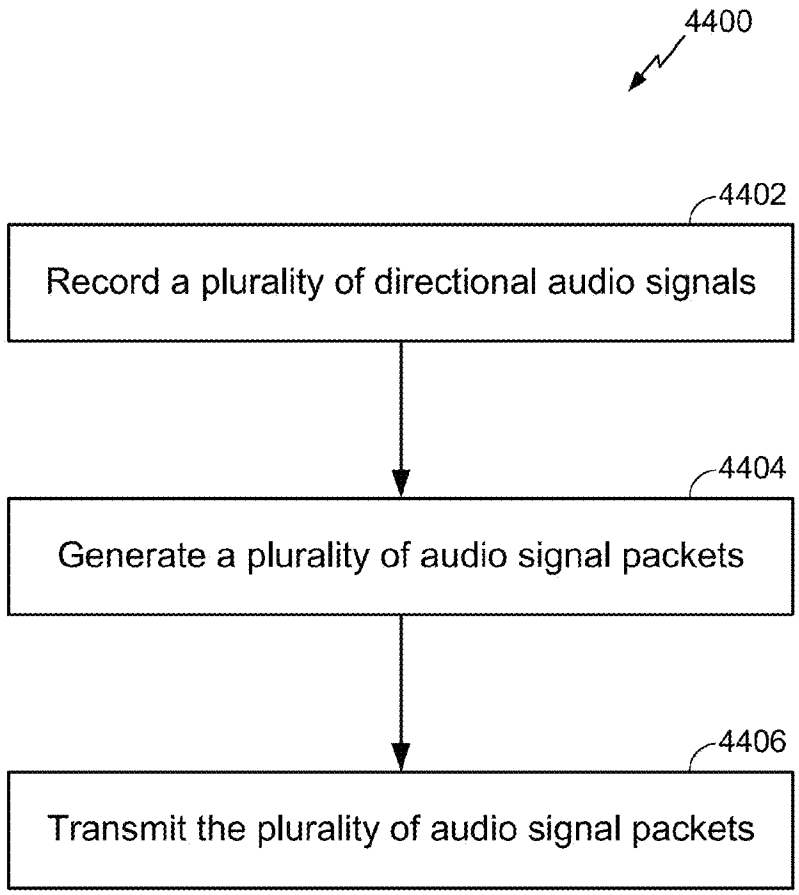
FIG. 44 is a flowchart illustrating a method for encoding multiple directional audio signals using an integrated codec.

FIG. 44 is a flowchart illustrating a method 4400 for encoding multiple directional audio signals using an integrated codec. The method 4400 may be performed by a wireless communication device 102. The wireless communication device 102 may record 4402 a plurality of directional audio signals. The plurality of directional audio signals may be recorded by a plurality of microphones. For example, a plurality of microphones located on a wireless communication device 102 may record directional audio signals from a front left direction, a back left direction, a front right direction, a back right direction, or some combination. In some cases, the wireless communication device 102 records 4402 the plurality of directional audio signals based on user input, for example via a user interface 312.

The wireless communication device 102 may generate 4404 a plurality of audio signal packets 3376. In some configurations, the audio signal packets 3376 may be based on the plurality of audio signals. The plurality of audio signal packets 3376 may include an averaged signal. As described above generating 4404 a plurality of audio signal packets 3376 may include generating a plurality of audio channels. For example, a portion of the plurality of directional audio signals may be compressed and transmitted as a plurality of audio channels over the air. In some cases, the number of directional audio signals that are compressed may not equal the number of audio channels that are transmitted. For example, if four directional audio signals are compressed, the number of audio channels that are transmitted may equal three. The audio channels may correspond to the one or more directional audio signals. In other words, the wireless communication device 102 may generate a front left audio channel that corresponds to the front left audio signal. The plurality of audio channels may include a filtered range of frequencies (e.g., band 1B) and an unfiltered range of frequencies (e.g., bands 1A, 2A, 2B and/or 2C).

Generating 4404 the plurality of audio signal packets 3376 may also include applying codecs to the audio channels. For example, the wireless communication device 102 may apply one or more of a fullband codec, a wideband codec, a superwideband codec or a narrowband codec to the plurality of audio signals. More specifically, the wireless communication device 102 may compress at least one directional audio signal in a low band, and may compress a different directional audio signal in a high band.

In some implementations, generating 4404 the plurality of audio signal packets 3376 may be based on received input. For example, the wireless communication device 102 may receive input from a user to determine bit allocation of the codecs. In some cases, the bit allocation may be based on a visualization of the energy of the directions to be compressed. A wireless communication device 102 may also receive input associated with compressing the directional audio signals. For example, a wireless communication device 102 may receive input from a user on which directional audio signals to compress (and transmit over the air). In some cases, the input may indicate which directional audio signal should have better audio quality. In these examples, the input may be based on by a gesture of a user's hand, for example by touching a display of a wireless communication device. Similarly, the input may be based on a movement of the wireless communication device.

With the audio signal packets 3376 generated, the wireless communication device 102 may transmit 4406 the plurality of audio signal packets 3376 to a decoder. The wireless communication device 102 may transmit 4406 the plurality of audio signal packets 3376 over the air. In some configurations, the decoder is included in a wireless communication device 102 such as an audio sensing device.

Figure 45:
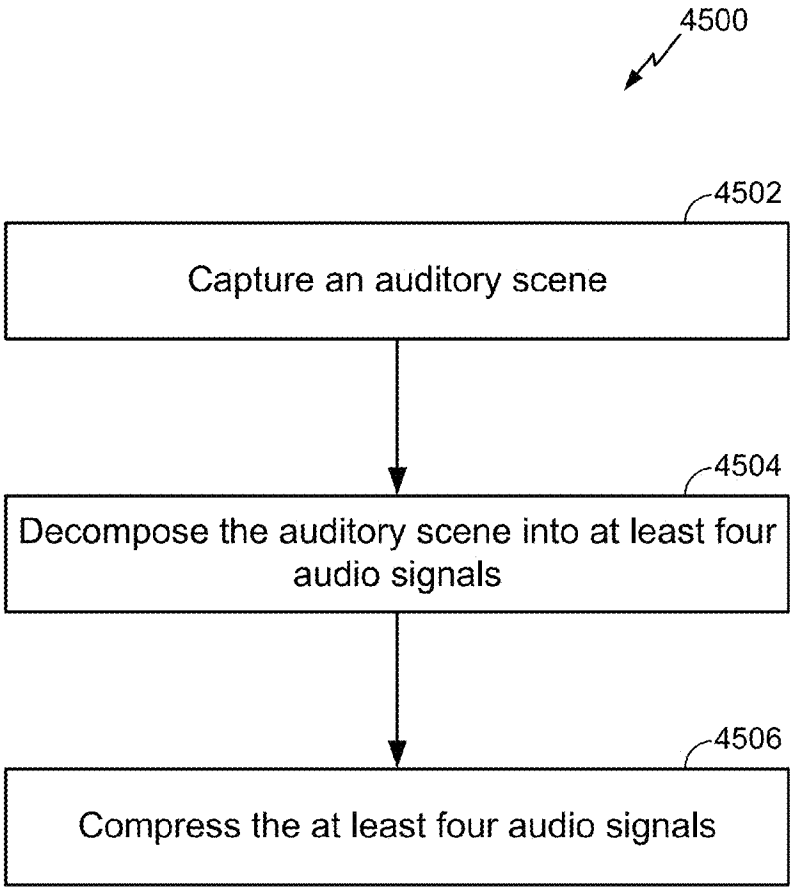
FIG. 45 is a flowchart illustrating a method for audio signal processing.

FIG. 45 is a flowchart illustrating a method 4500 for audio signal processing. The method 4500 may be performed by a wireless communication device 102. The wireless communication device 102 may capture 4500 an auditory scene. For example, a plurality of microphones may capture audio signals from a plurality of directional sources. The wireless communication device 102 may estimate a direction of arrival of each audio signal. In some implementations, the wireless communication device 102 may select a recording direction. Selecting a recording direction may be based on the orientation of a portable audio sensing device (e.g., a microphone on a wireless communication device). Additionally or alternatively, selecting a recording direction may be based on input. For example, a user may select a direction that should have better audio quality. The wireless communication device 102 may decompose 4504 the auditory scene into at least four audio signals. In some implementations, the audio signals correspond to four independent directions. For example, a first audio signal may correspond to a front left direction, a second audio signal may correspond to a back left direction, a third audio signal may correspond to a front right direction and a fourth audio signal may correspond to a back right direction. The wireless communication device 102 may also compress 4506 the at least four audio signals.

In some implementations, decomposing 4504 the auditory scene may include partitioning the audio signals into one or more frequency ranges. For example, the wireless communication device may partition the audio signals into a first set of narrowband frequency ranges and a second set of wideband frequency ranges. Additionally, the wireless communication device may compress audio samples that are associated with a first frequency band that is in the set of narrowband frequency ranges. With the audio samples compressed, the wireless communication device may transmit the compressed audio samples.

The wireless communication device 102 may also apply a beam in a first end-fire direction to obtain a first filtered signal. Similarly, a second beam in a second end-fire direction may generate a second filtered signal. In some cases, the beam may be applied to frequencies that are between a low threshold and a high threshold. In these cases, one of the thresholds (e.g., the low threshold or the high threshold) may be based on a distance between the microphones.

The wireless communication device may combine the first filtered signal with a delayed version of the second filtered signal. In some cases, the first and second filtered signals may each have two channels. In some cases one channel of a filtered signal (e.g., the first filtered signal and the second filtered signal) may be delayed relative to the other channel. Similarly, the combined signal (e.g., the combination of the first filtered signal and the second filtered signal) may have two channels that may be delayed relative to one another.

The wireless communication device 102 may include generating a first spatially filtered signal. For example, the wireless communication device 102 may apply a filter having a beam in a first direction to a signal produced by a first pair of microphones. In a similar fashion, the wireless communication device 102 may generate a second spatially filtered signal. In some cases, the axis of the first pair of microphones (e.g., those used to generate the first spatially filtered signal) may be at least substantially orthogonal to the axis of a second pair of microphones (e.g., those used to generate the second spatially filtered signal). The wireless communication device 102 may then combine the first spatially filtered signal and the second spatially filtered signal to generate an output signal. The output signal may correspond to a direction that is different than the direction of the first spatially filtered signal and the second spatially filtered signal.

The wireless communication device may also record an input channel. In some implementations, the input channel may correspond to each of a plurality of microphones in an array. For example, an input channel may correspond to the input of four microphones. A plurality of multichannel filters may be applied to the input channels to obtain an output channel. In some cases, the multichannel filters may correspond to a plurality of look directions. For example four multichannel filters may correspond to four look directions. Applying a multichannel filter in one look direction may include applying a null beam in other look directions. In some implementations, the axis of a first pair of the plurality of microphones may be less than fifteen degrees from orthogonal to the axis of a second pair of the plurality of microphones.

As described above, applying a plurality of multichannel filters may generate an output channel. In some cases, the wireless communication device 102 may process the output channel to produce a binaural recording that is based on a sum of binaural signals. For example, the wireless communication device 102 may apply a binaural impulse response to the output channel. This may result in a binaural signal which may be used to produce a binaural recording.

Figure 46:
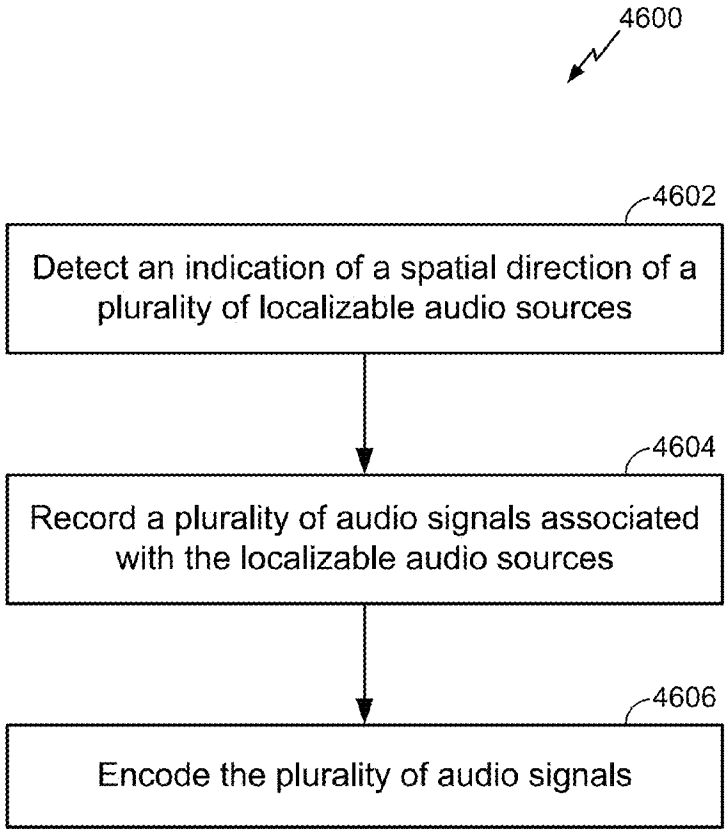
FIG. 46 is a flowchart illustrating a method for encoding three dimensional audio.

FIG. 46 is a flowchart illustrating a method 4600 for encoding three dimensional audio. The method 4600 may be performed by a wireless communication device 102. The wireless communication device 102 may detect 4602 an indication of a spatial direction of a plurality of localizable audio sources. As used herein, the term "localizable" refers to an audio source from a particular direction. For example a localizable audio source maybe an audio signal from a front left direction. The wireless communication device 102 may determine the number of localizable audio sources. This may include estimating a direction of arrival of each localizable audio source. In some cases, the wireless communication device 102 may detect an indication from a user interface 312. For example, a user may select one or more spatial directions based on user input from a user interface 312 of a wireless communication device 302. Examples of user input include, a gesture by a user's hand (e.g., on a touchscreen of a wireless communication device, a movement of the wireless communication device.)

The wireless communication device 102 may then record 4604 a plurality of audio signals associated with the localizable audio sources. For example, one or more microphones located on the wireless communication device 102 may record 4604 an audio signal coming from a front left, a front right, a back left and/or a back right direction.

The wireless communication device 102 may encode 4606 the plurality of audio signals. As described above, the wireless communication device 102 may use any number of codecs to encode the signal. For example, the wireless communication device 102 may encode 4606 a front left and back left audio signals using a fullband codec and may encode 4606 a front right and back right audio signals using a wideband codec. In some cases, the wireless communication device 102 may encode a multichannel signal according to a three dimensional audio encoding scheme. For example, the wireless communication device 102 may use any of the configuration schemes described in connection with FIGS. 29-32 to encode 4606 the plurality of audio signals.

The wireless communication device 102 may also apply a beam in a first end-fire direction to obtain a first filtered signal. Similarly, a second beam in a second end-fire direction may generate a second filtered signal. In some cases, the beam may be applied to frequencies that are between a low threshold and a high threshold. In these cases, one of the thresholds (e.g., the low threshold or the high threshold) may be based on a distance between the microphones.

The wireless communication device may combine the first filtered signal with a delayed version of the second filtered signal. In some cases, the first and second filtered signals may each have two channels. In some cases one channel of a filtered signal (e.g., the first filtered signal and the second filtered signal) may be delayed relative to the other channel. Similarly, the combined signal (e.g., the combination of the first filtered signal and the second filtered signal) may have two channels that may be delayed relative to one another.

The wireless communication device 102 may include generating a first spatially filtered signal. For example, the wireless communication device 102 may apply a filter having a beam in a first direction to a signal produced by a first pair of microphones. In a similar fashion, the wireless communication device 102 may generate a second spatially filtered signal. In some cases, the axis of the first pair of microphones (e.g., those used to generate the first spatially filtered signal) may be at least substantially orthogonal to the axis of a second pair of microphones (e.g., those used to generate the second spatially filtered signal). The wireless communication device 102 may then combine the first spatially filtered signal and the second spatially filtered signal to generate an output signal. The output signal may correspond to a direction that is different than the direction of the first spatially filtered signal and the second spatially filtered signal.

The wireless communication device may also record an input channel. In some implementations, the input channel may correspond to each of a plurality of microphones in an array. For example, an input channel may correspond to the input of four microphones. A plurality of multichannel filters may be applied to the input channels to obtain an output channel. In some cases, the multichannel filters may correspond to a plurality of look directions. For example four multichannel filters may correspond to four look directions. Applying a multichannel filter in one look direction may include applying a null beam in other look directions. In some implementations, the axis of a first pair of the plurality of microphones may be less than fifteen degrees from orthogonal to the axis of a second pair of the plurality of microphones.

As described above, applying a plurality of multichannel filters may generate an output channel. In some cases, the wireless communication device 102 may process the output channel to produce a binaural recording that is based on a sum of binaural signals. For example, the wireless communication device 102 may apply a binaural impulse response to the output channel. This may result in a binaural signal which may be used to produce a binaural recording.

Figure 47:
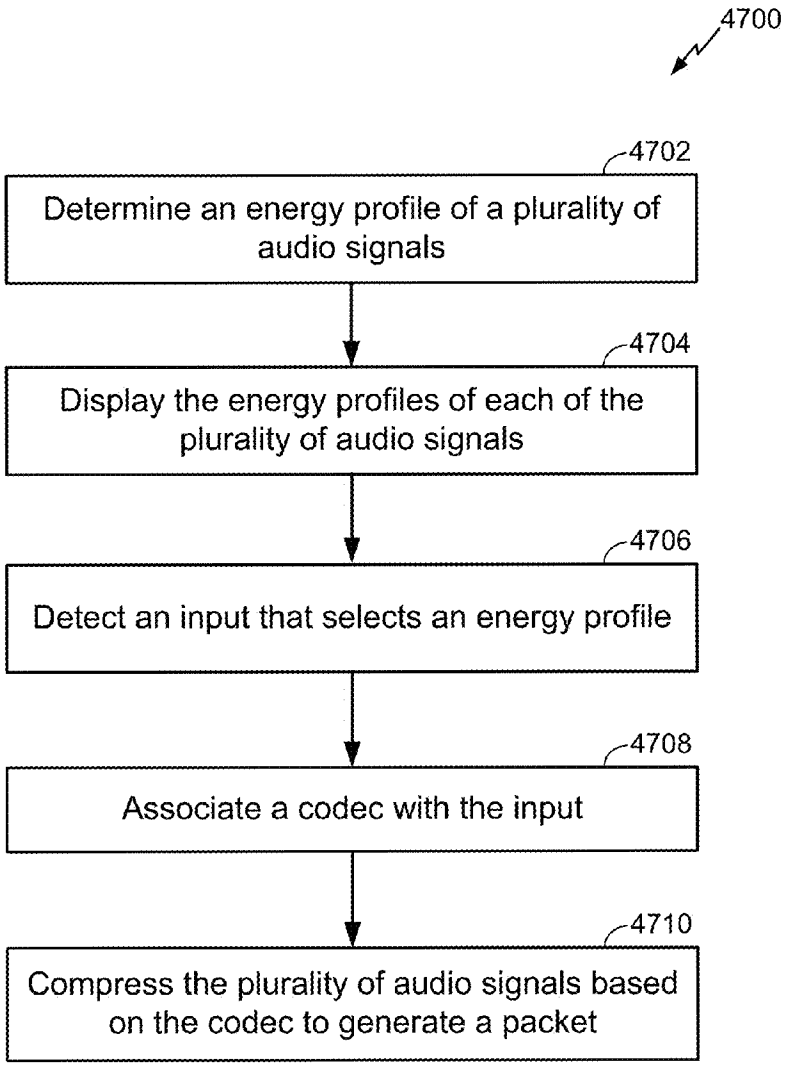
FIG. 47 is a flowchart illustrating a method for selecting a codec.

FIG. 47 is a flowchart illustrating a method 4700 for selecting a codec. The method 4700 may be performed by a wireless communication device 102. The wireless communication device 102 may determine 4702 an energy profile of a plurality of audio signals. The wireless communication device 102 may then display 4704 the energy profiles on each of the plurality of audio signals. For example, the wireless communication device 102 may display 4704 the energy profiles of a front left, a front right, a back left and a back right audio signal. The wireless communication device 102 may then detect 4706 an input that selects an energy profile. In some implementations, the input may be based on a user input. For example, a user may select an energy profile (e.g., corresponding to a directional sound) that should be compressed based on a graphical representation. In some examples, the selection may reflect an indication of which directional audio signal should have better sound quality, for example, the selection may reflect the direction where the user's voice is coming from.

The wireless communication device 102 may associate 4708 a codec associated with the input. For example, the wireless communication device 102 may associate 4708 a codec to produce better audio quality for a directional audio signal selected by the user. The wireless communication device 102 may then compress 4710 the plurality of audio signals based on the codec to generate an audio signal packet. As described above, the packet may then be transmitted over the air. In some implementations, the wireless communication device may also transmit a channel identification.

Figure 48:
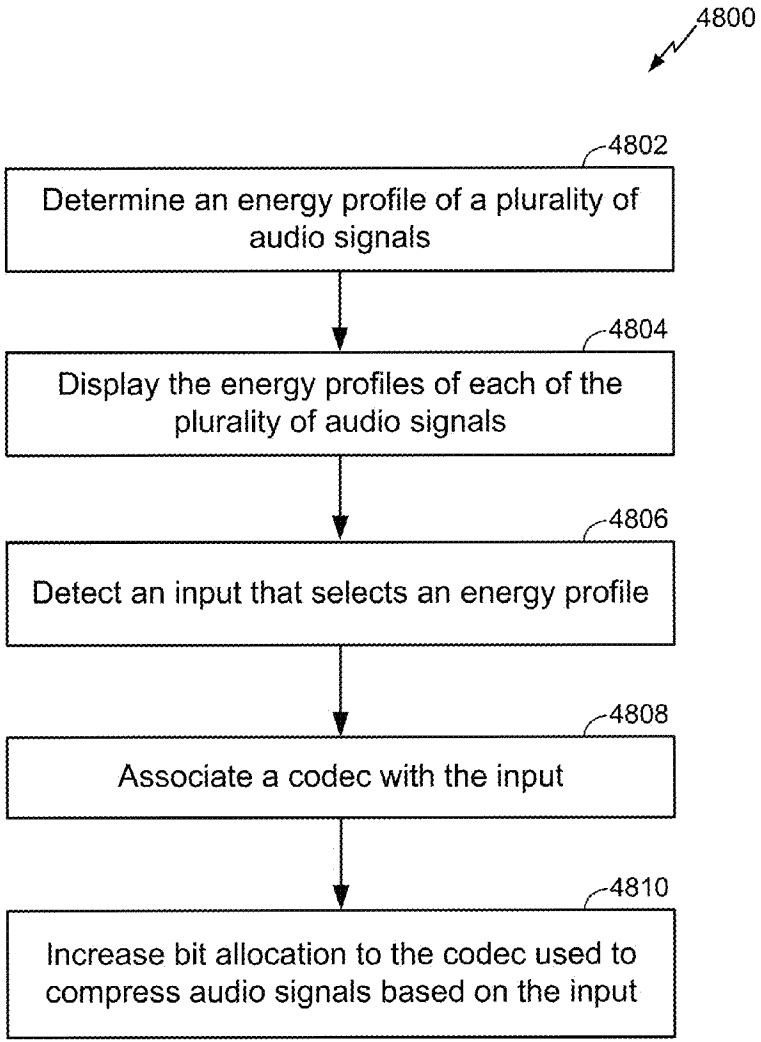
FIG. 48 is a flowchart illustrating a method for increasing bit allocation.

FIG. 48 is a flowchart illustrating a method 4800 for increasing bit allocation. The method 4800 may be performed by a wireless communication device 102. The wireless communication device 102 may determine 4802 an energy profile of a plurality of audio signals. The wireless communication device 102 may then display 4804 the energy profiles on each of the plurality of audio signals. For example, the wireless communication device 102 may display 4804 the energy profiles of a front left, a front right, a back left and a back right audio signal. The wireless communication device 102 may then detect 4806 an input that selects an energy profile. In some implementations, the input may be based on a user input. For example, a user may select an energy profile, based on a graphical representation, (e.g., corresponding to a directional sound) that should have more bits allocated for compression. In some examples, the selection may reflect an indication of which directional audio signal should have better sound quality, for example, the selection may reflect the direction where the user's voice is coming from.

The wireless communication device 102 may associate 4808 a codec associated with the input. For example, the wireless communication device 102 may associate 4808 a codec to produce better audio quality for a directional audio signal selected by the user. The wireless communication device 102 may then increase 4810 bit allocation to the codec used to compress audio signals based on the input. As described above, the packet may then be transmitted over the air.

Figure 49:
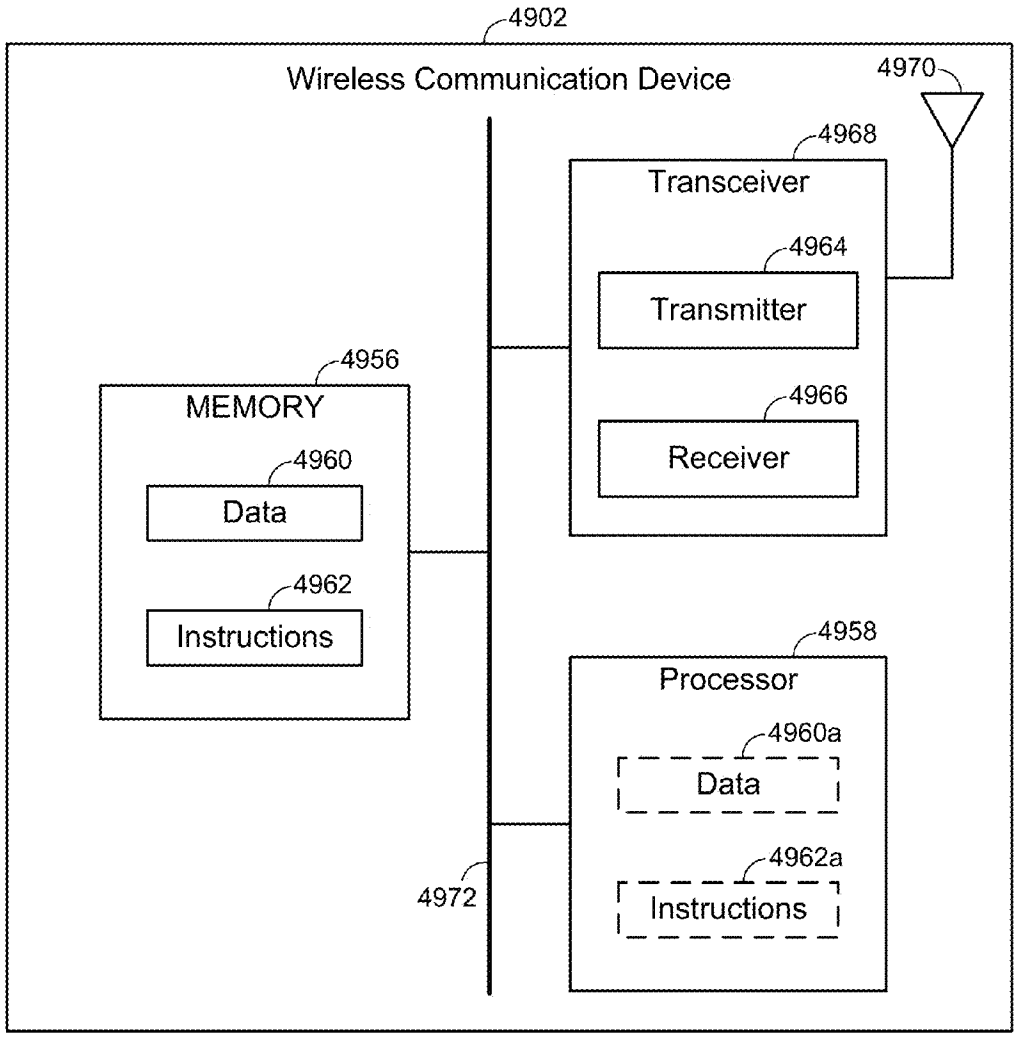
FIG. 49 illustrates certain components that may be included within a wireless communication device.

FIG. 49 illustrates certain components that may be included within a wireless communication device 4902. One or more of the wireless communication devices described above may be configured similarly to the wireless communication device 4902 that is shown in FIG. 49.

The wireless communication device 4902 includes a processor 4958. The processor 4958 may be a general purpose single- or multi-chip microprocessor (e.g., an ARM), a special purpose microprocessor (e.g., a digital signal processor (DSP)), a microcontroller, a programmable gate array, etc. The processor 4958 may be referred to as a central processing unit (CPU). Although just a single processor 4958 is shown in the wireless communication device 4902 of FIG. 49, in an alternative configuration, a combination of processors 4958 (e.g., an ARM and DSP) could be used.

The wireless communication device 4958 also includes memory 4956 in electronic communication with the processor 4958 (i.e., the processor 4958 can read information from and/or write information to the memory 4956). The memory 4956 may be any electronic component capable of storing electronic information. The memory 4956 may be random access memory (RAM), read-only memory (ROM), magnetic disk storage media, optical storage media, flash memory devices in RAM, on-board memory included with the processor 4958, programmable read-only memory (PROM), erasable programmable read-only memory (EPROM), electrically erasable PROM (EEPROM), registers, and so forth, including combinations thereof.

Data 4960 and instructions 4962 may be stored in the memory 4956. The instructions 4962 may include one or more programs, routines, sub-routines, functions, procedures, code, etc. The instructions 4962 may include a single computer-readable statement or many computer-readable statements. The instructions 4962 may be executable by the processor 4958 to implement one or more of the methods described above. Executing the instructions 4962 may involve the use of the data 4960 that is stored in the memory 4956. FIG. 49 illustrates some instructions 4962*a* and data 4960*a* being loaded into the processor 4958 (which may come from instructions 4962 and data 4960 in memory 4956).

The wireless communication device 4902 may also include a transmitter 4964 and a receiver 4966 to allow transmission and reception of signals between the wireless communication device 4902 and a remote location (e.g., a communication device, base station, etc.). The transmitter 4964 and receiver 4966 may be collectively referred to as a transceiver 4968. An antenna 4970 may be electrically coupled to the transceiver 4968. The wireless communication device 4902 may also include (not shown) multiple transmitters 4964, multiple receivers 4966, multiple transceivers 4968 and/or multiple antennas 4970.

In some configurations, the wireless communication device 4902 may include one or more microphones for capturing acoustic signals. In one configuration, a microphone may be a transducer that converts acoustic signals (e.g., voice, speech) into electrical or electronic signals. Additionally or alternatively, the wireless communication device 4902 may include one or more speakers. In one configuration, a speaker may be a transducer that converts electrical or electronic signals into acoustic signals.

The various components of the wireless communication device 4902 may be coupled together by one or more buses, which may include a power bus, a control signal bus, a status signal bus, a data bus, etc. For simplicity, the various buses are illustrated in FIG. 49 as a bus system 4972.

The methods and apparatus disclosed herein may be applied generally in any transceiving and/or audio sensing application, especially mobile or otherwise portable instances of such applications. For example, the range of configurations disclosed herein includes communications devices that reside in a wireless telephony communication system configured to employ a code-division multiple-access (CDMA) over-the-air interface. Nevertheless, it would be understood by those skilled in the art that a method and apparatus having features as described herein may reside in any of the various communication systems employing a wide range of technologies known to those of skill in the art, such as systems employing Voice over IP (VoIP) over wired and/or wireless (e.g., CDMA, TDMA, FDMA, and/or TD-SCDMA) transmission channels.

It is expressly contemplated and hereby disclosed that communications devices disclosed herein may be adapted for use in networks that are packet-switched (for example, wired and/or wireless networks arranged to carry audio transmissions according to protocols such as VoIP) and/or circuit-switched. It is also expressly contemplated and hereby disclosed that communications devices disclosed herein may be adapted for use in narrowband coding systems (e.g., systems that encode an audio frequency range of about four or five kilohertz) and/or for use in wideband coding systems (e.g., systems that encode audio frequencies greater than five kilohertz), including whole-band wideband coding systems and split-band wideband coding systems.

The foregoing presentation of the described configurations is provided to enable any person skilled in the art to make or use the methods and other structures disclosed herein. The flowcharts, block diagrams, and other structures shown and described herein are examples only, and other variants of these structures are also within the scope of the disclosure. Various modifications to these configurations are possible, and the generic principles presented herein may be applied to other configurations as well. Thus, the present disclosure is not intended to be limited to the configurations shown above but rather is to be accorded the widest scope consistent with the principles and novel features disclosed in any fashion herein, including in the attached claims as filed, which form a part of the original disclosure.

Those of skill in the art will understand that information and signals may be represented using any of a variety of different technologies and techniques. For example, data, instructions, commands, information, signals, bits and symbols that may be referenced throughout the above description may be represented by voltages, currents, electromagnetic waves, magnetic fields or particles, optical fields or particles, or any combination thereof.

Important design requirements for implementation of a configuration as disclosed herein may include minimizing processing delay and/or computational complexity (typically measured in millions of instructions per second or MIPS), especially for computation-intensive applications, such as playback of compressed audio or audiovisual information (e.g., a file or stream encoded according to a compression format, such as one of the examples identified herein) or applications for wideband communications (e.g., voice communications at sampling rates higher than eight kilohertz, such as 12, 16, or 44 kHz).

Goals of a multi-microphone processing system may include achieving ten to twelve dB in overall noise reduction, preserving voice level and color during movement of a desired speaker, obtaining a perception that the noise has been moved into the background instead of an aggressive noise removal, dereverberation of speech, and/or enabling the option of post-processing for more aggressive noise reduction.

The various elements of an implementation of an apparatus as disclosed herein may be embodied in any combination of hardware with software, and/or with firmware, that is deemed suitable for the intended application. For example, such elements may be fabricated as electronic and/or optical devices residing, for example, on the same chip or among two or more chips in a chipset. One example of such a device is a fixed or programmable array of logic elements, such as transistors or logic gates, and any of these elements may be implemented as one or more such arrays. Any two or more, or even all, of these elements may be implemented within the same array or arrays. Such an array or arrays may be implemented within one or more chips (for example, within a chipset including two or more chips).

One or more elements of the various implementations of the apparatus disclosed herein may also be implemented in whole or in part as one or more sets of instructions arranged to execute on one or more fixed or programmable arrays of logic elements, such as microprocessors, embedded processors, IP cores, digital signal processors, FPGAs (field-programmable gate arrays), ASSPs (application-specific standard products), and ASICs (application-specific integrated circuits). Any of the various elements of an implementation of an apparatus as disclosed herein may also be embodied as one or more computers (e.g., machines including one or more arrays programmed to execute one or more sets or sequences of instructions, also called "processors"), and any two or more, or even all, of these elements may be implemented within the same such computer or computers.

A processor or other means for processing as disclosed herein may be fabricated as one or more electronic and/or optical devices residing, for example, on the same chip or among two or more chips in a chipset. One example of such a device is a fixed or programmable array of logic elements, such as transistors or logic gates, and any of these elements may be implemented as one or more such arrays. Such an array or arrays may be implemented within one or more chips (for example, within a chipset including two or more chips). Examples of such arrays include fixed or programmable arrays of logic elements, such as microprocessors, embedded processors, IP cores, DSPs, FPGAs, ASSPs and ASICs. A processor or other means for processing as disclosed herein may also be embodied as one or more computers (e.g., machines including one or more arrays programmed to execute one or more sets or sequences of instructions) or other processors. It is possible for a processor as described herein to be used to perform tasks or execute other sets of instructions that are not directly related to a directional encoding procedure, such as a task relating to another operation of a device or system in which the processor is embedded (e.g., an audio sensing device). It is also possible for part of a method as disclosed herein to be performed by a processor of the audio sensing device and for another part of the method to be performed under the control of one or more other processors.

Those of skill will appreciate that the various illustrative modules, logical blocks, circuits, and tests and other operations described in connection with the configurations disclosed herein may be implemented as electronic hardware, computer software or combinations of both. Such modules, logical blocks, circuits, and operations may be implemented or performed with a general purpose processor, a digital signal processor (DSP), an ASIC or ASSP, an FPGA or other programmable logic device, discrete gate or transistor logic, discrete hardware components, or any combination thereof designed to produce the configuration as disclosed herein. For example, such a configuration may be implemented at least in part as a hard-wired circuit, as a circuit configuration fabricated into an application-specific integrated circuit, or as a firmware program loaded into non-volatile storage or a software program loaded from or into a data storage medium as machine-readable code, such code being instructions executable by an array of logic elements such as a general purpose processor or other digital signal processing unit. A general purpose processor may be a microprocessor, but in the alternative, the processor may be any conventional processor, controller, microcontroller or state machine. A processor may also be implemented as a combination of computing devices, e.g., a combination of a DSP and a microprocessor, a plurality of microprocessors, one or more microprocessors in conjunction with a DSP core, or any other such configuration. A software module may reside in RAM (random-access memory), ROM (read-only memory), nonvolatile RAM (NVRAM) such as flash RAM, erasable programmable ROM (EPROM), electrically erasable programmable ROM (EEPROM), registers, hard disk, a removable disk, a CD-ROM or any other form of storage medium known in the art. An illustrative storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

It is noted that the various methods disclosed herein may be performed by an array of logic elements such as a processor, and that the various elements of an apparatus as described herein may be implemented as modules designed to execute on such an array. As used herein, the term "module" or "sub-module" can refer to any method, apparatus, device, unit or computer-readable data storage medium that includes computer instructions (e.g., logical expressions) in software, hardware or firmware form. It is to be understood that multiple modules or systems can be combined into one module or system and one module or system can be separated into multiple modules or systems to perform the same functions. When implemented in software or other computer-executable instructions, the elements of a process are essentially the code segments to perform the related tasks, such as with routines, programs, objects, components, data structures, and the like. The term "software" should be understood to include source code, assembly language code, machine code, binary code, firmware, macrocode, microcode, any one or more sets or sequences of instructions executable by an array of logic elements, and any combination of such examples. The program or code segments can be stored in a processor readable medium or transmitted by a computer data signal embodied in a carrier wave over a transmission medium or communication link.

The implementations of methods, schemes, and techniques disclosed herein may also be tangibly embodied (for example, in one or more computer-readable media as listed herein) as one or more sets of instructions readable and/or executable by a machine including an array of logic elements (e.g., a processor, microprocessor, microcontroller, or other finite state machine). The term "computer-readable medium" may include any medium that can store or transfer information, including volatile, nonvolatile, removable and non-removable media. Examples of a computer-readable medium include an electronic circuit, a semiconductor memory device, a ROM, a flash memory, an erasable ROM (EROM), a floppy diskette or other magnetic storage, a CD-ROM/DVD or other optical storage, a hard disk, a fiber optic medium, a radio frequency (RF) link, or any other medium which can be used to store the desired information and which can be accessed. The computer data signal may include any signal that can propagate over a transmission medium such as electronic network channels, optical fibers, air, electromagnetic, RF links, etc. The code segments may be downloaded via computer networks such as the Internet or an intranet. In any case, the scope of the present disclosure should not be construed as limited by such configurations.

Each of the tasks of the methods described herein may be embodied directly in hardware, in a software module executed by a processor, or in a combination of the two. In a typical application of an implementation of a method as disclosed herein, an array of logic elements (e.g., logic gates) is configured to perform one, more than one or even all of the various tasks of the method. One or more (possibly all) of the tasks may also be implemented as code (e.g., one or more sets of instructions), embodied in a computer program product (e.g., one or more data storage media such as disks, flash or other nonvolatile memory cards, semiconductor memory chips, etc.), that is readable and/or executable by a machine (e.g., a computer) including an array of logic elements (e.g., a processor, microprocessor, microcontroller, or other finite state machine). The tasks of an implementation of a method as disclosed herein may also be performed by more than one such array or machine. In these or other implementations, the tasks may be performed within a device for wireless communications such as a cellular telephone or other device having such communications capability. Such a device may be configured to communicate with circuit-switched and/or packet-switched networks (e.g., using one or more protocols such as VoIP). For example, such a device may include RF circuitry configured to receive and/or transmit encoded frames.

It is expressly disclosed that the various methods disclosed herein may be performed by a portable communications device such as a handset, headset, or portable digital assistant (PDA), and that the various apparatus described herein may be included within such a device. A typical real-time (e.g., online) application is a telephone conversation conducted using such a mobile device.

In one or more exemplary configurations, the operations described herein may be implemented in hardware, software, firmware or any combination thereof. If implemented in software, such operations may be stored on or transmitted over a computer-readable medium as one or more instructions or code. The term "computer-readable media" includes both computer storage media and communication media, including any medium that facilitates transfer of a computer program from one place to another. A storage media may be any available media that can be accessed by a computer. By way of example, and not limitation, such computer-readable media can comprise an array of storage elements, such as semiconductor memory (which may include without limitation dynamic or static RAM, ROM, EEPROM, and/or flash RAM), or ferroelectric, magnetoresistive, ovonic, polymeric, or phase-change memory; CD-ROM or other optical disk storage, magnetic disk storage or other magnetic storage devices, or any other medium that can be used to store desired program code, in the form of instructions or data structures, in tangible structures that can be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technology such as infrared, radio, and/or microwave, then the coaxial cable, fiber optic cable, twisted pair, DSL, or wireless technology such as infrared, radio, and/or microwave are included in the definition of medium. Disk and disc, as used herein, includes compact disc (CD), laser disc, optical disc, digital versatile disc (DVD), floppy disk and Blu-ray Disc™ (Blu-Ray Disc Association, Universal City, Calif.), where disks usually reproduce data magnetically, while discs reproduce data optically with lasers. Combinations of the above should also be included within the scope of computer-readable media.

An acoustic signal processing apparatus as described herein may be incorporated into an electronic device that accepts speech input in order to control certain operations, or may otherwise benefit from separation of desired noises from background noises, such as communications devices. Many applications may benefit from enhancing or separating clear desired sound from background sounds originating from multiple directions. Such applications may include human-machine interfaces in electronic or computing devices which incorporate capabilities such as voice recognition and detection, speech enhancement and separation, voice-activated control, and the like. It may be desirable to implement such an acoustic signal processing apparatus to be suitable in devices that only provide limited processing capabilities.

The elements of the various implementations of the modules, elements and devices described herein may be fabricated as electronic and/or optical devices residing, for example, on the same chip or among two or more chips in a chipset. One example of such a device is a fixed or programmable array of logic elements, such as transistors or gates. One or more elements of the various implementations of the apparatus described herein may also be implemented in whole or in part as one or more sets of instructions arranged to execute on one or more fixed or programmable arrays of logic elements such as microprocessors, embedded processors, IP cores, digital signal processors, FPGAs, ASSPs and ASICs.

It is possible for one or more elements of an implementation of an apparatus as described herein to be used to perform tasks or execute other sets of instructions that are not directly related to an operation of the apparatus, such as a task relating to another operation of a device or system in which the apparatus is embedded. It is also possible for one or more elements of an implementation of such an apparatus to have structure in common (e.g., a processor used to execute portions of code corresponding to different elements at different times, a set of instructions executed to perform tasks corresponding to different elements at different times, or an arrangement of electronic and/or optical devices performing operations for different elements at different times).

In the above description, reference numbers have sometimes been used in connection with various terms. Where a term is used in connection with a reference number, this may be meant to refer to a specific element that is shown in one or more of the Figures. Where a term is used without a reference number, this may be meant to refer generally to the term without limitation to any particular Figure.

In accordance with the present disclosure, a circuit in a mobile device may be adapted to receive signal conversion commands and accompanying data in relation to multiple types of compressed audio bitstreams. The same circuit, a different circuit or a second section of the same or different circuit may be adapted to perform a transform as part of signal conversion for the multiple types of compressed audio bitstreams. The second section may advantageously be coupled to the first section, or it may be embodied in the same circuit as the first section. In addition, the same circuit, a different circuit, or a third section of the same or different circuit may be adapted to perform complementary processing as part of the signal conversion for the multiple types of compressed audio bitstreams. The third section may advantageously be coupled to the first and second sections, or it may be embodied in the same circuit as the first and second sections. In addition, the same circuit, a different circuit, or a fourth section of the same or different circuit may be adapted to control the configuration of the circuit(s) or section(s) of circuit(s) that provide the functionality described above.

The term "determining" encompasses a wide variety of actions and, therefore, "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

What is claimed is:

1. A method of transmitting three-dimensional audio by a wireless communication device, comprising:

capturing an auditory scene;

decomposing the auditory scene, based on using at least two microphone pairs located on the wireless communication device, into one or more audio signals representing different directions, representing one or more corners of the wireless communication device;

compressing the at least one or more audio signals, using at least one codec, to generate audio signal packets; and transmitting the audio signal packets over the air in real-time.

2. The method of claim 1, wherein the one or more corners of the wireless communication device include a front left direction, a back left direction, a front right direction, and a back right direction.

3. The method of claim 2, wherein the one or more corners of the wireless communication device are associated with a standard channel format surround sound system.

4. The method of claim 1, where the audio signal packets are transmitted over the air over a traffic channel during a call.

5. The method of claim 1, where the at least one codec is a speech codec.

6. The method of claim 1, wherein the decomposing the auditory scene includes forming a first beam from one microphone pair in the at least two microphone pairs, and forming a second beam from a second microphone pair in the at least two microphone pairs.

7. The method of claim 6, wherein the first beam and second beam are combined to amplify audio signals associated with a direction representing at least one corner of the one or more corners of the wireless communication device.

8. The method of claim 6, wherein the first beam and second beam are null beams that are combined to attenuate audio signals associated with a direction representing at least one corner of the one or more corners of the wireless communication device.

9. A wireless communication device that is configured to transmit three-dimensional audio, comprising:

one or more processors configured to:

capture an auditory scene;

decompose the auditory scene, based on using at least two microphone pairs located on the wireless communication device, into one or more audio signals representing different directions, representing one or more corners of the wireless communication device;

compress the at least one or more audio signals, using at least one codec, to generate audio signal packets; and transmit the audio signal packets over the air in real-time.

10. The wireless communication device of claim 9, wherein the one or more corners of the wireless communication device include a front left direction, a back left direction, a front right direction, and a back right direction.

11. The wireless communication device of claim 10, wherein the one or more corners of the wireless communication device are associated with a standard channel format surround sound system.

12. The wireless communication device of claim 9, where the audio signal packets are transmitted over the air over a traffic channel during a call.

13. The wireless communication device of claim 9, where the at least one codec is a speech codec.

14. The wireless communication device of claim 9, wherein the decomposing the auditory scene includes forming a first beam from one microphone pair in the at least two microphone pairs, and forming a second beam from a second microphone pair in the at least two microphone pairs.

15. The wireless communication device of claim 14, wherein the first beam and second beam are combined to amplify audio signals associated with a direction representing at least one corner of the one or more corners of the wireless communication device.

16. The wireless communication device of claim 14, wherein the first beam and second beam are null beams that are combined to attenuate audio signals associated with a direction representing at least one corner of the one or more corners of the wireless communication device.

17. An apparatus that is configured to transmit three-dimensional audio, comprising:

means for capturing an auditory scene;

means for decomposing the auditory scene, based on using at least two microphone pairs located on a wireless communication device, into one or more audio signals representing different directions, representing one or more corners of the wireless communication device;

means for compressing the at least one or more audio signals, using at least one codec, to generate audio signal packets; and means for transmitting the audio signal packets over the air in real-time.

18. The apparatus of claim 17, wherein the one or more corners of the wireless communication device include a front left direction, a back left direction, a front right direction, and a back right direction.

19. The apparatus of claim 18, wherein the one or more corners of the wireless communication device are associated with a standard channel format surround sound system.

20. The apparatus of claim 17, where the audio signal packets are transmitted over the air over a traffic channel during a call.

21. The apparatus of claim 17, where the at least one codec is a speech codec.

22. The apparatus of claim 17, wherein the decomposing the auditory scene includes forming a first beam from one microphone pair in the at least two microphone pairs, and forming a second beam from a second microphone pair in the at least two microphone pairs.

23. The apparatus of claim 22, wherein the first beam and second beam are combined to amplify audio signals associated with a direction representing at least one corner of the one or more corners of the wireless communication device.

24. The apparatus of claim 22, wherein the first beam and second beam are null beams that are combined to attenuate audio signals associated with a direction representing at least one corner of the one or more corners of the wireless communication device.

25. A non-transitory tangible computer-readable medium that is configured to facilitate transmission of three-dimensional audio by a wireless communication device, the computer-readable medium having instructions thereon, the instructions comprising:

code for causing the wireless communication device to capture an auditory scene;

code for causing the wireless communication device to decompose the auditory scene, based on using at least two microphone pairs located on the wireless communication device, into one or more audio signals representing different directions, representing one or more corners of the wireless communication device;

code for causing the wireless communication device to compress the at least one or more audio signals, using at least one codec, to generate audio signal packets; and code for causing the wireless communication device to transmit the audio signal packets over the air in real-time.

26. The computer-readable medium of claim 25, wherein the one or more corners of the wireless communication device include a front left direction, a back left direction, a front right direction, and a back right direction.

27. The computer-readable medium of claim 26, wherein the one or more corners of the wireless communication device are associated with a standard channel format surround sound system.

28. The computer-readable medium of claim 25, where the audio signal packets are transmitted over the air over a traffic channel during a call.

29. The computer-readable medium of claim 25, where the at least one codec is a speech codec.

30. The computer-readable medium of claim 25, wherein the decomposing the auditory scene includes forming a first beam from one microphone pair in the at least two microphone pairs, and forming a second beam from a second microphone pair in the at least two microphone pairs.

31. The computer-readable medium of claim 30, wherein the first beam and second beam are combined to amplify audio signals associated with a direction representing at least one corner of the one or more corners of the wireless communication device.

32. The computer-readable medium of claim 30, wherein the first beam and second beam are null beams that are combined to attenuate audio signals associated with a direction representing at least one corner of the one or more corners of the wireless communication device.

* * * * *